United States Patent [19]

Oura

[11] Patent Number: 4,577,343

[45] Date of Patent: Mar. 18, 1986

[54] SOUND SYNTHESIZER

[75] Inventor: Toshio Oura, Tokyo, Japan

[73] Assignee: Nippon Electric Co. Ltd., Tokyo, Japan

[21] Appl. No.: 531,195

[22] Filed: Sep. 12, 1983

Related U.S. Application Data

[63] Continuation of Ser. No. 214,931, Dec. 10, 1980, abandoned.

[30] Foreign Application Priority Data

Dec. 10, 1979 [JP] Japan ..... 54-159909

[51] Int. Cl.[4] ..... G10L 1/00

[52] U.S. Cl. ..... 381/51

[58] Field of Search ..... 381/51–53; 364/513, 513.5; 84/1.01, 1.03

[56] References Cited

U.S. PATENT DOCUMENTS 3,641,496 2/1972 Slavin ..... 179/1.5 M
3,913,442 10/1975 Deutsch ..... 84/1.19
4,163,120 7/1979 Baumwolspiner ..... 179/1.5 M

FOREIGN PATENT DOCUMENTS 124604 9/1979 Japan ..... 179/1.5 M

OTHER PUBLICATIONS

Flanagan, "Speech Analysis . . . ", Springer Verlag, 1972, pp. 150–152.

*Primary Examiner*—E. S. Matt Kemeny
*Attorney, Agent, or Firm*—Sughrue, Mion, Zinn, Macpeak, and Seas

[57] ABSTRACT

Speech is synthesized by repeated readout of prestored basic speech waveforms. For varying the speech tone frequency, readout is done at a fixed rate but skipping samples sequentially stored.

7 Claims, 74 Drawing Figures

FIG. 8

| ROM ADDRESS | ODD NUMBER SIGN 16 | LEVEL 15 | 14 | 13 | 12 | 11 | 10 | 9 | EVEN NUMBER SIGN 8 | LEVEL 7 | 6 | 5 | 4 | 3 | 2 | 1 | (TABLE) |
|---|---|---|---|---|---|---|---|---|---|---|---|---|---|---|---|---|---|
| 1000 | 0 | 0 | 0 | 1 | 0 | 1 | 0 | 0 | 0 | 0 | 0 | 0 | 0 | 0 | 0 | 0 | NORMALIZED WAVEFORM DATA OF FIG. 4(a) |
| 1001 | 0 | 0 | 1 | 1 | 1 | 0 | 0 | 1 | 0 | 0 | 1 | 0 | 1 | 0 | 1 | 0 | |
| 1002 | 0 | 1 | 1 | 0 | 1 | 0 | 1 | 1 | 0 | 1 | 0 | 0 | 1 | 1 | 1 | 1 | |
| 1003 | 0 | 1 | 1 | 1 | 1 | 1 | 1 | 1 | 0 | 1 | 1 | 1 | 0 | 1 | 1 | 0 | |
| 1004 | 0 | 1 | 0 | 1 | 1 | 0 | 0 | 1 | 0 | 1 | 1 | 0 | 0 | 0 | 0 | 1 | |
| 1005 | 1 | 0 | 1 | 1 | 0 | 1 | 1 | 0 | 0 | 0 | 0 | 0 | 0 | 0 | 1 | 0 | |
| 1006 | 1 | 1 | 0 | 1 | 1 | 0 | 0 | 0 | 1 | 1 | 1 | 0 | 1 | 0 | 0 | 1 | |
| 1007 | 1 | 0 | 1 | 1 | 0 | 0 | 1 | 0 | 1 | 1 | 0 | 1 | 0 | 0 | 0 | 1 | |
| 1008 | 0 | 0 | 0 | 1 | 0 | 0 | 1 | 0 | 1 | 0 | 0 | 1 | 0 | 0 | 0 | 1 | |
| ⋮ | | | | | | | | | | | | | | | | | |
| 101E | 1 | 0 | 0 | 0 | 1 | 1 | 0 | 0 | 0 | 0 | 0 | 1 | 0 | 1 | 1 | 0 | |
| 101F | 1 | 0 | 0 | 0 | 0 | 1 | 1 | 0 | 0 | 0 | 0 | 0 | 0 | 1 | 1 | 0 | |
| 1020 | 0 | 0 | 0 | 1 | 0 | 1 | 1 | 0 | 0 | 0 | 0 | 0 | 0 | 0 | 0 | 0 | NORMALIZED WAVEFORM DATA OF FIG. 3(d) |
| ⋮ | | | | | | | | | | | | | | | | | |
| 103F | 1 | 0 | 0 | 0 | 0 | 1 | 1 | 1 | 1 | 0 | 0 | 1 | 0 | 1 | 0 | 1 | |
| 1040 | 0 | 0 | 0 | 1 | 0 | 0 | 1 | 0 | 0 | 0 | 0 | 0 | 0 | 0 | 0 | 0 | NORMALIZED WAVEFORM DATA OF FIG. 4(c) |
| ⋮ | | | | | | | | | | | | | | | | | |
| 104F | 1 | 0 | 0 | 0 | 1 | 0 | 0 | 1 | 1 | 0 | 0 | 1 | 0 | 1 | 0 | 0 | |
| 1050 | | | | | | | | | | | | | | | | | PREPARED OTHER WAVEFORM DATA |
| ⋮ | | | | | | | | | | | | | | | | | |

FIG. 9

| | ODD NUMBER | | | | | | | | EVEN NUMBER | | | | | | | | |
|---|---|---|---|---|---|---|---|---|---|---|---|---|---|---|---|---|---|
| | | | | LEVEL | | | | | | | | LEVEL | | | | | |
| | 16 | 15 | 14 | 13 | 12 | 11 | 10 | 9 | 8 | 7 | 6 | 5 | 4 | 3 | 2 | 1 | (TABLE) |
| XX30 | | | | 0 | 0 | 0 | 1 | 0 | | | | 0 | 0 | 0 | 0 | 1 | NORMALIZED ENVELOPE DATA OF FIG. 4(b) |
| 31 | | | | 0 | 0 | 1 | 1 | 1 | | | | 0 | 0 | 1 | 0 | 0 | |
| 32 | | | | 1 | 0 | 1 | 0 | 0 | | | | 0 | 1 | 0 | 1 | 1 | |
| 33 | | | | 1 | 1 | 0 | 1 | 1 | | | | 1 | 1 | 0 | 0 | 0 | |
| 34 | | | | 1 | 0 | 1 | 1 | 0 | | | | 1 | 1 | 1 | 0 | 1 | |
| 35 | | | | 1 | 0 | 1 | 1 | 0 | | | | 1 | 1 | 1 | 1 | 1 | |
| 36 | | | | 1 | 1 | 0 | 1 | 0 | | | | 1 | 1 | 1 | 0 | 1 | |
| ⋮ | | | | | | | | | | | | | | | | | |
| 3E | | | | 0 | 0 | 0 | 1 | 0 | | | | 0 | 0 | 0 | 1 | 1 | |
| 3F | | | | 0 | 0 | 0 | 0 | 0 | | | | 0 | 0 | 0 | 0 | 1 | |
| XX40 | | | | 1 | 1 | 1 | 1 | 1 | | | | 0 | 0 | 1 | 0 | 0 | NORMALIZED ENVELOPE DATA OF FIG. 4(d) |
| 41 | | | | 1 | 1 | 1 | 0 | 1 | | | | 1 | 1 | 1 | 1 | 0 | |
| 4F | | | | 0 | 0 | 0 | 0 | 0 | | | | 0 | 0 | 1 | 0 | 1 | |
| | | | | | | | | | | | | | | | | | OTHER ENVELOPE DATA OF SPEECH SOUND, IMITATION SOUND, MUSICAL SOUND, etc. |

FIG. 11

| H | L=1 | L=0 |
|---|---|---|
| 0 | $R_1$ TONE WAVEFORM UPPER ADDRESS | $R_0$ TONE WAVEFORM LOWER ADDRESS |
| 1 | $R_3$ TONE ENVELOPE UPPER ADDRESS | $R_2$ TONE ENVELOPE LOWER ADDRESS |
| 2 | $R_5$ NOISE ENVELOPE UPPER ADDRESS | $R_4$ NOISE ENVELOPE LOWER ADDRESS |
| 3 | $R_7$ TIME COUNT UPPER DATA | $R_6$ TIME COUNT LOWER DATA |
| 4 | $R_9$ TONE ENVELOPE TIME COUNT | $R_8$ TONE ENVELOPE TIME RATE |
| 5 | $R_B$ NOISE ENVELOPE TIME COUNT | $R_A$ NOISE ENVELOPE TIME RATE |
| 6 | $R_D$ TONE PEAK | $R_C$ NOISE PEAK |
| 7 | $R_F$ NEXT TONE ADDRESS | $R_E$ NEXT TONE ADDRESS |
| 8 | $R_{11}$ TONE OUTPUT DATA | $R_{10}$ TONE OUTPUT DATA |
| 9 | $R_{13}$ NOISE OUTPUT DATA | $R_{12}$ NOISE OUTPUT DATA |
| A | | |
| B | | |
| C | | |
| ⋮ | | |

FIG. 17
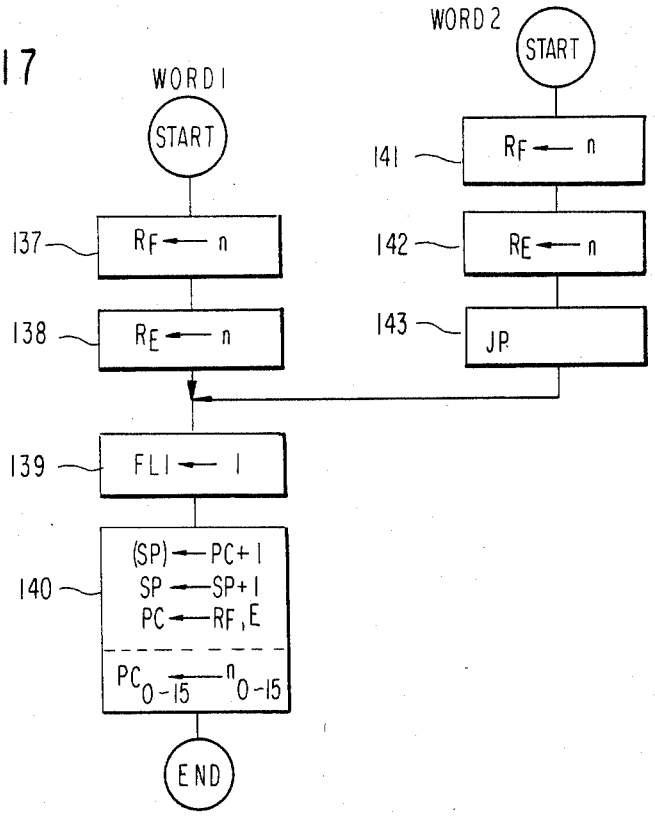
FIG. 18(a) N=64
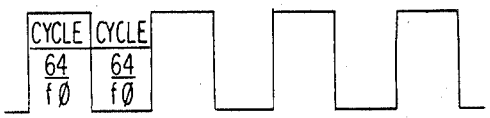
FIG. 18(b) N=32
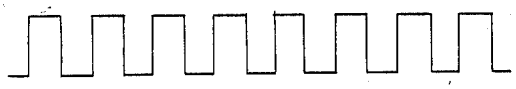
FIG. 18(c) OUTPUT 26 (N=32)
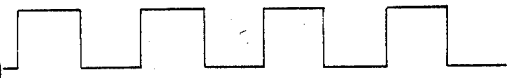
FIG. 18(d) N=16
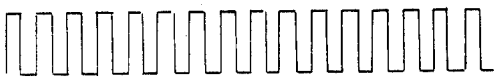
FIG. 18(e) OUTPUT 29 (N=16)
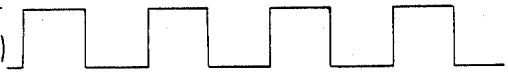
FIG. 18(f) N=8
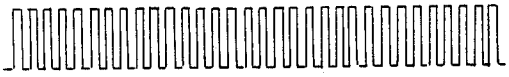
FIG. 18(g) OUTPUT 28 (N=8)
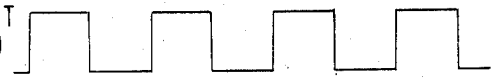
FIG. 18(h)
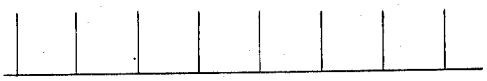
TONE INTERRUPTION SIGNAL (N=64, 32, 16, 8)
FIG. 18(i) N=96
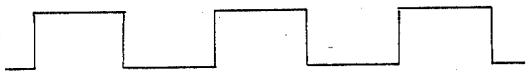
FIG. 18(j)
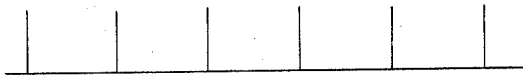
TONE INTERRUPTION SIGNAL (N=96)

FIG. 21(a)
FIG. 21(b)
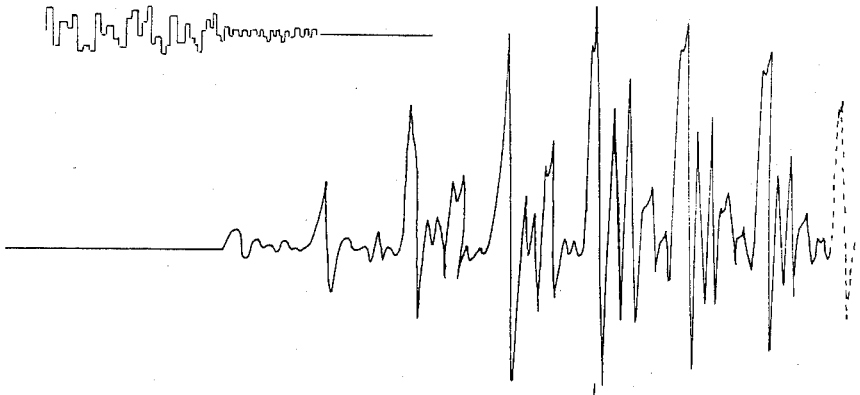
FIG. 21(c)
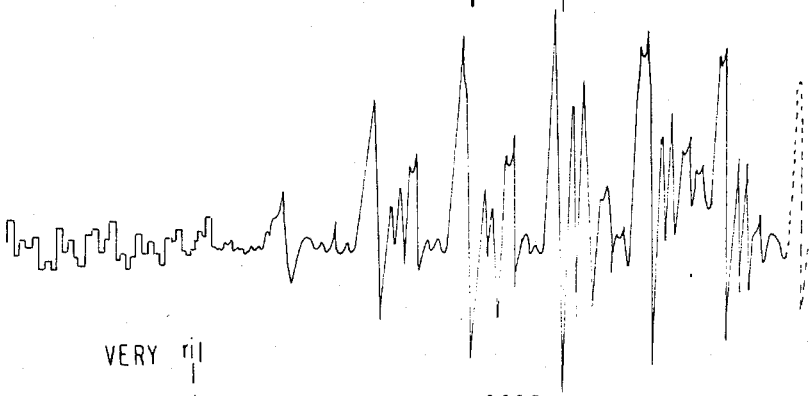
FIG. 22
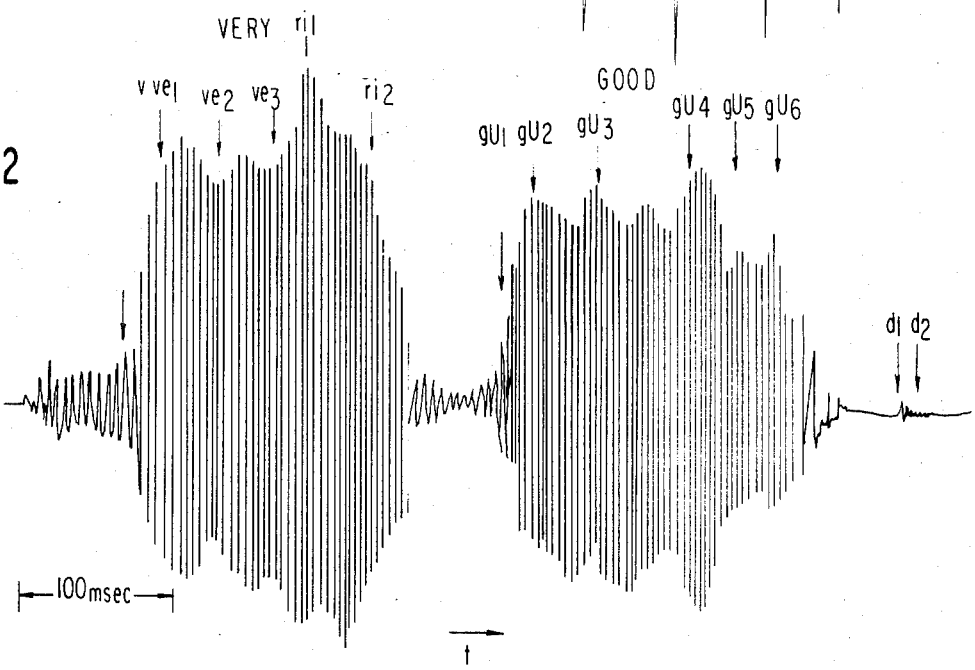
FIG. 23
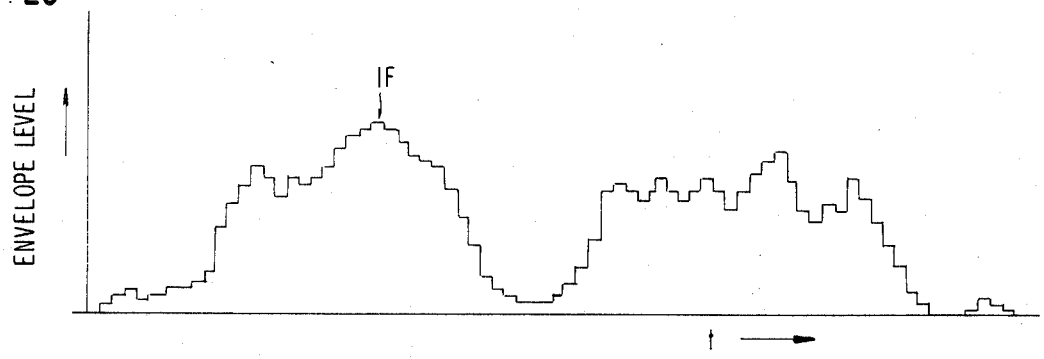

SOUND SYNTHESIZER

This application is a continuation of application Ser. No. 214,931, filed Dec. 10, 1980, now abandoned.

BACKGROUND OF THE INVENTION

The present invention relates to a sound synthesizer, and more particularly to a sound synthesizer employing a compact information processor such as microcomputer or the like. Throughout this specification and the appended claims the term "sound" is defined as consisting of an assembly of phonemes and it includes the so-called sound such as musical sounds and imitation sounds as well as imitations of animal sounds as pronounced by human beings.

As an apparatus for producing a speech sound (especially the human speech) by means of an electric circuit, the Formant Vocoder has been known. The term "formant" means a concentration of energy found at a specific frequency band in a sound signal. It is believed that this formant is determined by the resonant characteristics of the vocal tract. The speech signal is analyzed into 7 kinds of information such as a several kinds of formant frequencies (for example, first formant—third formant), their amplitudes, etc. When a resonance circuit is excited on the basis of this information, a spectrum envelope approximated to the speech signal can be reproduced. The Formant Vocoder is such a type of speech reproducer. However, at the current status of the art, it is difficult to obtain a satisfactory speech from this type of vocoder. Therefore, a speech synthesizer employing the Linear Predictive Coding System (hereinafter abbreviated as LPC) has been proposed which is based on the vocoder and a speech synthesizer making use of a method of speech segments generation in the speech synthesis of mono-syllables.

The proposed former speech synthesizer utilizes the speech band compression technique (information compression technique). Briefly speaking, it is a system of predicting from a speech signal at a preceding moment, a speech signal at the next succeeding moment. In general, a speech sound is classified into a voiced sound and an unvoiced sound. In the case of the voiced sound, a white noise signal and a periodic impulse signal are used as a driving signal. In the case of the unvoiced sound, only the white noise signal is used as a driving signal. These driving signals are amplified and then input to a lattice digital filter. At this moment, the coefficients of the filter are renewed in each sampling period to synthesize a desired speech signal. The filter coefficients are renewed each time a quantized driving signal is read out of a memory at every one frame (about 20 ms). Besides the driving signals, information necessitated for speech synthesis such as pitch information, amplitude information, etc. is stored in the memory. The amount of information contained in one frame depends upon the number of the connected filters. If 10 filters are present, an information amount of about 48 bits is necessitated. In some frames, a lesser amount of information will suffice. Generally, however, if the period of the frame is assumed to be 20 ms, then for synthesizing a speech signal is only one second, about 2,400 bits of information are necessitated. Accordingly, even if a memory having a memory density of 64K-bits/one chip is employed, a speech signal can be synthesized only for about 30 seconds. This serves as an extremely great bar against miniaturization of a speech synthesizer.

On the other hand, the amount of arithmetic operation necessitated for the speech synthesis is enormous. For example, in the arithmetic circuit is required a multiplier and, since the area occupied by a multiplier is very large, it is not favorable for an integrated circuit arrangement. Moreover, even if a pipe-line type multiplier is employed, 19 repetitions of multiplication and addition/subtraction are required. Furthermore these arithmetic operations must be carried out in each sampling cycle. In addition, a delay circuit for preventing overlap of arithmetic operations is also necessary. In this way, a speech synthesizer according to the LPC system is composed of a complex circuit and it necessitates hardware having a large area. With regard to a computing speed also, if a sampling frequency of 10 kHz is employed, 19 repetitions of arithmetic operations must be executed in 100 $\mu$s. Accordingly, a high-speed logical operation capability compatible to a mini-computer is required. In other words, the cost of the synthesizer becomes high that it is hardly applicable to private instruments.

Still further, in order to improve the quality of the synthesized sound, abrupt change of parameters must be avoided. Accordingly, an interpolation circuit for interpolating intermediate values between given parameters is also necessary. Furthermore, one information is available only as a parameter for synthesizing one speech. Hence, there occurs an inconvenience that the number of synthesizable speeches is limited by the memory capacity. Especially, in the case of synthesizing, in addition to human speeches, musical sounds such as the sounds of pianos, flutes, violins, etc. and imitation sounds such as engine sounds of automobiles, aircrafts, etc., a memory having a large capacity is required.

On the other hand, in the proposed latter speech synthesizer making use of speech segments, a waveform of a speech signal is divided into parts of a short period (8 ms or 4 ms). The divided waveform part is called "speech segment". The speech segment information is edited within a memory. The speech synthesizer reads necessary speech segment information (representative segments) out of the memory in accordance with the speech signal to be synthesized. Addressing for the read out operation is executed by key input or by programming. In order for the synthesizer to synthesize a speech signal, time information, amplitude information, sequence information, etc. are required in addition to the representative segments. The synthesizer synthesizes a speech signal on the basis of this information. However, the initial digital value and the final digital value possessed by the selected representative segment are generally different for the respective representative segments. In other words, the final digital value of the first representative segment and the final digital value of the subsequent second representative segment are generally not identical. Accordingly, a speech signal having a continuous waveform variation cannot be obtained, and the synthesized speech signal assumes a discontinuous waveform having discontinuity at every segment. Consequently, the waveform becomes a speech waveform having a large distortion as compared to the natural speech waveform, and hence a speech signal of good quality could not be obtained by the prior art system.

Also, besides the above-mentioned methods, various methods have been known in which speech digital information is obtained by analyzing a speech signal with the aid of the delta modulation system (DM), pulse coded modulation system (PCM), adaptive delta modulation system (ADM), differential PCM system (DPCM), adaptive predictive coding system (APC), etc. However, no synthesizer has yet been proposed which is most suitable for synthesizing a speech signal on the basis of such analyzed information. As a matter of course, even with the PARCOR system which makes use of a partial autocorrelation coefficient, miniaturization and cost reduction of a speech synthesizer cannot be expected, because the PARCOR system also necessitates a complex filter circuit as well as a large amount of information.

SUMMARY OF THE INVENTION

It is therefore one principal object of the present invention to provide a compact speech synthesizer for easily synthesizing sounds having different tone frequencies.

Another object of the present invention is to provide a speech synthesis system in which information required for speech synthesis is minimized.

Still another object of the present invention is to provide a novel sound synthesizer which can be controlled by means of a microprocessor.

Yet another object of the present invention is to provide a high-speed sound synthesis system in which the number of arithmetic operations necessitated for the synthesis is reduced and speech can be synthesized through real-time processing.

A further object of the present invention is to provide a synthesizer in which all the speech synthesizing means are integrated on a single semicoinductor substrate by making use of the technique of LSI.

A still further object of the present invention is to provide a sound synthesis unit which can synthesize the human speeches such as phones, syllables, words, vocabularies, sentences, etc. including the voiced and/or unvoiced sounds, and also which can freely synthesize other sounds such as musical sounds, imitation sounds and the like.

Still another object of the present invention is to provide a speech synthesizer circuit which can also execute normal information processing such as numerical computation, control for peripheral instruments, information analysis, display processing, etc. (that is, processings equivalent to that of a micro-processor).

The sound synthesizer according to the present invention comprises memory means for storing an envelope information sampled from an envelope waveform of a sound signal and a sound wave information sampled from a sound signal waveform, means for generating a pitch information which determines the pitch of the sound signal, and means for multiplying the envelope information by the sound wave information at every period determined by the pitch information to produce a sound signal.

The procedure for synthesizing a sound signal by making use of the sound synthesizer according to the present invention is as follows:

At first, before explaining the procedure, description will be made on the sound signal. For instance, in the case where a signal representing human speech spoken by a human being is depicted on a recording paper, the waveform of the recorded signal consists of a voiced sound signal waveform and an unvoiced sound signal waveform. Further analyzing the voiced sound signal waveform in greater detail, then it can be seen that a plurality of kinds of common waveforms appear repeatedly. Among these repeatedly appearing waveforms, approximately identical waveforms are extracted as a common waveform. The extracted common waveform is subjected to analog-digital conversion at a sampling rate of, for example, 20 KHz to be converted into digital data of 8 bits per sampling, and the digital data are stored in a memory. Among the 8 bits, one bit is used for representing a positive/negative information of the waveform. In the case of sampling in the above-described manner, with a memory of, for instance, 64K-bits, a digital data for a sound signal during a period of about 3.2 seconds can be obtained.

In a waveform of a word or a sentence consisting of a plurality of consecutive phones are present a plurality of repeated waveforms as described above. Since this repeated waveform is repeated at a high frequency, its repetition period is extremely short. Accordingly, sometimes 2 or 3 different kinds of repeated waveforms would appear in a phone waveform. However, for each phone waveform if one representative repeated waveform among the different ones is prepared, a sound signal closely approximated to the natural human speech can be synthesized. For the unvoice signal, a random waveform could be used during that period.

In addition, an envelope waveform for the sound signal can be obtained by connecting the maximum amplitude points in the respective repeated waveforms. With regard to this envelope waveform, it is only necessary to effect sampling of one envelope information in correspondence to each repeated waveform. In other words, every sound signal is characterized by this envelope waveform and the sound waveform (the repeated waveform for a voice signal and the random waveform for an unvoiced signal).

Therefore, according to the present invention, the procedure of synthesis consists of multiplying the sampled sound wave information by the corresponding envelope information under time control by a pitch information. The pitch information is used as an important factor for determining the pitch of the synthesized sound.

As a result, a sound signal having a synthesized speech waveform that is faithful to the natural human's speech waveform, can be obtained. In the device and system according to the present invention, the hardware means is extremely simple, and moreover, the sound signal can be obtained at a high speed. As a matter of course, the synthesized signal is subjected to digital-analog conversion, and then reproduced as an audible sound through an acoustic device such as a loudspeaker. The term "sound signal" as referred to above includes a speech signal containing a voiced signal and/or an unvoiced signal as its components, a musical sound signal, an imitation sound signal, and the like. The voiced sound consists of the vowels (for instance, representing in terms of phonetic symbols, (a), (i), (u), (e) and (o) in Japanese, (a), (ai), (æ), (i), (e), (u), (ʌ), (ɔ), etc. in English, and (i), (ɛ), (a), (ɔ), (oe), (u), (ɣ), (ə), etc. in German) and some of the consonants (for instance, (n), (m), (y), (r), (w), (g), (z), (d), (b), etc.). In other words, the voiced sound is one kind of saw-toothed waveform containing a plurality of frequency components. On the other hand, the unvoiced sound consists of the remainder of the consonants (for instance, (k), (s), (t), (h) (p), etc.). In other words, the unvoiced sound is, by way of example in the case of the human speech signal, a white noise generated by a sound source consisting of a turbulent air flow produced in the vocal tract with the vocal cords held unvibrated.

In the voiced sound signal of a one-letter sound (a monosyllable) are contained repeated waveforms which can be deemed to have the same shape. Here it is to be noted that the unvoiced sound signal consists of a random waveform such as a noise. The above-referred sound waveform information, in the case of the voiced sound signal, means the digital data obtained by quantizing one of the repeated waveforms at a plurality of sampling points, but in the case of the unvoiced sound signal, the digital data obtained by quantizing the random waveform at a plurality of sampling points. In this instance, in the digital data for the voiced sound signal of one monosyllable could be included a plurality of waveform data whose shapes are different from each other. Furthermore, with regard to the digital data for the unvoiced signal, the waveform data could be set such that an appropriate wave form may be repeated during the period of the unvoiced sound, or else any waveform data in which a repeated waveform does not appear over the entire period could be set. Still further, the number of sampling points for the digital data (sound wave information) of the voiced and/or unvoiced sound signals could be set at any arbitrary number such as, for example, 32, 64, etc. In addition, the numbers of bits of the digital data at the respective sampling points could be set at any desired number depending upon the sound signal such as, for example, 5 bits, 8 bits, etc. In the case where the sound signal is a high-pitched tone, the number of sampling points for one repeated waveform or one random waveform could be small, but in the case of a low-pitched tone, the more the number of sampling points is, the better is the quality of the sound. This is because the waveform variation for the low-pitched tone is complex and its pitch frequency is low.

The pitch of a sound can be freely selected by varying the pitch information. According to the present invention, a sound signal having a desired pitch can be synthesized by multiplying the sound wave information by the envelope information at every sampling period which is determined by the selected pitch information. Especially it is to be noted that if the pitch of a sound is disregarded, a sound signal waveform having a fixed pitch can be obtained by merely multiplying the envelope information by the sound wave information. In the case of further improving the tone quality of the voice, it is desirable to exactly extract the repeated waveforms contained in a monosyllable. Upon synthesis, by reading the extracted repeated waveforms out of the memory under sequence control and multiplying it by the envelope information, a speech waveform that is nearly identical to the natural human speech waveform can be reproduced. It is to be noted that if the number of used data of the sound wave information prepared in the memory is varied depending upon the pitch information, then the speech can be synthesized at a high speed without being accompanied by deterioration of the tone quality. It is only necessary to prepare a necessary number of sound wave information (repeated waveform data and random waveform data) which number corresponds to the number of vowels and consonants required for the speech synthesis. By making such provision, any desired words, sentences, etc. can be synthesized through the same process of synthesis. On the other hand, an alternative procedure could be employed, in which the voice sound signal and the unvoiced sound signal are classified in the entire sound waveform representing, for example, one sentence or one word, and for the voiced sound signal the signal period is divided into repeated waveform units and the representative repeated waveform is quantized in every unit. The process of synthesis in this alternative area could be the same as the above-described process.

Thus, according to the present invention, since the process of synthesis is simple, the necessary hardware means is extremely simple. Moreover, the hardware circuit could be such a circuit that is substantially equivalent to the adder circuit, shift register circuit, memory circuit, frequency-divider circuit and timing control circuit in combination in the well-known micro-computer. No special hardware for the synthesis would be necessitated. Accordingly, the sound synthesizer according to the present invention can be produced at low cost. Furthermore, since the synthesizer is also available as a micro-computer, it is extremely favorable in view of versatility and mass-producibility.

Furthermore, the necessary amount of data can be greatly reduced as compared to the prior art. Consequently, a memory circuit for storing the sound wave information, envelope information, pitch information and instruction-for-synthesis information, as well as a synthesizer circuit for synthesizing a sound signal on the basis of the respective informations, can be integrated on the same semiconductor chip. Moreover, according to the present invention, a sound signal having an excellent tone quality can be produced at a high speed on a real time basis. In addition, every kind of sound (speech) from a one-letter sound to a long sentence, can be synthesized. Still further, through a similar method of synthesis, musical sounds, imitation sound, etc. can be also synthesized freely. Also, since a sound waveform is principally considered as a subject of the synthesis, the synthesizer system is not linguistically restricted at all whether the waveform may represent Japanese, French, English or German. In other words, the synthesizer can synthesize the languages of all the countries, and yet the process for synthesis could be the same for every language. In addition, if the amplitude information is also added to the data for synthesis as will be described later, then the loudness of the sound also can be controlled at will. In this instance, it is only necessary to further multiply the result of the above-described multiplication of the sound wave information by the envelope information, by the newly added amplitude information. The multiplication operation as used in the synthesizer system according to the present invention does not necessitate a large scale multiplier circuit as used in the speech synthesizer according to the LPC system in the prior art, and furthermore, does not necessitate a complex circuit such as a digital filter. According to the present invention, only a single simple multiplier circuit will suffice, because in each sampling period the necessary multiplication could be executed only once. It is to be noted that even if the amplitude information should be additionally employed, the multiplication period would be extremely short, and hence the influence of this modification upon the hardware could be neglected. Furthermore as will be described in detail later, in the case of employing the method of synthesis according to the present invention, it is possible to replace simple addition operations for the above-described multiplication operation. More particularly, if one adder and one shift register are provided, an arithmetic operation equivalent to multiplication can be achieved. Moreover, when the pitch information is varied, occurrence of discontinuities in the synthesized sound wave can be prevented by merely additionally providing means for varying the number of data to be used for synthesis among the sound wave information data prepared in the memory (the digital data sampled from one repeated waveform). As a result, a smooth sound signal not containing distortion or interruption of sound can be obtained.

Other objects and advantages of the present invention will be fully apprehended from the following detailed description of the preferred illustrative embodiments thereof taken in conjunction with the appended drawings, in which:

BRIEF DESCRIPTION OF THE DRAWINGS

FIG. 1(*b*) is a block diagram showing more detailed circuit construction of the prior art sound synthesizer shown in FIG. 1(*a*);

FIG. 1(*c*) is a sound segment waveform diagram;

FIG. 1(*d*) is a prediction waveform diagram of the sound segment shown in FIG. 1(*c*);

FIG. 3(*b*) is an enlarged waveform diagram showing the initial noise portion of the phone "Ka" shown in FIG. 3(*a*);

FIGS. 3(*c*) and 3(*d*) are enlarged waveform diagrams showing periodic similar waveform parts included in the tone section of the phone "Ka" shown in FIG. 3(*a*), respectively;

FIG. 3(*e*) is a noise envelope waveform diagram of FIG. 3(*a*);

FIG. 3(*f*) is a tone envelope waveform diagram of FIG. 3(*a*);

FIG. 4(*b*) is a tone envelope waveform diagram;

FIG. 4(*c*) is another common waveform diagram of the high-frequency band of the tone waveform of the phone "Ka";

FIG. 4(*d*) is a noise envelope waveform diagram;

FIGS. 8 and 9 are explanatory diagrams showing the bit construction of the sound information;

FIG. 11 is an explanatory diagram of a random access memory location;

FIG. 13(*c*) is noise signal waveform diagram;

FIG. 17 is a flow chart of tone signal processing;

FIGS. 18(*a*) to (*j*) are timing signal diagrams showing timing signals generated by a frequency divider;

FIG. 21(*a*) is a waveform diagram showing a noise signal produced by the second embodiment of the present invention;

FIG. 21(*b*) is a waveform diagram showing a sound signal synthesized from the tone signal produced by the second embodiment of the present invention;

FIG. 21(*c*) shows noise plus tone signal;

FIG. 22 is a waveform diagram depicting a record of a speech waveform of "very good" in English;

FIG. 23 is a normalized waveform diagram showing an envelope waveform of the speech waveform of "very good";

DETAILED DESCRIPTION OF THE PREFERRED EMBODIMENTS

Figure 1A:
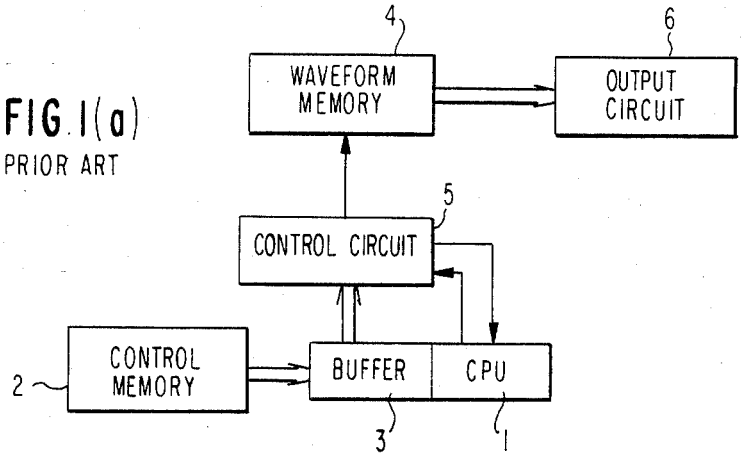
FIG. 1(a) PRIOR ART
FIG. 1(*a*) is a block diagram showing a prior art sound synthesizer.
Figure 1B:
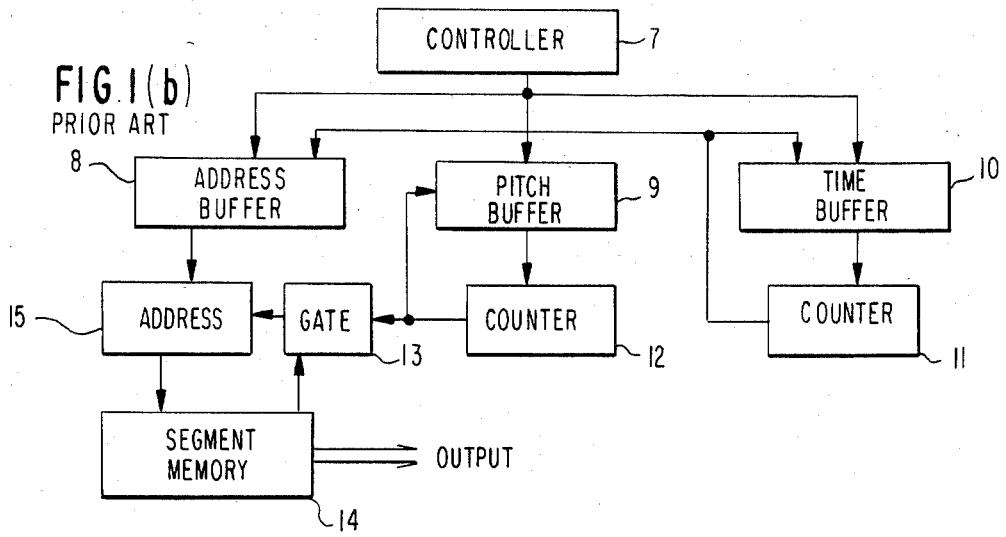
FIG. 1(b) PRIOR ART
Figure 1C:
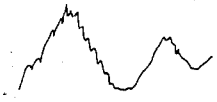
Figure 1D:
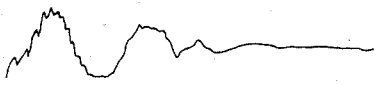

A speech synthesizer system in which a waveform of a recorded sound signal is divided into waveform parts (sound segments) per unit time (4 ms or 8 ms) and necessary waveform parts (sound segments) are selected from these prepared sound segments and jointed together, has been heretofore proposed. This system necessitates, in addition to the sound segments, control information for the time lengths, amplitudes, sequence, etc. of the sound segments. FIG. 1(*a*) shows a sound segment edit synthesizer in the prior art in a block form. This apparatus necessitates a compact electronic computer consisting of a central processing unit (CPU) 1 which executes synthesis processing in accordance with a control command, a control information memory 2, and a buffer 3 for temporarily storing a control information read out of the memory 2. In addition, it necessitates a waveform information memory 4 for storing a sound segment information, a control circuit 5 for addressing the waveform informtion memory 4 on the basis of the command fed from the electronic computer and achieving timing control as well as amplitude control for the sound segment to be read out, and a speech output circuit 6 having a D/A conversion function and an analog amplification function for amplifying the sound signal. If the respective functions are represented by functional blocks to be explained in more detail, the synthesizer apparatus is represented as shown in FIG. 1(*b*). In this figure, the respective code data are stored in a segment address buffer 8, pitch buffer 9 and time length buffer 10 on the basis of the command fed from a control section 7. The stored data produce a segment address for the waveform information memory 14 as controlled by counters 11 and 12 and a gate 13. The produced segment address is generated from an address generator 15 to send out a representative segment from the waveform information memory 14. In the waveform information memory 14 are also stored repetition number data and the like in addition to the sound segments. It is to be noted that the respective sound segments are prepared (or stored) so as to have a fixed length (a fixed pitch period). In other words, the pitch periods for the respective sound segments are fixed and these are predetermined by the recorded sound signal.

The read sound segments are successively jointed in a predetermined sequence to be synthesized into a speech signal. However, a good sound signal cannot be synthesized by simply joining (editing) the prepared segments, because with respect to an accent no control has been made to the synthesized sound signal due to the fact that the selected sound signal is synthesized with a predetermined pitch period. In the prior art, the pitch was controlled so as to meet a desired speech signal by predictively extending the last portion of the sound segment shown in FIG. 1(*c*) as shown in FIG. 1(*d*) or cutting off the sound signal at the midpoint. Since this procedure compensates only a part of the sound segment, complex waveform processing such as the LPC system was necessitated. However, with such pitch control, one can obtain only a synthesized waveform having large errors and distortions as compared to the natural human speech waveform, and hence a satisfactory speech sound could not be synthesized. More specifically, a speech sound waveform containing unnatural discontinuities at the joints between the sound segments was generated, and it was impossible to provide a smooth synthesized sound waveform. Moreover, the synthesizer apparatus required a large scale hardware compatible to a mini-computer, and was thus very expensive. In addition, since a great number of control information is required, a large capacity memory device had to be equipped in the synthesizer apparatus. Also, due to the complex processing for the pitch control, the circuit design of the apparatus was difficult. Accordingly, it was impossible to construct a sound synthesizer by means of a one-chip micro-computer in which a memory, a CPU and an I/O controller are integrally formed on a single semiconductor substrate. Especially, due to poor versatility and mass-productibility, the sound synthesizer in the prior art could not be applied to electrical appliances for general home use, home computers, warning apparatuses and educational instruments.

The important information necessitated according to the present invention are the sound waveform information for determining the kind of sound, the envelope information for determining the relative amplitude of sound and the pitch information for determining the pitch of sound. The sound waveform information means a waveform information for the minimum unit of signal waveform constituting a sound (phone, syllable, word, sentence, etc.). In other words, it implies a representative one of waveform parts appearing repeatedly in a continuous sound signal waveform, and for one phone there exists at least one repeated waveform part. This repeated waveform portion is divided along the time axis, and the amplitude values sampled at the respective dividing points are normalized to obtain a sound waveform information. The envelope means the curve obtained by connecting the maximum amplitude points in the respective repeated waveform portions. In other words, it provides data indicating the amount of amplitude deviations in a sound signal. That is, it determines a mode of variation of the amplitude in the successive repeated waveform parts, and after being sampled at a predetermined time interval it is normalized. Accordingly, the sound signal waveform can be obtained by multiplying the sound waveform information by the envelope information. The pitch information is a control information for determining the pitch of the sound, which information is utilized to change the period of the repeated waveform parts. For a prepared sound waveform information, the sampling period is determined depending upon this pitch information. In other words, if the sampling period is short, a low-pitched sound is synthesized, whereas if it is long, a high-pitched sound is synthesized. That is, the entire shape of the repeated waveform part is varied precisely at a rate determined by the pitch information. This variation of the waveform is correctly adapted to the change of the pitch of the sound. Thus, since the entire waveform is adjusted rther than adjusting only a part (the final waveform values) of the repeated waveform part, any unnatural discontinuity would not appear at all at the joints between the repeated waveform parts. The pitch information determines an accent or an intonation of a sound, and hence it could be prepared according to the sound to be synthesized.

Figure 2:
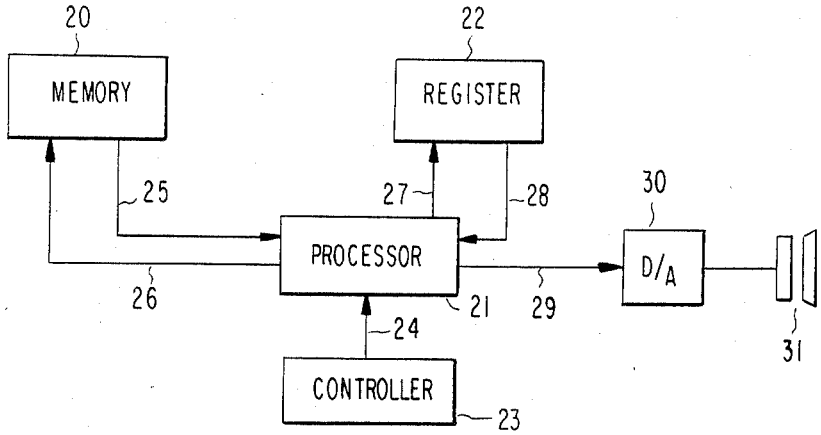
FIG. 2 is a functional block diagram showing essential parts of the sound synthesizer according to a first embodiment of the present invention.
Figure 3A:
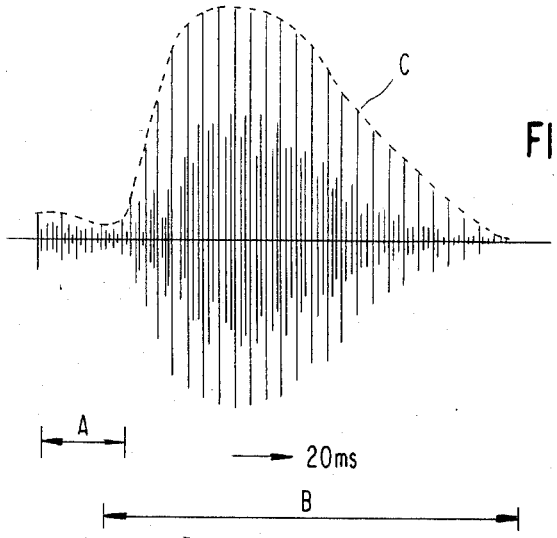
FIG. 3(*a*) is an overall waveform diagram of a speech "Ka" in Japanese.
Figure 3E:
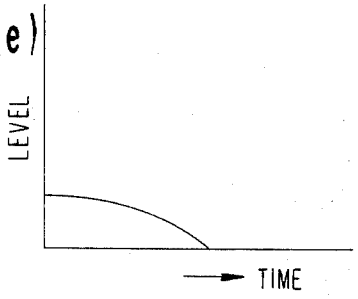
Figure 3B:
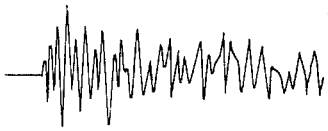
Figure 3F:
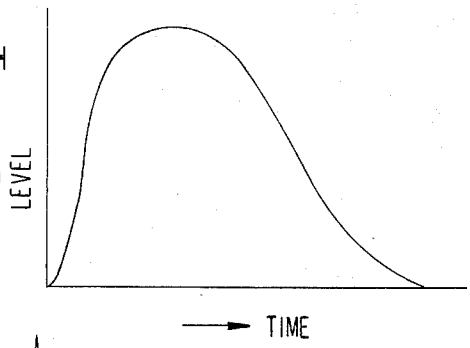
Figure 3C:
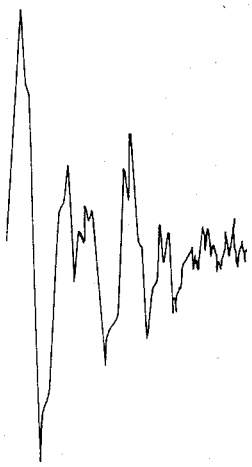
Figure 3D:
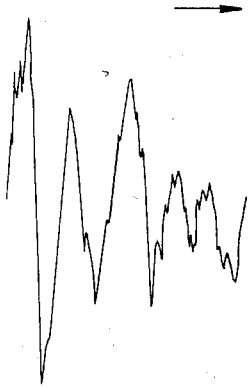
Figure 4A:
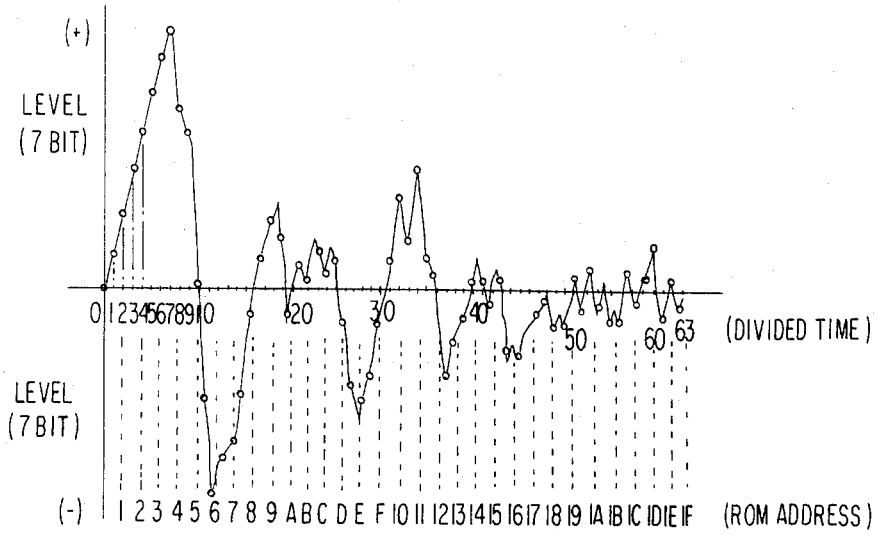
FIG. 4(*a*) is a common waveform (repeated waveform) diagram in the tone section of the phone "Ka" shown in FIG. 3(*c*)
Figure 4B:
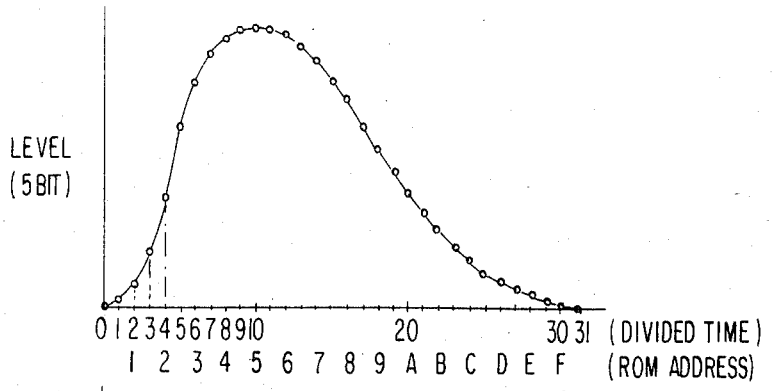
Figure 4C:
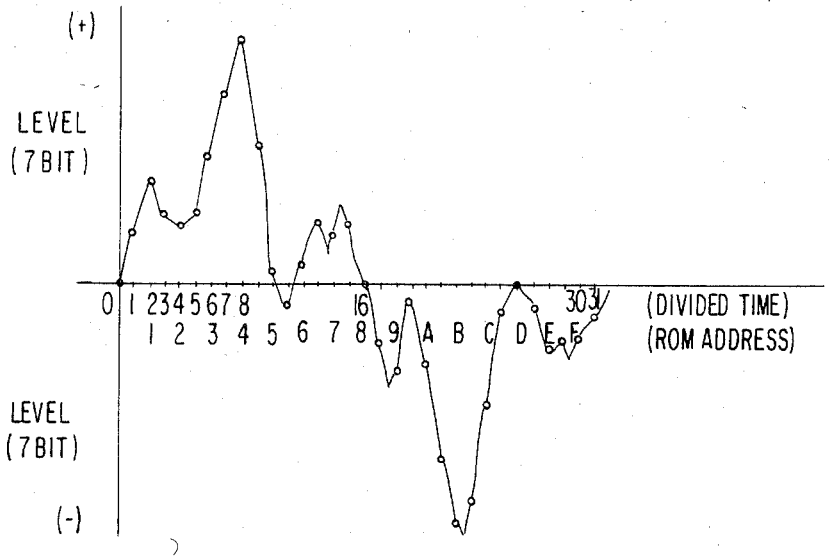
Figure 4D:
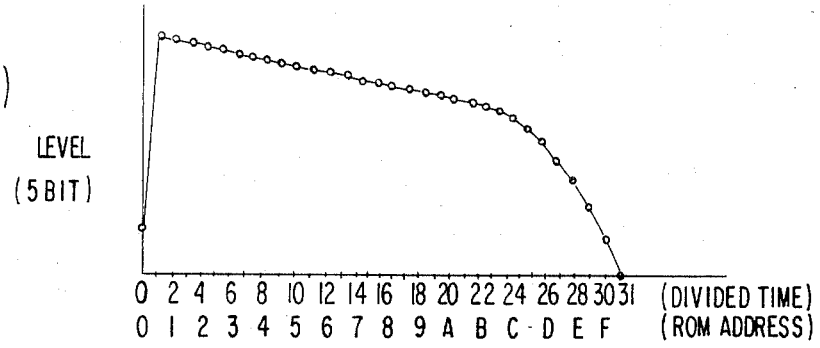

FIG. 2 is a functional block diagram showing essential parts in one preferred embodiment of the sound synthesizer according to the present invention. The important functions are achieved by a memory 20 in which the above-described information is preset, a synthesis processor 21 and a register 22 for temporarily storing data during the processing. The processor 21 sends an address 26 to the memory 20 in response to a synthesis program 24 that is input from an external instrument 23. Data 25 stored at the designated address are transferred to the processor 21. The processor 21 cooperates with the register 22 to execute the synthesis processing on the basis of the transferred data 25. Data 27 used in the processing are temporarily stored in the register 22, and selected data 28 are read out of the register 22, if desired. The selected sound waveform information is multiplied by the envelope information at every one period designated by the pitch information. The multiplied data are transferred to a D/A converter 30 as a digital sound signal 29 to be converted into an analog signal. This analog signal serves as a synthesized signal which causes speech to be radiated via a loudspeaker 31.

The thus synthesized sound signal waveform provides a waveform very closely approximated to a speech sound signal waveform spoken and recorded by a speaker. Especially owing to the control by the pitch information, a sound having clear accents and intonations could be obtained. Moreover, the above-described discontinuities between the respective minimum units of waveform (the repeated waveform parts) were not recognized at all in the synthesized sound signal.

It is to be noted that a sound synthesizer on the same scale as the one-chip micro-computer could be obtained by employing, in the above-described synthesizer, a read-only memory (hereinafter abbreviated as ROM) as the memory for storing information, a CPU having a multiplier function, timing control function and command decoding function as the synthesis processor, and a random access memory (hereinafter abbreviated as RAM) as the register for temporarily storing data necessitated for the processing.

In order to better understand the above-described preferred embodiment, hardware including synthesis processing means and memory means will now be disclosed in greater detail and explanation will be made on the operation principle of the hardware.

First, in the case of employing a ROM as the memory means, description will be made concerning the information to be preset in this ROM. While the example presented here relates to Japanese, the same procedure is equally applicable to other languages. This will be further explained in a later part of this specification.

Each speech signal is sampled and quantized through an analog-digital converter (A/D converter) at a sampling rate of about 20 kHz or 10 kHz. The speech signal is quantized into a digital information of 8 or more bits and the entire waveform is written in a memory. The written information is read out at such a reading speed that the waveform for the speach signal can be well recorded, and the read data are passed through a digital-analog converter (D/A converter) and then recorded on a recording paper. At this moment, it is desirable to analyze a waveform portion having an especially abrupt change in a sufficiently precise manner. FIG. 3(*a*) is an overall waveform diagram of a speech "Ka" in Japanese which was recorded in the above-described manner. In the case of Japanese, this entire waveform forms one phone. As shown in this figure, normally in the case of a voiced sound, a white noise is present in the initial portion A and a tone section is present in the subsequent portion B. One speech waveform is obtained as a combination of these portions. FIG. 3(*b*) is an enlarged waveform diagram showing the initial noise portion of the phone "Ka" in Japanese. FIGS. 3(*c*) and 3(*d*), respectively, are enlarged waveform diagrams showing a speech phoneme consisting of representative one of periodic similar waveform parts (repeated waveform parts) included in the tone section of the waveform of the phone "Ka". In this case, waveform parts related by the similar shape which are different merely in the envelope level, are handled as an identical waveform. However, waveform parts which cannot be deemed to have a similar shape even if the difference in the envelope level is taken into account as shown in FIGS. 3(*c*) and 3(*d*), respectively, are separately extracted as different waveforms having separate periodicities, and individually recorded. While the speech phonemes included in the tone section B of the phone "Ka" are explained with respect to two different representative phonemes extracted from the tone section B in this preferred embodiment of the invention, a larger number of phonemes could be extracted. Here, the term "envelope" implies the waveform represented by a broken line C in FIG. 3(*a*), which is a locus obtained by connecting the maximum amplitude points in the successive speech phonemes. Further, the speech envelope waveform is divided into an envelope waveform for a noise section and an envelope waveform for a tone section. The former is recorded as a noise envelope waveform, that is an envelope waveform for the section of "K" in the Japanese phone "Ka" (See FIG. 3(*e*)), and the latter is recorded as a tone envelope waveform (See FIG. 3(*f*)). Generally, in the case of the voiced sounds, every tone envelope waveform traces substantially the same locus.

Now reference should be made to FIG. 4(*a*), in which a common waveform part (repeated waveform) in the tone section shown in FIG. 3(*c*) is divided into 64 intervals along the time axis and in the respective intervals the amplitudes are normalized into maximum 8-bit levels (7 level bits plus one sign bit). Although not illustrated, similar normalization is also effected for another common waveform part shown in FIG. 3(*d*). Not only the speech phone "Ka", but with respect to other voiced sound phones also, the speech waveform is classified into a noise section, a tone section and a mixed noise/tone section through the same procedure, and one or more common waveform parts are extracted from the tone section having a periodicity and then normalized. On the other hand, with regard to higher harmonic components up to the order of 16-fold overtones among the harmonic components included in one extracted common waveform part, the waveform part could be normalized as being divided into 32 intervals along the time axis, as shown in FIG. 4(*c*). In addition, FIGS. 4(*b*) and 4(*d*) are diagrams illustrating the tone and noise envelope waveforms shown in FIG. 3(*f*) and 3(*e*) as divided into 32 intervals along the time axis and normalized into maximum 5-bit levels in each interval.

Through the above-mentioned method, the noise and the fundamental frequencies (pitch frequencies) of the common waveforms of the tone for each speech waveform are determined as digital information, and by dividing the entire period of the envelope waveform into 32 units of time, the each divided unit of time is calculated. In addition, among the thus obtained tone waveforms and an envelope waveform, similar waveforms are grouped as one common waveform to achieve compression of information. Furthermore, a time normalization ratio of the envelope waveform (a time ratio of envelope) and a normalization ratio of the maximum value of amplitude of each speech envelope to the maximum value of the corresponding normalized envelope waveform (a ratio of a sound intensity (peak value)) are preset. With regard to a speech having a varying basic frequency, a rate of the variation and a duration of the sound are determined. With regard to various musical sounds, impulsive sounds, mechanical sounds, imitation sounds, the parameters of these sounds are also determined through the same procedure as the above-mentioned procedure.

In other words, with respect to speech sounds and various other audible sounds, their repeated common waveforms (tone waveforms), fundamental frequencies of the tone, tone envelope waveforms, tone peak values, time ratios of the tone envelope, tone duration periods, rates of variation of the tone fundamental frequencies, noise envelope waveforms, noise peak values, time ratios of the noise envelope, and noise duration periods are obtained as digital parameters, and among these parameters, information which can be deemed to be common to a plurality of sounds are grouped as many as possible into a common parameter to achieve compression of the information.

Here, the peak value data are data for determining loudness of a speech, and the fundamental frequency (pitch) data are data for determining a pitch of speech. The speech synthesized according to these data becomes a speech having accents and intonations which is very close to the natural human speech.

Figure 5:
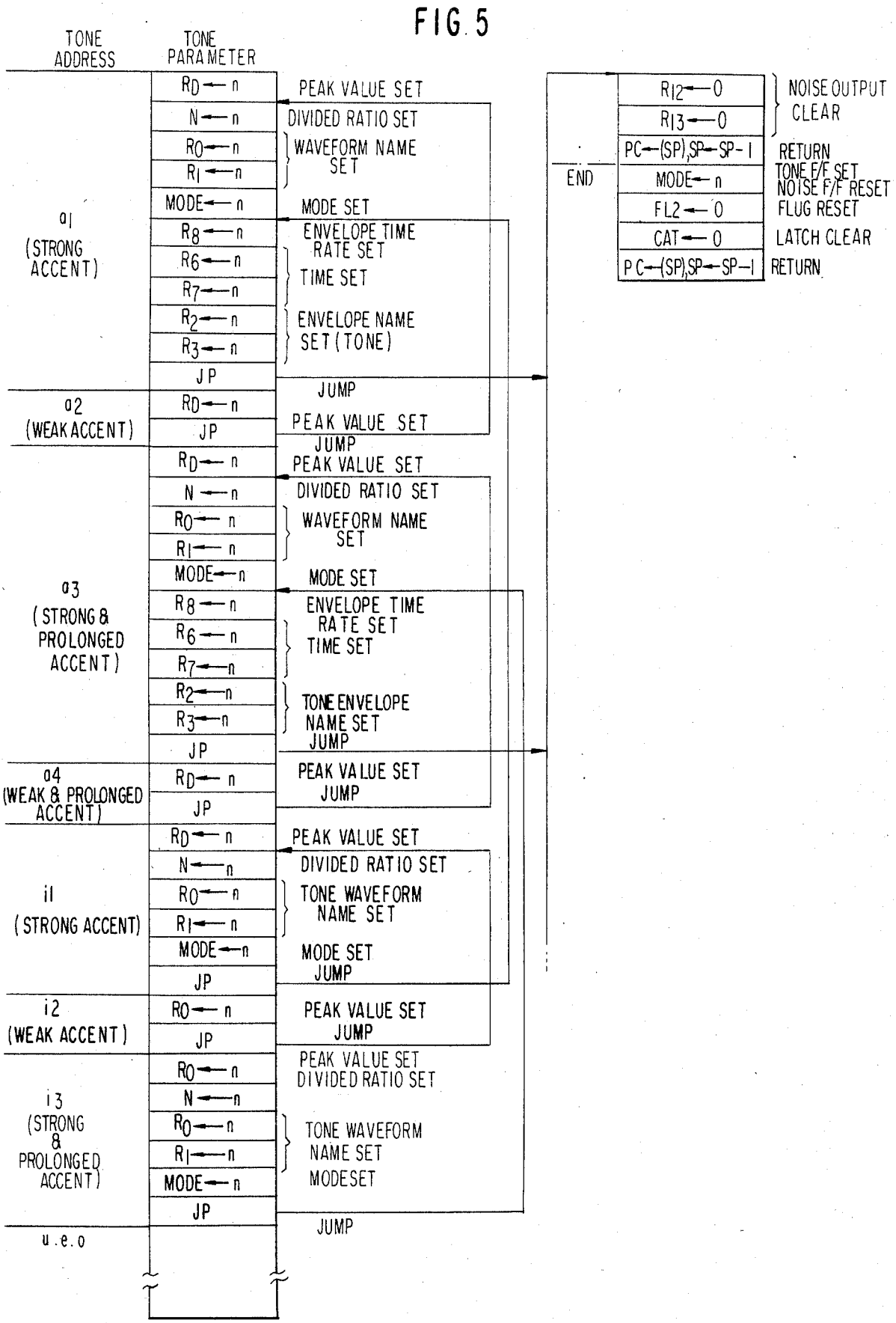
FIGS. 5 to 7 are tables of memory in which sound information are stored.
Figure 6:
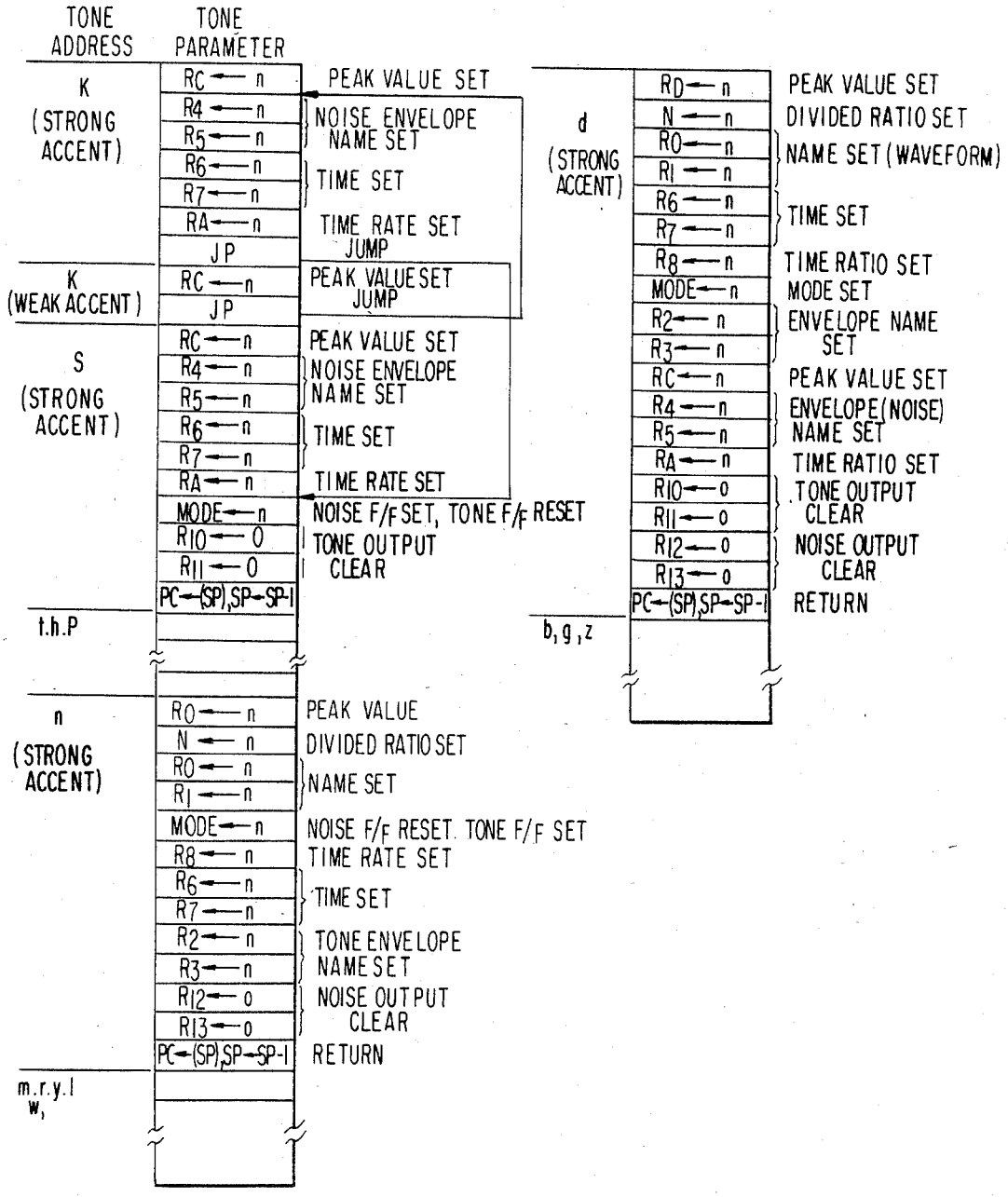
Figure 7:
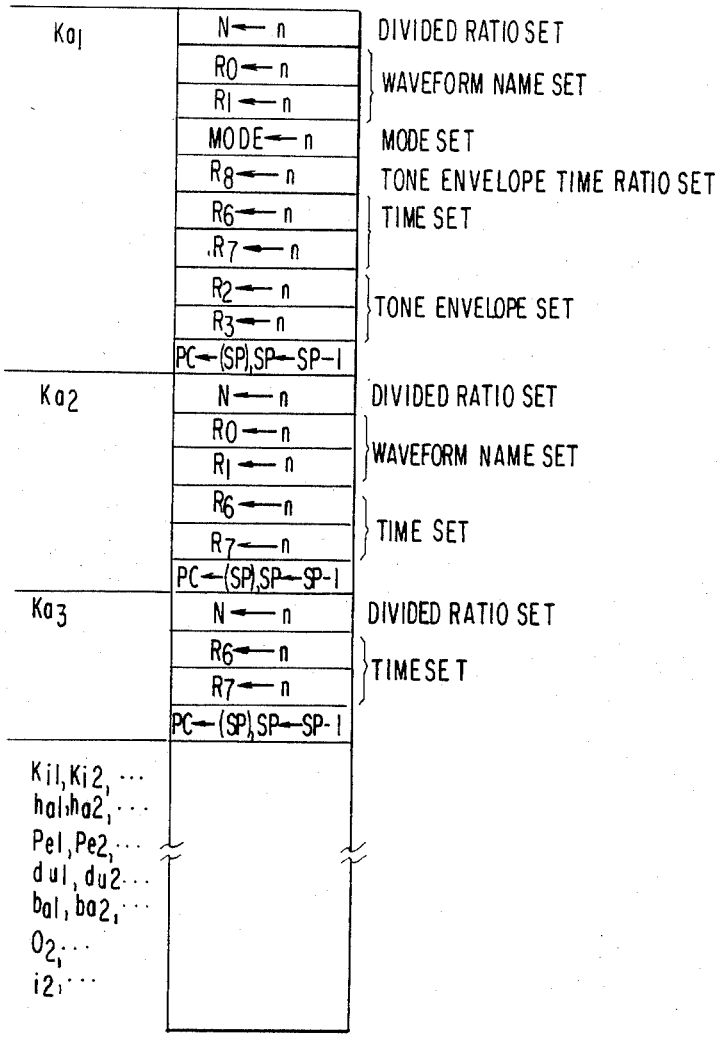

Thus obtained data are written at a desired address in an ROM. Although the method for writing could be selected arbitrarily, in order to prevent complexity of software it is advisable to edit the data in a subroutine form as illustrated in FIGS. 5 to 7. For instance, the vowels of Japanese (a), (i), (u), (e), (o), etc. are jointly set in a predetermined region (tables) in the ROM. In the case of reading, it is only necessary to address the respective tables by means of a table reference instruction. The table reference address is set as a speech parameter address. Each vowel is further classified, such that for instance, in the case of the vowel (a), it is classified into ($a_1$) having a strong accent, ($a_2$) having a weak accent, ($a_3$) having a strong and prolonged accent, and ($a_4$) having a weak and prolonged accent. With regard to the necessary data, for the vowel ($a_1$) having a strong accent, are prepared peak value data of the amplitude of the waveform, fundamental frequency (ratio of frequency division) data for the waveform, waveform data for ($a_1$), waveform mode designation data (as will be described in detail later), envelope time ratio data, time data, a name of a tone envelope waveform and a jump instruction. With respect to the ($a_2$) having a weak accent, peak value data of the amplitude of the waveform is prepared, and in the next position should be set a jump command for transferring to the fundamental frequency data for the waveform of the ($a_1$) having a strong accent. In other words, since the intensity of accent depends upon the amplitude of the waveform, it is only necessary to make only the peak value variable. On the other hand, with regard to the ($a_3$) having a strong and prolonged accent, data which are similar to those of the above-describes ($a_1$) having a strong accent could be preset, but it is only necessary to change the time data. In addition, in the case of being not concerned with the pitch of sounds, the data of fundamental frequencies could be varied. For the other data the data of ($a_1$) having a strong accent can be used. For the ($a_4$) having a weak and prolonged accent, the peak value is changed, and with respect to the data involving the fundamental frequency and the subsequent items, provision is made such that a jump is effected to the above-described subroutine for the ($a_1$).

Regarding the vowel ($i_1$) having a strong accent, data of a peak value, fundamental frequency (ratio of frequency division), name of tone waveform, and mode designation are prepared, and subsequently a jump is effected to the envelope time ratio data et seq of the ($a_1$). This is because the waveform of the tone envelope was set so as to available in common for the voiced sounds. In addition, with respect to the vowel ($i_2$) having a weak accent, the vowel ($i_3$) having a strong and prolonged accent, and the other vowels (u), (e), (o), etc. also, the respective data are prepared in the same manner as described above, and setting is made so as to jump to a predetermined subroutine. After all the necessary data have been set, the final jump command (the vowels ($a_1$), ($a_1$), etc.) designates transfer of the processing to the return command for resetting a noise output and releasing the tone interruption processing.

Furthermore, as shown in FIG. 6, with respect to other speech sounds such as, for example, unvoiced consonants (k), (s), (t), (p) and (h) which can be synthesized only with a white noise, or voiced consonants (n), (m), (r), (y), (l), (w), (d), (b), (g) and (z) which have peculiar waveforms, also the necessary data are set in the ROM tables.

As described above, parameters for tones and noises necessitated for speech analysis are stored in the ROM tables in a subroutine form. Then, by merely designating the head address of the respective routines, the information of the speech to be synthesized can be read out in a predetermined sequence. The read data are edited in a RAM.

In addition, in the ROM are preset normalized data of the common waveform parts in the tone in the form of, for instance, 16 bits per word. More particularly, sampled data for the common waveform part in the tone shown in FIG. 4(*a*) are coded and set in a ROM table. Assuming that the address for the ROM is designated for each 16P-bit unit, then in the case where the tone common waveform part for the Japanese phone "Ka" normalized as shown in FIG. 4(*a*) is coded and recorded starting from the address #1000, at the 1st to 8th bit positions of the address #1000 are written the data of the time-divided waveform in the even number ordered intervals (for instance, in the second and fourth intervals), and at the 9th to 16th bit positions of #1000 address are written the same data in the odd number ordered intervals (for instance, in the first and third intervals). In this instance, at the 1st to 7th and 9th to 15th bit positions are written the amplitude levels of the tone waveform part, and at the 8th and 16th bit positions are written sign values of the amplitude levels ("0" in the case of a plus level or "1" in the case of a minus level). Since the waveform part shown in FIG. 4(*a*) is divided into 64 intervals, for the purpose of recording all these data, a memory region for 32 addresses is necessitated. Accordingly, at the addresses #1000 to #101F as represented by the hexadecimal code are written the waveform data shown in FIG. 4(*a*). Likewise at the addresses #1020–103F are written normalized information of another waveform part shown in FIG. 3(*d*). Furthermore, in the address #1040–104F are written normalized data of the waveform part in FIG. 4(*c*) which is divided into 32 intervals, and at the address #1050 and subsequent addresses are written normalized data of tone waveform parts of other speech sounds. On the other hand, the preset state of another table of the ROM where the envelopes of tones and noises are written is shown in FIG. 9. In this figure at the addresses #XX30 to #XX3F are written the tone envelope data shown in FIG. 4(*b*). In this table, at the respective addresses, the time-divided even number ordered data are written at the 1st to 8th bit positions, and the odd number ordered data are written at the 9th to 16th bit positions. In practice, as the amplitude level of the envelope is coded into 5 bits, at the 6th to 8th bit positions and at the 14th to 16th bit positions are always written "0". Subsequently at the addresses #XX40 to XX4F are written normalized data of the noise envelope in FIG. 4(*b*). Likewise, if desired, envelope waveforms of sounds of a piano having an exponential damping characteristic as well as noise and tone envelope waveforms of various impulsive sounds, musical sounds, imitation sounds, etc. could be written in the tables of the ROM. In this way, in the tables of the ROM are preset parameters, subroutines, tone and noise waveform data, and tone and noise envelope data of the respective speeches and other sounds. It is to be noted that with respect to the noise waveform data, random waveforms are used, and hence, though appropriate waveforms could be prepared in the ROM table, a polynomial counter for generating a random waveform could be used as will be explained later. In the case of employing this counter, there is no need to prepare noise waveform data in the ROM.

Now a hardware construction for synthesizing a sound signal on the basis of the above-described prepared information according to a second preferred embodiment of the present invention which is more practical than the first preferred embodiment shown in FIG. 2 will be described in detail with reference to FIG. 10, which shows the circuit construction in a block form. The interconnections between the respective circuit blocks designated by reference numerals having a figure "1" at its their hundred digit position will now be explained. However, the operations and functions of the respective blocks will become clear by the description of operation which follows later.

A clock signal (timing signal) for actuating the respective circuits is produced by deriving an output of a clock oscillator (OSC) 142 to which a crystal, ceramic or CR resonator is connected, through a clock generator (CG) 143 which consists of a frequency divider circuit and a waveform shaper circuit. The clock signal is divided in frequency by a frequency divider circuit (DIV) 144 having a predetermined frequency-dividing ratio, and then input to a one-shot generator 145, a polynomial counter (PNC1) 134, another polynomal counter (PNC2) 138 and an interruption control circuit (INT. G) 140. To this interruption control circuit (INT G) 140 are further applied signals fed from the one-shot generator 145, an external interruption signal input terminal 170 and a mode register 135, respectively. The interruption control circuit (INT G) 140 feeds an interruption address information to an interruption address generator (INT ADR) 141. The interruption address signal generated by the interruption address generator (INT ADR) 141 is sent to a bus 169. This bus 169 is connected to a program counter (PC) 108, one-bit line shift circuit 174, and another bus 165. The outputs of the program counter (PC) 108 and the one-bit line shift circuit 174 are transferred to a bus 166 which is connected to an input end of a ROM 101. The one-bit line shift circuit 174 is connected to an odd-number designation flip-flop (ODF) 139. On the other hand, the ROM 101 is read on a bus 167, and the output data of the ROM 101 are temporarily stored in a latch circuit 104. The latch circuit 104 is connected to an instruction decoder circuit (ID) 103, a RAM 102 and the bus 165. To the RAM 102 is input through a bus 168 a RAM address signal which is output from a stack pointer (SP) 105. As a result, data stored at a designated address of the RAM 102 are read on the bus 165. The bus 165 is connected to a stack register (STK) 109 which temporarily holds the contents of the program counter (PC) 108. The output of the stack register (STK) 109 is input through the bus 169 to the program counter (PC) 108. The bus 165 is further connected to a lower-digit accumulator (AL) 110, a higher-digit accumulator (AH) 111, a B-register 114, a C-register 115, the mode register (MODE) 135 and a flag register (FL) 136. In addition, the bus 165 is connected to temporary memory registers 120 and 121 each having a 16-bit construction, a frequency-division value (pitch data) N-register 123 which stores a preset value in the program counter (PC) 108, a D-register 117, and a latch (LAT3) 118 for storing digital data to be input to a D/A converter 119. The high-digit and lower-digit accumulators 110 and 111 are jointly formed as an accumulator of 16 bits in total. To the lower-digit accumulator (AL) 110 is connected a stack register (A') 113 in which the contents of the lower-digit accumulator (AL) 110 are temporarily sheltered upon interruption processing. The N-register 123 is connected to a programmable counter (PGC) 124 and an N-decoder circuit 125. Through this circuit, the desired pitch period is determined. The programmable counter (PGC) 124 feeds data to one-bit frequency-divider circuits 126–128, respectively. The 4-bit output from the programmable counter (PGC) 124 and the one-bit frequency-divider circuit group 126–128 in combination, and the 4-bit output from the N-decoder circuit 125 are transferred through a matrix circuit including transfer gates for switching signals 129–132, to the one-pulse generator 133 and the interruption address generator 141, respectively. An output of the one-pulse generator 133 is fed to the interruption control circuit (INT G) 140. An output of the polynominal counter (PNC1) 134 is sent to the bus 165. The respective outputs from the 16-bit latch circuits 120 and 121 are input to a 16-bit arithmetic and logic operation unit (ALU) 122 where logic operations are carried out, and the results S are output to the bus 165. The flag register (FL) 136 is associated with a sheltering flag register (FL') 137. In addition, a part of the contents of the flag register (FL) 136 is also fed to a judge flip-flop (J) 146. From this judge flip-flop (J) 146 is output a non-operation instruction (NOP) depending upon the results of judgement. The bus 165 to be used for transfer of principal data between the respective blocks is interconnected with an input/output port data bus 175 which carries out data transfer to or from external instruments. This input/output port data bus 175 is connected to latch circuits 163 and 164 and input/output 171 and 172. Furthermore, there are provided a speech sign flip-flop (SS) 159, a borrow flip-flop flop (BO) 173 and a tone sign flip-flop (TS) 153 for effecting necessary indication for synthesis processing, and outputs of these flip-flops are connected to the D/A converter 119 and the latch circuit (LAT3) 118, respectively. An analog speech signal output from the D/A converter 119 is fed through terminals 160 and 161 to a loudspeaker 162 and thereby speech is generated.

Now the interconnections between the flip-flops (BO), (SS) and (TS) 173, 159 and 153 will be explained. The output signal from the TS 153 is branched into a signal output through a switching transfer gate 157 and a signal output through an inverter 154 and a switching transfer gate 156. They are both input to the SS 159. The input to the TS 153 is fed from the bus 165. Furthermore, the output of the TS 153 is input to one input terminal of an exclusive OR gate 158, another input terminal of which is applied with the output of the polynominal counter (PNC2) 138, and whose output is applied via a gate 152 to the arithmetic and logic operation unit (ALU) 122. An output terminal $C_{16}$ of the ALU 122 is connected to the flip-flop (BO) 173, the gate 156 and an inverter 155. On the other hand, an output terminal $C_8$ of the ALU 122 is connected to the flag register (FL) 136. Moreover, output terminals $C_5$ and $C_6$ of the ALU 122 are connected to the flag register (FL) 136 in common, and due also applied to gates 150 and 151, separately. These gates 150 and 151 are controlled by the outputs of OR gates 148 and 149, respectively. The outputs of the gates 150 and 151 are again input to the ALU 122. To the OR gates 148 and 149 are input an $ID_2$ signal (as will be described later) and an in-phase or out-of-phase signal, respectively, from a mode register (MODE) 135. The out-of-phase signal is produced by an inverter 147.

Now description will be made of the generation of various control signals applied to the respective circuit sections, and especially the generation of clock signals. The oscillator 142 feeds an oscillation output (in this illustrated embodiment, assumed to have a frequency of 3.58 MHz) of a crystal, ceramic, CR or other oscillator element contained therein to a frequency-divider and clock-generator circuit 143. As a result, a plurality of clock signals having predetermined pulse widths and pulse intervals are transferred to various circuits such as memories, gates, registers, latches, etc. A clock signal $\phi_2$ has a frequency of 894.9 KHz which is obtained by dividing the oscillation frequency of 3.58 MHz by four. Incrementing of the program counter 108 which generates an address signal for reading the ROM 101 is synchronized with this clock signal $\phi_2$. The program counter 108 transfers its contents through the buses 169 and 165 to the latch circuit 120 to be stored there, also as synchronized with the clock signal $\phi_2$. The latch circuit 120 has a capability of holding a data of 16 bits, and it serves as a temporary register circuit for supplying operation data to the arithmetic and logic operation unit (ALU) 122. Accordingly, the contents of the program counter 108 transferred to the latch circuit 120 are further sent to the ALU 122, where a +1 addition operation is carried out to the contents of the program counter 108. From an S-output terminal of the ALU 122 is output the result of the operation, which is passed through the data bus 165 to the program counter stack register (STK) 109 and stored therein. Therefore, in this stack register 109 are obtained new address data ($PC_i+1$) which is the sum of the previous contents of the program counter 108 ($PC_i$) and +1. This data is again input to the program counter 108 in synchronism with a clock signal $\phi_1$.

The above is a description of an increment operation of the program counter 108. The incremented data are transferred through the address bus 166 connected to the ROM 101 as controlled by a clock signal $\phi_1$. Consequently, the data stored at the designated address in the ROM 101 are read out as an operation code (OP code) for indicating the processing at the next timing. The read OP data are input through the data bus 167 to the latch circuit 104 in synchronism with the clock signal $\phi_2$. Also, the data are set in the instruction decoder (ID) 103 at the same timing. The instruction decoder (ID) 103 outputs a predetermined control signal (micro-order signal) on the basis of the input OP code. According to this control signal the entire system would operate. However, in the case where the ROM 101 is used as a table (for storage of processing data), the data read out of this table is not used for generating a micro-order but is used as processing data.

Figure 10:
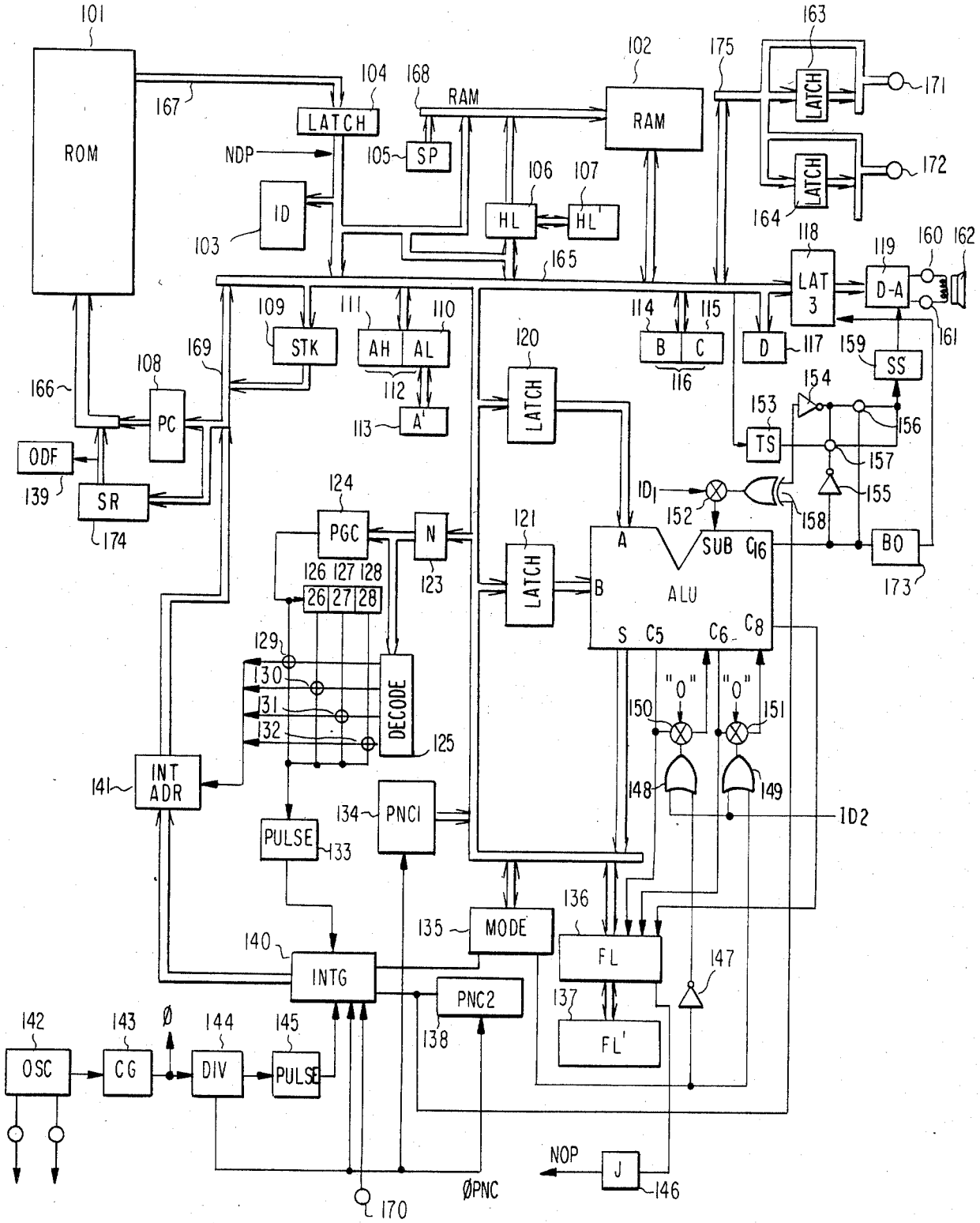
FIG. 10 is a block diagram of a second embodiment of the present invention.

It should be noted that the hardware construction illustrated in FIG. 10 is composed of similar circuit elements to those of the conventional micro-processor and memory. Accordingly, the system shown in FIG. 10 has not only the function of a speech synthesizer circuit but also the function of the conventional micro-computer which can execute programs other than the speech synthesis program such as, for example, a peripheral instrument control program, a display processing program, a numerical calculation program, etc. This means that the sound synthesizer according to the present invention can be realized by means of a conventional micro-computer.

Now, the state of data storage in the RAM 102 which would edit and temporarily store the parameters and data read out of the tables in the ROM 101 upon speech synthesis, will be explained with reference to FIG. 11. The RAM 102 comprises memory regions of 16 bits per address. At the higher 8-bit positions ($R_0, R_2, \ldots, R_{2n}$) and lower 8-bit positions ($R_1, R_3, \ldots, R_{2n+1}$) of the respective regions are respectively stored the data read out of the ROM 101 as described hereunder. The lower 8-bit address values and higher 8-bit address values of the start address (tone waveform name) of the ROM table in which the tone waveform part of the voiced sound to be synthesized is preset are stored in the sub-regions $R_0$ and $R_1$, respectively. Also, in the sub-regions $R_2$ and $R_3$ are respectively stored the lower 8-bit address values and higher 8-bit address values of the start address of the ROM table in which the tone envelope waveform data group is preset. In the sub-regions $R_4$ and $R_5$ are respectively stored the lower 8-bit address values and higher 8-bit address values of the ROM table in which the noise envelope waveform data group is preset. In the sub-regions $R_6$ and $R_7$ are stored time count data as parameters for the speech synthesis. In the sub-region $R_8$ is stored a tone envelope time rate, and in the sub-region $R_A$ is stored a noise envelope time rate. In the sub-regions $R_9$ and $R_B$ are stored time counts of tone and noise envelopes, respectively (similar contents to those stored in the sub-regions $R_8$ and $R_A$). In the sub-regions $R_C$ and $R_D$ are stored peak values of a noise and a tone, respectively. In the sub-regions $R_E$ and $R_F$ are respectively stored the lower 8-bit address values and higher 8-bit address values of the start address representing the tone waveform name to be subsequently used for the speech synthesis. Arithmetic operations as described hereinafter are executed on the basis of the parameters and data stored in the sub-regions $R_0$ to $R_D$, and the resultant tone output data and noise output data are stored in the sub-regions $R_{10}$ and $R_{12}$ and in the sub-regions $R_{12}$ and $R_{13}$, respectively. The respective contents in the sub-regions $R_0, R_1, \ldots, R_{2n+1}$ of the RAM 102 can be directly read out by transferring the OP code data (operand) derived from the ROM 101 to the RAM 102 through the RAM address bus 168. In addition, data can be read out of the RAM 102 by means of the contents of the stack pointer (SP) 105 connected to the RAM address bus 168. Especially, when the contents of the stack pointer (SP) 105 are all "0", the sub-regions $R_0$ and $R_1$ are simultaneously designated.

In the followings, basic operations of the speech synthesizer according to the illustrated second preferred embodiment of the present invention will be described.

In this embodiment, the speech synthesis processing is executed principally in the three modes of tone processing mode, time control mode and noise processing mode. The details of these three modes will be described later. Basically, in the tone processing mode, a tone signal is produced by multiplying a tone waveform by a tone envelope and further by a tone peak value. On the other hand, in the noise processing mode, a noise signal is produced by multiplying a noise waveform by a noise envelope and further by a noise peak value. In addition, in the time control mode, the processing period for the tone and noise is controlled, and parameters of the sound to be synthesized subsequently are set in the RAM 102. The tone signal and noise signal produced in the above-described processing modes are either added or subtracted in the arithmetic and logic operation unit. The resultant digital signal forming a speech signal is subjected to D/A conversion and then applied to an electro-acoustic device (a loudspeaker in the illustrated embodiment) on a real time basis. As a matter of course, the speech synthesizer illustrated in FIG. 10 can execute, besides the above-described three modes of processing for speech synthesis, processing such as numerical calculations, control of peripheral instruments, etc. which are irrelevant to the speech synthesis. Accordingly, in this preferred embodiment, the above-described three speech synthesis processing modes are excecuted as interruption modes during a general processing in a data processing system. The term "interruption mode" means such processing mode that a processing which is currently being executed is interrupted forcibly or at a predetermined timing to execute a separate processing. For that purpose, in the system shown in FIG. 10 are provided a stack pointer 9 and a stack flag (FL') 37, or the like, which serve to temporarily shelter the contents of the program counter and flag indicating the step of processing that is currently being executed. In the case where an interuption mode is not used, that is, in the case where the hardware shown in FIG. 10 is used soley for the purpose of speech synthesis, the aforementioned circuit components for temporary storage are unnecessary.

Now description will be made on the procedure for synthesizing the speech of Japanese "Ka" whose waveform is illustrated in FIG. 3. At first, the part "K" of the phone "Ka", that is, the noise (unvoiced sound) portion will be synthesized. This is executed in a noise interruption mode. Accordingly, in the mode register 135 in FIG. 10 is set a signal which designates the noise mode. Further, in the sub-regions $R_4$ and $R_5$ of the RAM 102 are set the start address data of the table in the ROM 101 in which table is written the noise envelope waveform information of the phone "Ka". In addition, in the sub-region $R_A$ of the RAM 102 is stored a time rate in the case of dividing the noise shown in FIG. 3(*a*) into 32 time intervals. In this instance, the time rate is set in such manner that the time of the end of the noise "K" may correspond to the ROM address offset value 31 of the noise envelope shown in FIG. 4(*d*). Furthermore, a noise peak value for determining the intensity (amplitude) of the noise is set in the sub-region $R_C$ of the RAM 102. In such an initial state, the sub-regions $R_{10}$, $R_{11}$, $R_{12}$ and $R_{13}$ are kept reset to "0".

In this preferred embodiment, polynomial counters 134 and 138 are used to provide the noise waveform data. The polynomial counter serves to randomly generate any one of count values 1–N in response to a clock signal. However, if N is the maximum count value, then in the output periods 1–N no count number would ever be generated more than twice.

The polynomial counters 134 and 138 in FIG. 10 are counters for generating the above-described pseudo random signals, and their input clock signals are fed from the frequency divider circuit 144. Each time a clock $\phi_{PNC}$ is fed from the frequency-divider circuit 144 to the polynomial counter 138, an interruption signal is applied from the polynomial counter 138 to the interruption control circuit (INT G) 140. At this moment, the mode register 135 (a flip-flop being available therefor) indicating generation of a noise, is set at "1". Accordingly, in this period is established a noise interruption mode. An interruption signal is applied from the interruption control circuit (INT G) 140 to the interruption address circuit (INT ADR) 141 in synchronism with the clock $\phi_{PNC}$. As a result, a noise interruption address signal is sent from the INT ADR 141 to the program counter (PC) 108. Furthermore, at this moment, the data currently set in the lower digit accumulator (AL) 110 and the flag register (FL) 136 are temporarily sheltered in the sheltering accumulator (A') 113 and the sheltering flag register (FL') 137, respectively. In addition, prior to the setting of the interruption address signal in the program counter (PC) 108, the current contents of the program counter (PC) 108 are written through the buses 169 and 165 at the address of the RAM 102 designated by the stack pointer (SP) 105. When this operation has been finished, the contents of the stack pointer (SP) 105 are automatically added with +1. Also, the mode register 135 for indicating the noise mode is set to "1" to instruct the execution of the noise interruption operation. As a result, a noise interruption signal is set in the program counter (PC) 108, and this is transferred through the ROM address bus 166 to the ROM 101 as in synchronism with the clock $\phi_1$. The operations up to this point are the initial operations for the noise interruption processing. Thereafter, a noise interruption processing (table reference instruction 100), as described hereunder, is executed.

Figure 12:
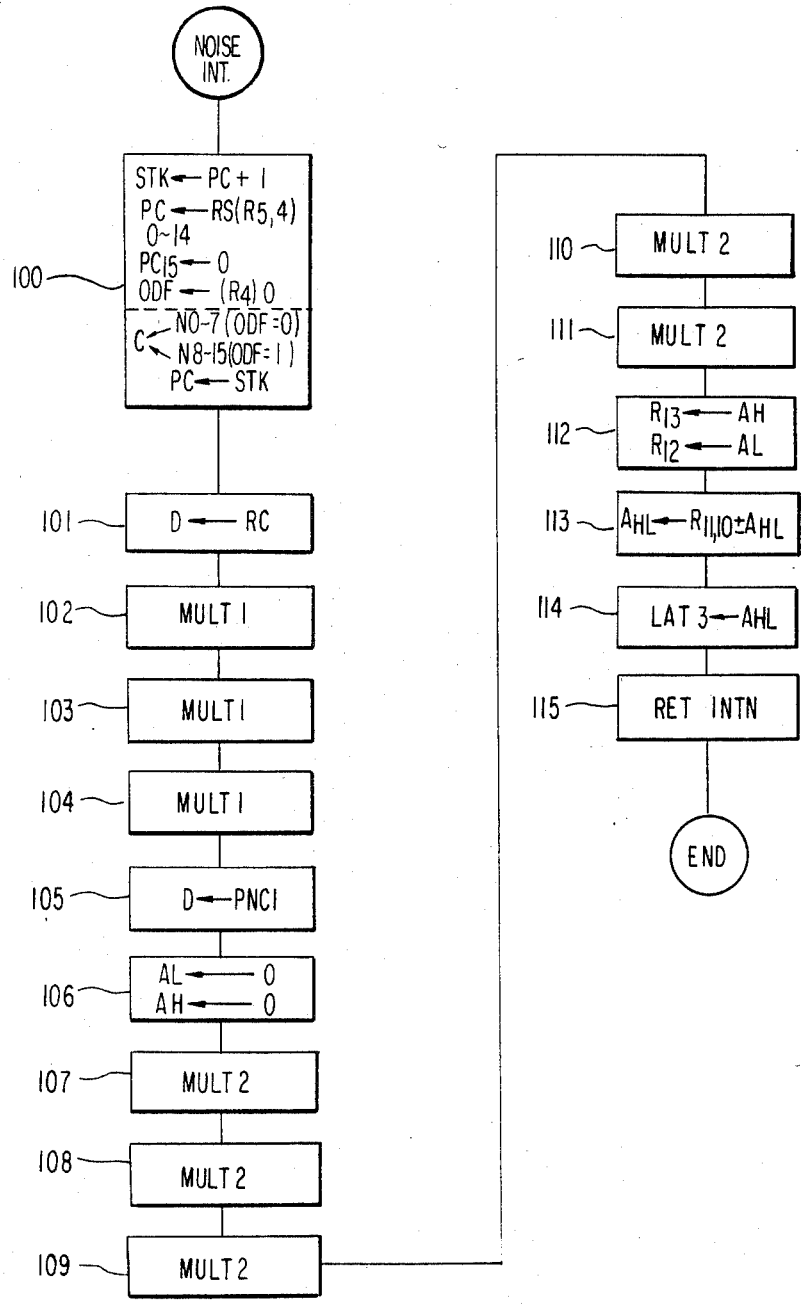
FIG. 12 is a flow chart of the noise signal processing.

In the following, description will be made of the procedures of the noise interruption processing starting from the table reference instruction 100, with reference to the flow chart shown in FIG. 12.

In the following description, the various operational steps are designated 100–165 with various of these numbers having been used to designate hardware components in FIG. 10. In order to eliminate any confusion between the step numbers and hardware reference numerals, the former will always be preceded by the words "step" or "instructions", e.g. "step 101". In the noise interruption routine, the table reference instruction 100 is executed on the basis of the interruption address signal (ADR INTN) generated from the interruption address generator (INT ADR) 141. At first, the contents in the program counter (PC) 108 are added with +1 and then stored in the stack register 109. Further, the noise envelope waveform address set in the sub-regions $R_4$ and $R_5$ of the RAM 102 is input to the one-bit right-shift circuit 174 through the buses 165 and 169. Among the input address data, the data excluding the least significant bit are transferred to the ROM 101 as an address output from the program counter (PC) 108. On the other hand, among the lower 8-bit address of the noise envelope set in the sub-region $R_4$ of the RAM 102, the least significant bit is stored in the odd-number designation flip-flop (ODF) 139 by the one-bit right-shift circuit 174. In the next machine cycle, the B-register 114 is initially set. When the odd-number designation flip-flop (ODF) 139 is set at "0" (the address in the sub-region $R_4$ being an even-number address), the lower 8 bits $n_0$–$n_7$ of the table output from the ROM 101 are set in the C-register 115 through the bus 165. On the other hand, when the flip-flop (ODF) 139 is set at "1", that is, when the address in the sub-region $R_4$ is an odd-number address, the higher 8 bits $n_8$–$n_{15}$ of the table output from the ROM 101 are set in the C-register 115. In this way, the noise envelope data are read out from the ROM 101. Thereafter, the contents of the stack register (STK) 109 are returned to the program counter (PC) 108, and the procedure advances to the next step. In the step 101, the noise peak value data set in the sub-region $R_C$ of the RAM 102 are stored in the D-register 117. Next, in the step 102 a MULT 1 instruction is executed. According to this instruction, the contents of the B-register 114 and the C-register 115 are shifted leftwards by one bit if the least significant bit in the D-register 117 (the least significant bit of the noise peak value data) is "1". Thereby the stored levels are doubled. On the other hand, if the least significant bit in the D-register 117 is "0", then the data in the C-register 115 are not shifted, but the data in the D-register 117 are shifted rightwards by one bit. The subsequent steps 103 and 104 are execution cycles for the above-described MULT 1 instruction, in which if the contents of the D-register 117 are, for example, "00000111", then the data in the C-register 115 are successively shifted 3 times leftwards, and thereby the level of the data in the C-register 115 is multiplied by 8. In this way, by executing the MULT 1 instructions a desired number of times (three times in the above-described embodiment), the noise envelope level can be set at any one of the unit, double, fourfold and eightfold levels. Accordingly, if the number of executions of this instruction MULT 1 is further increased, then the sixteenfold, thirty-twofold or higher level can be set. Therefore, the noise envelope level can be set at a desired peak value level.

Subsequently, in the step 105, the data fed from the polynomial counter (PNC 1) 134 for generating a pseudo random level, are set in the D-register 117 through the bus 165. In the step 106, the accumulator 112 is set to its initial condition. Here it is to be noted that in the case where the higher-digit accumulator (AH) 111 and the lower-digit accumulator (AL) 110 are used in combination as a 16-bit register, they are called simply "accumulator", and with respect to the B-register 114 and the C-register 115 also, in the case of using them in combination as a 16-bit register, they are called simply "BC-register".

The steps 107 to 111 are execution cycles for a MULT 2 instruction. The MULT 2 instruction is a multiplication instruction. According to this instruction, when the least significant bit in the D-register 117 (the data fed from the PNC 1) is "1", the 16-bit data in the accumulator 112 are set in the latch circuit 120. Moreover, the 16-bit data in the BC-register 116 are set in the latch circuit 121 through the bus 165. The respective data set in both latch circuits 120 and 121 are input to two input terminals A and B of the ALU 122 to be added with each other. The result of addition is output from the S-output terminal through the bus 165, and then set in the accumulator 112. On the other hand, when the least significant bit in the D-register 117 is "0", the addition operation in the ALU 122 is not effected, but the contents of the accumulator 112 are maintained in themselves. Instead, the data in the D-register 117 are shifted rightwards by one bit, and the data in the BC-register 116 are shifted leftwards by one bit. Such MULT 2 instruction is an instrution to multiply the noise envelope data by the noise waveform data, the amplitude values of these data having been already set. In this way, the arithmetic operations of (noise envelope data)×(peak value)×(voice waveform data) can be executed. Next, in the step 112, the data in the accumulator 112 are transferred to and stored in the sub-regions $R_{12}$ and $R_{13}$ (noise output) of the RAM 102.

In the step 113, the noise signal and the tone signal are mixed together. A previously calculated tone signal is set in the sub-regions $R_{10}$ and $R_{11}$ of the RAM 102 as 15 bits in total plus one sign bit of coded data. This tone signal and the noise signal set in the accumulator 112 are transferred to the latch circuits 121 and 120, respectively, and arithmetic operations of these signals are effected in the ALU 122, and the result is set in the accumulator 112. In this instance, if the sign bits of the tone signal and the noise signal represent the same sign, addition is executed. Whereas if they represent opposite signs, subtraction is executed. In addition, in the case of the same sign, the carry output $C_{16}$ from the ALU 122 becomes "0", and hence the gate 157 is opened. Accordingly, the output of the tone sign flip-flop (TS) 153 is in itself set in the sound sign flip-flop (SS) 159. On the other hand, even in the case of opposite signs, if the tone signal is larger in magnitude than the noise signal, then the borrow output "0" is derived from the same terminal $C_{16}$ of the ALU 122. Accordingly, the output of the TS flip-flop 153 is set in the SS flip-flop 159 through the gate 157. However, in the case where the noise signal and the tone signal have the opposite signs and the former is larger in magnitude than the latter, the borrow output $C_{16}$ of the ALU 122 becomes "1", and hence "1" is written in the borrow flip-flop (BO) 173. Accordingly, an inverted output of the TS flip-flop 153 is set in the SS flip-flop 159 via the gate 156. Now, if the sign bits of the noise and the tone are both "0", that is, if the output of the polynominal counter (PNC 2) 138 is 0 and also the tone sign flip-flop (TS) 153 is in the "0" state, then the noise and tone output levels are both at the + levels, whereas if they are both "1", then the noise and tone output levels are both at the − levels. Furthermore, since the output of the exclusive OR gate 158 is "0" if the both signals have the same sign, and "1" if they have the opposite signs, the addition or subtraction can be properly executed by applying this output of the exclusive OR gate 158 to the subtraction instruction input terminal SUB of the ALU 122. The ALU 122 is constructed in such manner that subtraction may be executed when the SUB input is "1", and addition may be executed when the SUB input is "0". With regard to the designation of the arithmetic operation type (addition or subtraction) of the ALU 122, it is also possible to designate the arithmetic operation type by inputing an output control instruction ID, from the instruction decoder (ID) 103 for decoding the OP code, through the gate 152 to the SUB terminal. This is utilized for processing other than the arithmetic operations for mixing the tone signal with the noise signal (speech synthesis processing).

Next, in the step 114, the higher 8 bits in the accumulator 112 (the data in the higher-digit accumulator 111) are set in the latch LAT 3) 118 via the bus 165. When the borrow output $C_{16}$ for the 16th bit becomes "1" as a result of the instruction processing ($A_{HL} \leftarrow R_{11}$, $R_{10} \pm A_{HL}$) executed in the step 113, the BO flip-flop 173 is set to "1". Then, the respective outputs from the accumulator 112 are inverted and then set in the latch (LAT 3) 118. Alternatively, after the data in the accumulator 112 have been set in the latch 118, if the BO flip-flop 173 is at the state "1", the output from the latch 118 could be applied to the D/A convertor 119 after it is inverted.

Finally in the step 115, a RET INTN instruction is executed. This is a return instruction for releasing the noise interruption mode. According to this instruction, the mode register (MODE) 135 is reset, and the data in the RAM 102 addressed by the contents of the stack pointer (SP) 105 are returned to the program counter 108. In addition, the content of the stack pointer (SP) 105 is decreased by one. Thereafter the data sheltered upon interruption, that is, the lower-digit accumulator data temporarily stored in the sheltering accumulator (A') 113 and the flag data temporarily stored in the sheltering flag register (FL') 137, are respectively returned to the lower-digit accumulator (AL) 110 and the flag register (FL) 136. As a result, the noise interruption processing has been finished.

A series of interruption processings 100 to 115 as described above are executed each time the clock $\phi_{PNC}$ enters the polynomial counters 134 and 138. It is assumed that the sign of the noise is "+" when the output of the polynomial counter (PNC 2) 138 is "0", and "−" when it is "1". The level of the noise signal is a digital value consisting of a 15-bit data total, which is obtained as a result of arithmetic operations of (data of polynomial counter (PNC 1) 134)×(noise peak value)×(noise envelope level). The final speech output is obtained by adding or subtracting the noise signal obtained by above-described interruption processing routine and the tone signal already set in the RAM 102 to or from each other depending upon the signs of the respective signals. This final speech output signal is subjected to digital-analog conversion (through the D/A converter 119), and thereafter applied through the terminals 160 and 161 to the loudspeaker 162.

Figure 13A:
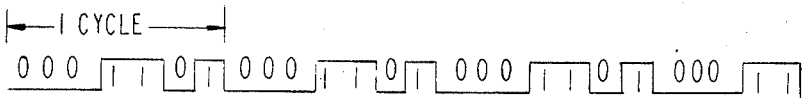
FIGS. 13(*a*) and (*b*) are timing charts of output data generated by a polynomial counter.
Figure 13B:
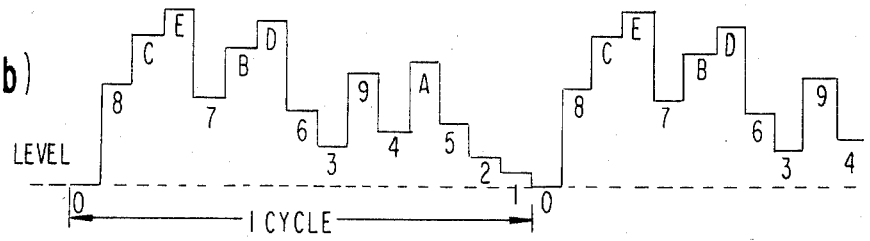
Figure 13C:
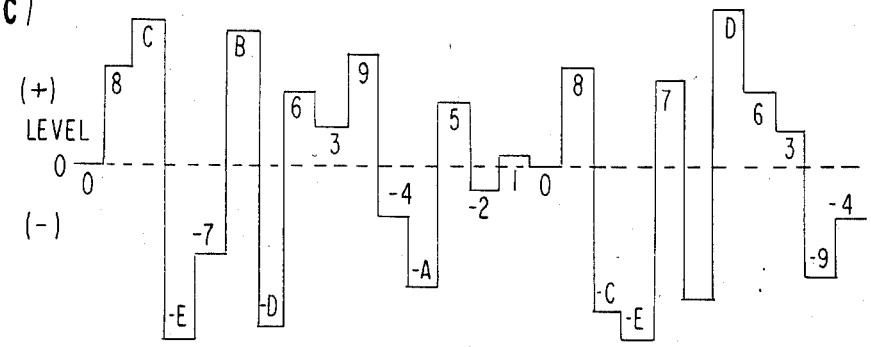

For simplicity of explanation, assuming that the polynomial counter (PNC 2) 138 shown in FIG. 10 has a 3-bit construction and the polynomial counter (PNC 1) 134 has a 4-bit construction, the waveform diagram for the respective outputs is shown in FIG. 13. A serial signal output from the polynomial counter (PNC 2) 138 is shown at (a) in FIG. 13. This signal is the signal indicating a sign of a noise, "0" indicating a (+) level of the noise while "1" indicating a (−) level of the noise. One period of this output signal consists of 7 bits. The output data of the polynomial counter (PNC 1) 134 are shown at (b) in FIG. 13. One period of this output signal consists of 15 bits. The contents of this polynomial counter 134 determine the amplitude level of the noise. A noise wave form obtained from the outputs of the polynomial counters (PNC 1) (PNC 2) 134 and 138 shown at (a) and (b), respectively, is illustrated at (c) in FIG. 13. The noise waveform is obtained by executing a noise interruption processing in every period of the clock applied to the polynomial counters. In practice, the final noise signal can be obtained by multiplying this noise waveform by the noise peak value and further by the noise envelope waveform level as described above. In the case where the polynomial counter (PNC 2) 138 for determining the sign of the noise is constructed of 3 to 5 bits and the polynomial counter (PNC 1) 134 for determining the amplitude level of the noise is constructed of 7 bits, the repetition frequency of the noise is equal to (clock frequency for polynomial counters $\phi_{PNC}$)÷(7–31)÷127. Accordingly, assuming that $\phi_{PNC}$ is 10 KHz, then the repetition frequency becomes 11.2 Hz–2.5 Hz, which is an inaudible frequency. The maximum frequency of the noise is represented by $\phi_{PNC}\div 2$. Furthermore, if the polynomial counter (PNC 2) 138 is constructed of more bits, then the average value of the noise frequency is further lowered. In other words, the average value of the noise frequency is proportional to the clock frequency for the polynomial counters.

Now description will be made of a time control interruption mode. In the time control interruption mode, the clock $\phi$ is divided in frequency by the frequency-divider circuit 144 in FIG. 10 and then applied to the one-shot generator 145. As a result, a one-pulse signal is generated in every reference period and is input to the interruption control circuit 140. If another interruption processing is being executed at this moment, then the time control interruption processing will commence after the processing being executed has terminated.

The purpose of the time control interruption processing is control for the timing of the stepping of an address for an envelope waveform, control for the time length of a speech, and setting of parameters for a speech to be synthesized subsequently.

Figure 14B:
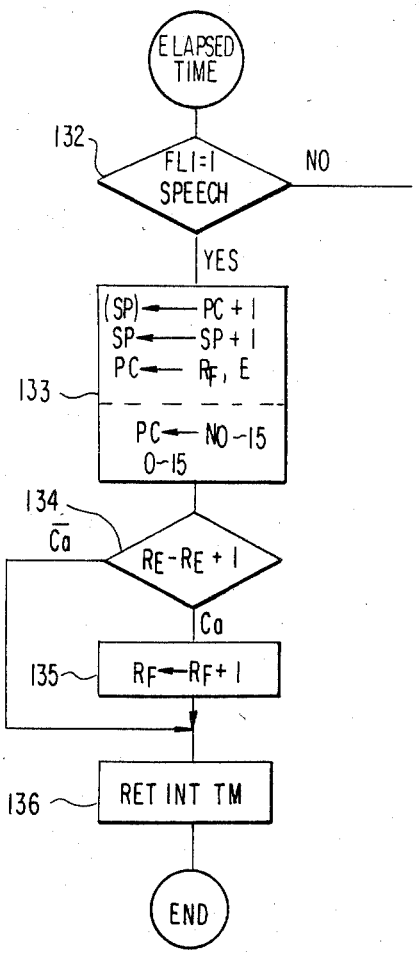
FIGS. 14(*a*) and (*b*) are flow charts of timing control processing.
Figure 14:
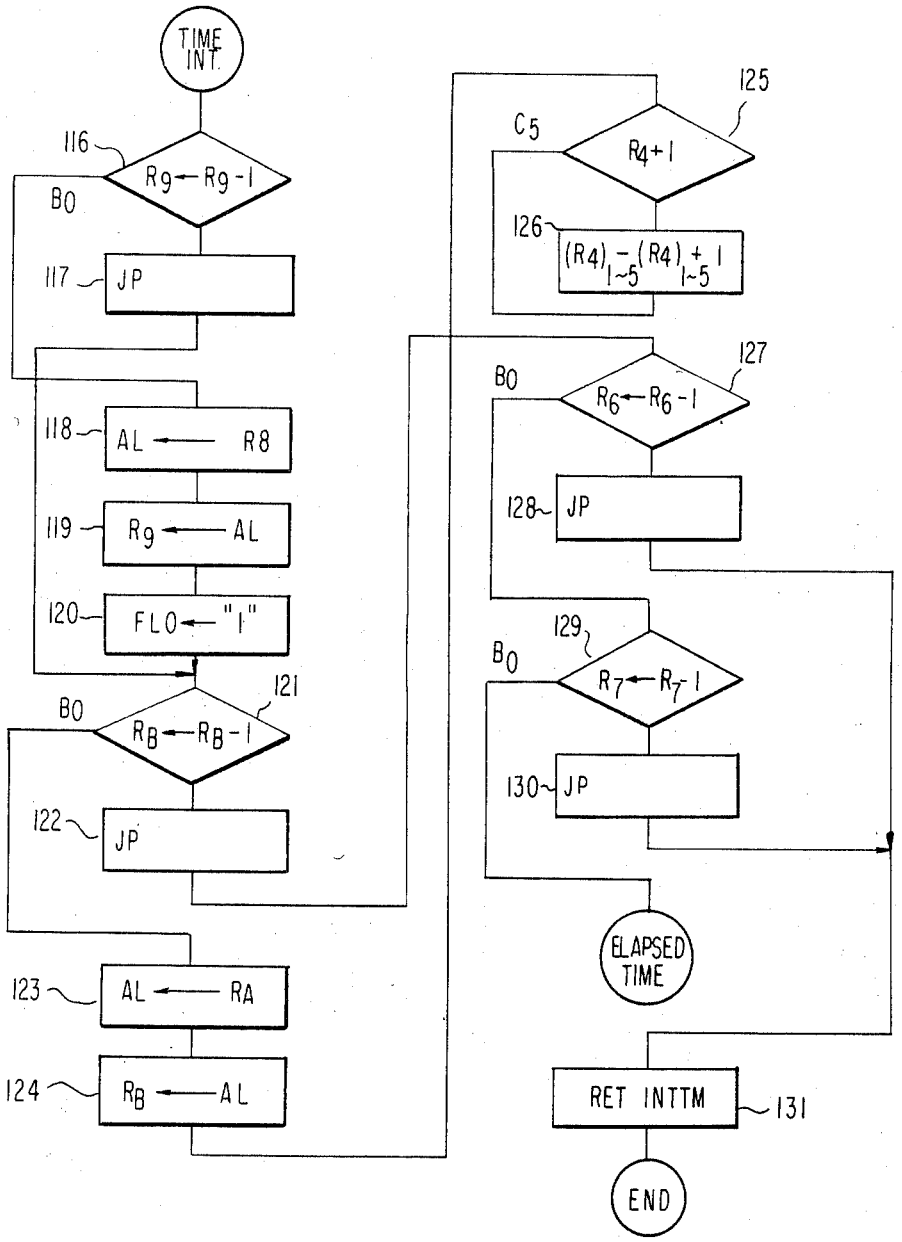
Figure 15A:
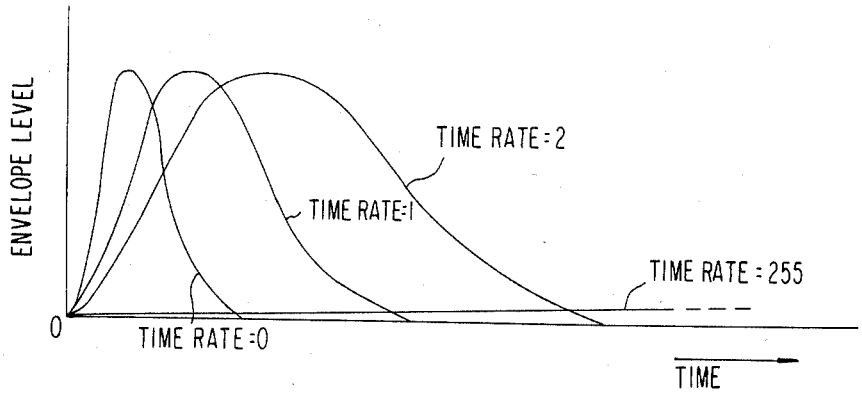
FIGS. 15(*a*) and (*b*) are explanatory diagrams showing the envelope period rate of tone and noise, respectively.
Figure 15B:
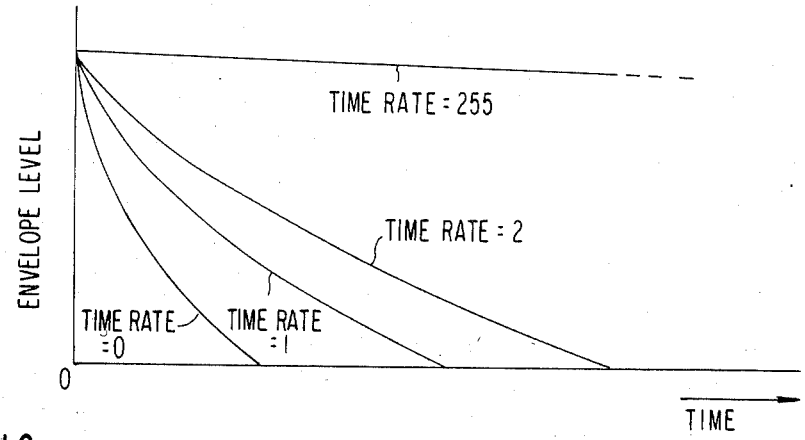

FIG. 14(*a*) shows one example of a flow chart representing the procedure of the time control interruption processing. The operations in this processing will now be explained. Prior to entering the time control interruption processing, at first, sheltering for interruption is effected. At this moment, the time control interruption flip-flop is set, and the contents of the program counter (PC) 108 are written in the ROM 102 at an address designated by the stack pointer (SP) 105. Then the contents of the stack pointer (S) 105 is incremented by one. Subsequently, the data transfer for sheltering of A'←HL and FL'←FL is effected in a similar manner to the processing upon noise interruption. A time control interruption address signal is set in the program counter (PC) 108. In response to the time control interruption address signal, a time control interruption processing instruction is read out. In the steps 116 ($R_9 \leftarrow R_9-1$) to step 120 (FLO←"1"), the tone envelope time $R_1$ is counted down, and if a borrow (BO) appears, a preset value of the tone envelope time rate $R_8$ is set in the sub-region $R_1$ of the RAM 102. In addition, a time control interruption flag FLO in the flag FL 136 is set to "1". More particularly, in the step 116, the tone envelope time count data set in the sub-region $R_9$ of the RAM 108 are decremented by one, and if a borrow is emitted, then the next step is skipped. Here the term "skip" means the operation of omitting the step 117 and shifting to the step 118. In the step 117, unconditional jump to the step 121 is effected. In the step 118, the data set in the sub-region $R_8$ of the RAM 102 are transferred to the lower-digit accumulator (AL) 110. In the step 119, the data set in the lower-digit accumulator (AL) 110 are transferred to the subregion $R_9$ of the RAM 102. In the step 120, the flag FLO in the flag (FL) 136 is set to "1". As a result, the duration of the tone envelope waveform can be varied by a factor of 1 to 256 depending upon the envelope time rate data as shown in FIG. 15(*a*). In the steps 121 to 126, stepping of the address for the noise envelope waveform is executed according to the noise envelope rate. In the step 121, the noise envelope time count data set in the sub-region $R_B$ of the RAM 102 is decremented by one, and if a borrow is emitted, then the next step is skipped. In the step 122, the processing of unconditionally jumping to the step 127 is executed. In the step 123, the noise envelope time rate set in the sub-region $R_A$ of the RAM 102 is transferred to the lower-digit accumulator (AL) 110. In the step 124, the data in the accumulator 110 are set in the sub-region $R_B$ of the RAM 102. In the step 125, the lower 8-digit address of the noise envelope waveform in the sub-region $R_4$ of the ROM 102 is provisionally incremented by one. As a result, if the address value of the fifth bit is emitted as a carry $C_5$, then the next step is skipped. (However, in this case, the data increased by one are not set in the sub-region $R_4$.) In the step 126, among the lower 8-digit address of the noise envelope waveform set in the sub-region $R_4$, only the lower 5 bits are incremented by one. At this moment, if a carry to the sixth bit is output, the carry output is inhibited.

The above-described operations in the steps 121 to 126 are such that as the noise envelope time in the sub-region $R_B$ is counted down, if the borrow $B_0$ is generated, then the preset value of the noise envelope time rate in the sub-region $R_A$ is newly set in the sub-region $R_B$, and the lower 8-digit address of the noise envelope waveform in the sub-region $R_4$ is counted up until it becomes XXX11111. The generation of the borrow $B_0$ indicates the termination of the noise envelope time. The above-mentioned operations are repeatedly executed until the time count set in the sub-regions $R_6$–$R_7$ become 0. When the lower 8-digit address in the sub-region $R_4$ has become XXX11111, control is effected in such manner that it may not be turned to XXX00000 at the next timing. Such control is effected for the purpose of inhibiting the address from returning to the initial address of the envelope waveform. Through the above-described operations, the duration of the noise envelope can be varied by a factor of 1 to 256 depending upon the envelope time rate as shown in FIG. 15(*b*). In addition, the step 127 and subsequent steps are steps for counting down the time count preset data set in the sub-regions $R_6$ and $R_7$. In the case where neither the data in the sub-regions $R_6$ nor $R_7$ become "11111111" and thus a borrow is not generated, the data indicates that the time has not yet elapsed. Then the procedure advances to the instruction designated by the step 111. In the step 131, the time control interruption flip-flop is reset and thus the interruption processing is terminated.

On the other hand, if the data in the sub-regions $R_6$ and $R_7$ both become "11111111" and hence a borrow is generated, then the data indicates that the preset time has elapsed, and so the processing shifts to the processing shown in FIG. 14(*b*). During this processing, in the step 132, it is determined whether or not a word is currently being spoken. If it is being spoken, the processing shifts to the step 133. In this step, the contents of the program counter (PC) 108 are incremented. As a result, the data PC+1 are stored in the RAM 102 at the address designated by the stack pointer (SP) 105. Further, the stack pointer (SP) 105 is incremented by one. Then the data of the next tone address in the sub-regions $R_E$ and $R_F$ are set in the program counter (PC) 108. At the next timing, data $n_{0-15}$ are read out of the table in the ROM 101 addressed by the contents of the program counter (PC) 108 and are again set in the program counter (PC) 108.

Figure 16:
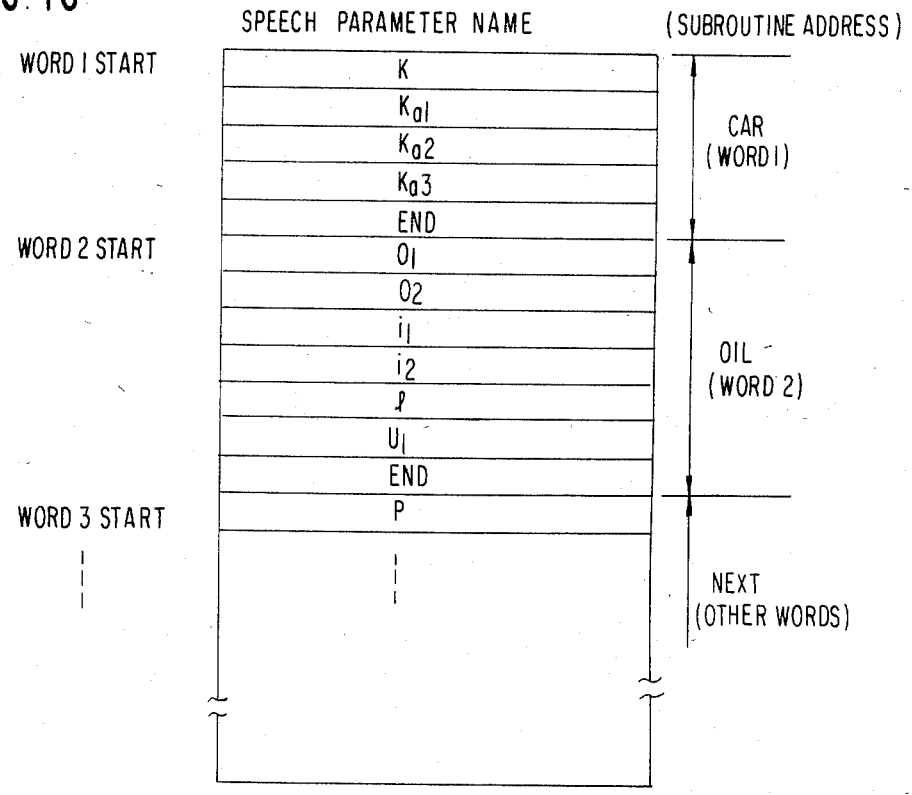
FIG. 16 is a explanatory diagram showing the order of synthesized speech.
Figure 19A:
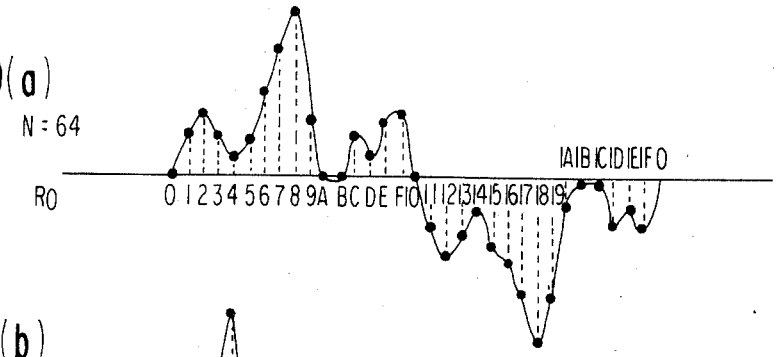
FIGS. 19(*a*) to (*d*) are repeated waveform and sampling points diagrams of the tone signal in the case of N=64, N=32, N=16 and N=8, respectively.
Figure 19B:
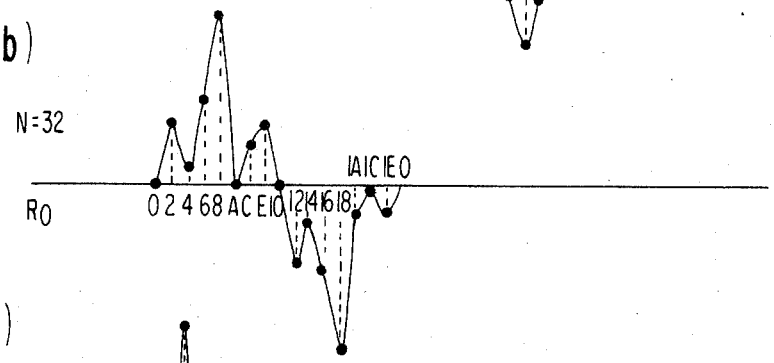
Figure 19C:
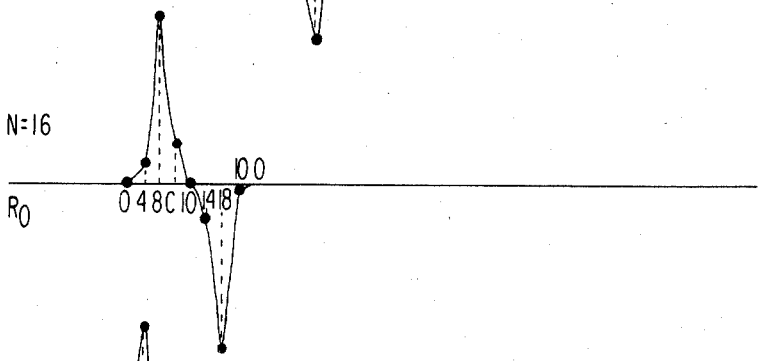
Figure 19D:
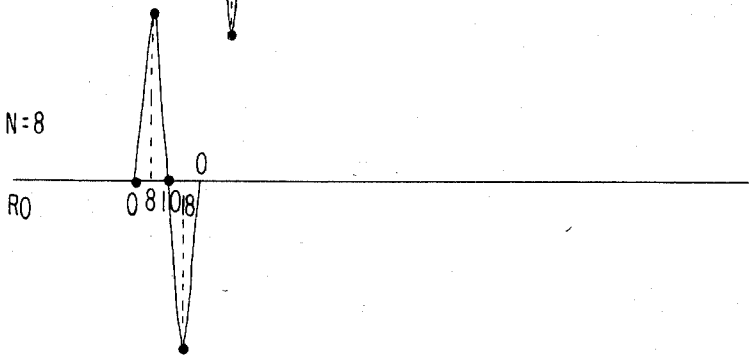

For instance, as shown in FIG. 16, the respective start addresses of the words "car" ($KKa_1\ Ka_2\ Ka_3$) and "oil" ($O_1\ O_1\ i_1\ i_2\ l\ u_1$) are programmed in the ROM 101 in the sequence of generation of speech. Each time a predetermined period has elapsed, a speech parameter setting subroutine corresponding to a speech parameter name indicated by $Ka_1$, $Ka_2$, $Ka_3$, etc. preset at the next tone address is sequentially called, and the processing jumps to the called routine to prepare the respective speech parameters (tone waveform name, noise waveform name, etc.) necessitated for the speech name to be output in the RAM 102. The speech parameter names $Ka_1$–$Ka_3$ are given as one example where three kinds of tone waveform parts (repeated waveform parts) of Japanese "Ka" are preset.

As a storage system for the speech parameters, subroutine type storage is employed. That is, after speech parameters have been set, the contents of the stack pointer (SP) are transferred to the program counter (PC) by means of a return instruction (PC←SP) and the processing of decrementing the contents of the stack pointer (SP) by one (SP←SP−1) is executed. Further, the processing returns to the step 134 shown in FIG. 14(*b*), in which the processing of incrementing the tone address value by one ($R_E \leftarrow R_E+1$) is executed. In this case also, if no carry is generated, then the next step is skipped. On the other hand, a carry is generated, then the processing shifts to the next step 135, in which the processing of incrementing the upper 8-digit address in the next tone address ($R_F \leftarrow R_F+1$) is executed. Thereafter, in the step 136, the processing of terminating the time control interruption is executed. As a result, the interruption processing is released.

With regard to speech parameters of the vowels and voiced sounds other than the vowels ((n), (m), (r), (y), (l), (v), etc.), tone peak values, frequency-division ratios (pitches), tone waveform names, time axis normalization modes for tone waveforms, tone envelope rates, durations and tone envelope waveform names are set in the RAM, and the tone flip-flop is set. On the other hand, with regard to the noise section in the beginning of the consonants (k), (s), (t) and (h), noise peak values, noise envelope waveform names, duration, noise envelope rates and time rates are set in the RAM, and the noise flip-flop is set. Further, with respect to the consonants (d), (b), (p), (g), (z), etc. in the beginning of which a tone and a noise are mixed together, the parameters of both the tone and the noise are set in the RAM, and both the tone flip-flop and the noise flip-flop are set. With respect to the portion subsequent to the beginning portion, if necessary, similar speech parameter subroutines are also prepared. In the speech parameter setting subroutines are set tone peak values for synthesizing the respective speeches, tone waveform names, tone envelope waveform names, frequency-division ratios for determining tone fundamental frequencies (pitches), set instructions for the mode flip-flop which indicates a sampling number for one repeated waveform part, set/reset instructions for the noise flip-flop and tone flip-flop, and time setting instructions. Thus, the sequence of the speech parameter setting subroutines for words such as shown in FIG. 16 can be designated.

FIG. 17 is a flow chart showing a routine for setting words or sentences to be synthesized. At first, a start address of the word is initially set. Further, a word flag is set to read out a speech parameter setting subroutine corresponding to the speech parameter name designated by the start address of the word, and the desired speech parameters are set in the RAM 102. Thereafter, a return instruction is executed to terminate the initial setting. With reference to FIG. 17, in the steps 137 and 138, the start address of the first word is set in the sub-regions $R_E$ and $R_F$ of the RAM 108. In the steps 141 and 142, the start address of the next word is set in the sub-regions $R_E$ and $R_F$ for the next address of the RAM 102. In the step 143, the processing of unconditionally jumping to the step 139 is executed. In the step 139, a word flag FL 1 is set to indicate that a word is currently being spoken. On the other hand, in the step 140, the next tone data ($n_{0-15}$) addressed by the data set in the sub-regions $R_E$ and $R_F$ of the RAM 102 are read out of the RAM 101. Initial settings of other words are likewise effected.

Now tone interruption processing will be described. FIG. 18 shows a timing chart for the tone interruption signals. At (a), (b) (d) and (f) in FIG. 18 are shown output waveform diagrams of the programmable counter 124 when the values (pitch data) 64, 32, 16 and 8, respectively, are set in the frequency-division ratio register (N) 123. The pitch frequencies of the respective waveforms are $f\phi/64$, $f\phi/32$, $f\phi/16$ and $f\phi/8$, respectively. When N=64–255 is fulfilled, a control signal is generated from the N-decoder circuit 125 such that the transfer gate 129 may become conducting. At this moment, the output of the programmable counter 124 is in itself passed through the gate 129 and input to the one-shot generator 133. Thereby one pulse is generated each time the input signal rises or falls, and hence a tone interruption signal as shown in FIG. 18(*a*) is generated. However, when N=32–63 is fulfilled, the N-decoder circuit 125 generates a control signal for making the transfer gate 130 conduct. Then, the output of the programmable counter 124 shown in FIG. 18(*b*) is divided in frequency by a factor of 2 through the one-bit frequency-divider circuit 126. At a result, the waveform shown in FIG. 18(*c*) is input to the one-shot generator 133, and hence a tone interruption signal having the same timing as that in the case of N=64 is generated as shown in FIG. 18(*h*). When N=16–31 is fulfilled, the N-decoder circuit 125 makes the transfer gate 131 conduct. At this moment, the output of the programmable counter 124 is in itself passed through the gate 129 and input to the one-shot generator 133. Thereby one pulse is generated each time the input signal rises or falls, and hence a tone interruption signal as shown in FIG. 18(*h*) is generated. However, when N=32–63 is fulfilled, the N-decoder circuit 125 generates a control signal for making the transfer gate 130 conduct. Then, the output of the programmable counter 124 shown in FIG. 18(*b*) is divided in frequency by a factor of 2 through the one-bit frequency divider circuit 126. As a result, the waveform shown in FIG. 18(*c*) is input to the one-shot generator 133, and hence a tone interruption signal having the same timing as that in the case of N=64 is generated as shown in FIG. 18(*h*). When N=16–31 is fulfilled, the N-decoder circuit 125 makes the transfer gate 131 conduct. At this moment, the output of the programmable counter 124 shown in FIG. 18(*d*) is divided in frequency by a factor of 4 through the two one-bit frequency divider circuits 126 and 127. Accordingly, a signal shown in FIG. 18(*e*) is input to the one-shot generator 133, and hence a tone interruption signal of the same timing as that in the cases of N=64 and N=32 is generated (FIG. 18(*h*)). When N=8–15 is fulfilled, the N-decoder circuit 125 makes the transfer gate 132 conduct. As a result, the output of the programmable counter 124 shown in FIG. 18(*f*) is divided in frequency by a factor of 8 through the three one-bit frequency-divider circuits 126, 127 and 128, and hence a signal shown in FIG. 18(*g*) is input to the one-shot generator 133. In this case also, a tone interruption signal of the same timing as that in the case of N=64, N=32, and N=16 is generated. In other words, in all the cases of N=64, N=32, N=16 and N=8, the tone interruption signal is generated exactly at the same frequency. Accordingly, when the N is set in the range of N=8–255, in the respective ranges of N=8–15, N=16–31, N=32–63 and N=64–255, the highest tone interruption frequency is obtained at N=8, N=16, N=32 and N=64. And the frequencies of the tone interruption signals when N=8, 16, 32 or 64 is fulfilled are equal to each other as described above, and they are equal to a value obtained by dividing the clock frequency $f_\phi$ of the programmable counter 124 by 64, that is, $f_\phi 64$. This value represents the maximum frequency of the tone interruption signal. Assuming now that the clock frequency is set at $f_\phi$=3.579545 MHz÷4=894.9 KHz, then the maximum value of the tone interruption frequency becomes 894.9 KHz÷64=13.98 KHz. Accordingly, it is a characteristic feature of this system that even in the case of N<64, the tone interruption signal frequency would not exceed $f_\phi/64$. FIG. 18(*i*) shows an output waveform diagram of the programmable counter 124 when the value of N=96 is selected, in which as compared to the case of N=64, the tone interruption frequency is reduced by a factor of 64/96=⅔.

In Table-1 are shown comparative data for a tone signal in which one waveform is normalized by dividing into 32 intervals along the time axis and another tone signal in which one waveform is normalized by dividing into 64 intervals. In this table, the values of N are divided into 4 ranges of 8–15, 16–31, 32–63 and 64–255, and the tone interruption frequencies, number of tone interruptions per one waveform, orders of contained harmonic overtones, tone fundamental frequencies and maximum harmonics frequencies were calculated and indicated.

TABLE 1

| Mode of Normalization | Frequency-Division Ratio (N) | Tone Interruption Frequency (Sampling Frequency) | No. of Tone Interruption per one Waveform | Order of Contained Harmonic Overtone | Tone Fundamental Frequency | Maximum Harmonics Frequency |
|---|---|---|---|---|---|---|
| 1 Waveform Divided into 32 (ROM 16 words used) | 8~15 | $\frac{894.9\text{ kHz}}{N} - 8 =$ 13.98~7.45 kHz | 4 | 2 | 3.495 kHz~1.86 kHz | 6.99 kHz~3.73 kHz |
| | 16~31 | $\frac{894.9\text{ kHz}}{N} - 4 =$ 13.98~7.22 kHz | 8 | 4 | 1.747 kHz~902 Hz | 6.99 kHz~3.61 kHz |
| | 32~63 | $\frac{894.9\text{ kHz}}{N} - 2 =$ 13.98~7.10 kHz | 16 | 8 | 873.7 Hz~443 Hz | 6.99 kHz~3.55 kHz |
| | 64~255 | $\frac{894.9\text{ kHz}}{N} - 1 =$ 13.98~3.51 kHz | 32 | 16 | 436.9 Hz~109.7 Hz | 6.99 kHz~1.76 kHz |
| 1 Waveform Divided into 64 (ROM 32 words used) | 8~15 | $\frac{894.9\text{ kHz}}{N} - 8 =$ 13.98~7.45 kHz | 8 | 4 | 1,747 kHz~931 Hz | 6.99 kHz~3.73 kHz |
| | 16~31 | $\frac{894.9\text{ kHz}}{N} - 4 =$ 13.98~7.22 kHz | 16 | 8 | 873.7 Hz~451 Hz | 6.99 kHz~3.61 kHz |
| | 32~63 | $\frac{894.9\text{ kHz}}{N} - 2 =$ 13.98~7.10 kHz | 32 | 16 | 436.9 Hz~221 Hz | 6.99 kHz~3.55 kHz |
| | 64~255 | $\frac{894.9\text{ kHz}}{N} - 1 =$ 13.98~3.51 kHz | 64 | 32 | 218.4 Hz~55 Hz | 6.99 kHz~1.76 kHz |

As will be apparent from Table-1, the tone interruption frequency is irrelevant to the number of divisions of the normalized waveform, but it is determined by the value of the frequency-division ratio N. The number of tone interruptions per one waveform is identical to the number of normalized divisions in the case of N=64–255. Accordingly, the ROM tables are sampled the same number of times as the number of normalized divisions of the waveform. That is, in the case of a normalization mode of 32 divisions per one waveform, the number of tone interruptions is 32, and in the case of a normalization mode of 64 divisions per one waveform the number of tone interruptions is 64. The order of the contained harmonic overtone is equal to the value obtained by dividing the number of tone interruptions per one waveform (i.e., the number of samplings per one waveform of a tone) by 2. The tone fundamental frequency (pitch) is equal to the value obtained by dividing the tone interruption frequency by the number of tone interruptions per one waveform. The maximum harmonics frequency is equal to the value obtained by dividing the tone interruption frequency by 2.

FIG. 19 shows waveform diagrams to be used for explaining the sampling of a tone waveform. In FIG. 19(*a*) are shown the sampling points in the case of N=64. In this case, all the normalized data prepared by dividing one waveform into 32 intervals are read out of the ROM 101. Accordingly, the lower 5-bit data set in the sub-region $R_0$ of the RAM 102 for designating the lower-digit address of the tone waveform are incremented 31 times in the sequence of 0, 1, 2, 3,- - -, 1E, 1F. However, in the case of N=32–63, the number of tone interruptions per one waveform becomes $\frac{1}{2}$ of the number of normalized divisions of the waveform, in the case of N=16–31 it becomes $\frac{1}{4}$ of the number of normalized divisions of the waveform, and in the case of N=8–15 it becomes $\frac{1}{8}$ of the number of normalized divisions of the waveform. In other words, a higher harmonics component is sampled. In addition, in the case of N=32–63, among the normalized data series divided into 32 intervals, 16 sampling points designated by the multiples of 2 are derived similarly to the case of N=32 shown in FIG. 19(*b*). In this instance, the lower 5-bit value set in the sub-region $R_0$ of the RAM 102 for designating the lower-digit address of the tone waveform, is incremented by 2, 15 times in the sequence of 0, 2, 4, 8, - - - 1C, 1E. Also in the case of N=16–31, among the normalized data divided into 32 intervals, 8 sampling points designated by the multiples of 4 are read out similarly to the case of N=16 shown in FIG. 19(*c*). In this case, the lower 5-bit value set in the sub-region $R_0$ of the RAM 102 for designating the lower-digit address of the tone waveform, is incremented by 4, 7 times in the sequence of 0, 4, 8, C,14, 18, 1C. Further, in the case of N=8–15, among the normalized data divided into 32 intervals, 4 sampling points designated by the multiples of 8 are read out similarly to the case of N=8 shown in FIG. 19(*d*). In this case, the lower 5-bit value set in the sub-region $R_0$ of the RAM 102 for designating the lower-digit address of the tone waveform, is incremented by 8, 3 times in the sequence of 0, 8, 10, 18.

With regard to the normalized data obtained by dividing one waveform into 64 intervals, in the case of N=64–255, the lower 6-bit value in the sub-region $R_0$ is incremented by one 63 times. That is all the data at the 64 sampling points are read out. In addition, in the case of N=32–63, the lower 6-bit value in the sub-region $R_0$ is incremented by 2, 31 times. As a result, 32 sampled data at every other sampling point are read out. Further, in the case of N=16–31, the lower 6-bit value in the sub-region $R_0$ is incremented by 4, 15 times. Accordingly, 16 samples of data at every four sampling points are read out. In the case of N=8–15, the lower 6-bit value in the sub-region $R_0$ is incremented by 8, 8 times. Accordingly, 8 sampled data at every eight sampling points are read out.

The normalized data obtained by dividing one waveform into 64 intervals can contain twice as much of the higher harmonics component as compared to the normalized data obtained by dividing one waveform into 32 intervals. Accordingly, when a low-pitched sound having a low tone frequency is synthesized, the larger number of divisions per one waveform is more preferable. However, in the case of synthesizing a high-pitched sound, the number of divisions could be small. This selection of the number of divisions can be arbitrarily made by changing the pitch data (N). Here it is to be noted that in the case of changing a pitch of a sound, the entire waveform is corrected.

Figure 20A:
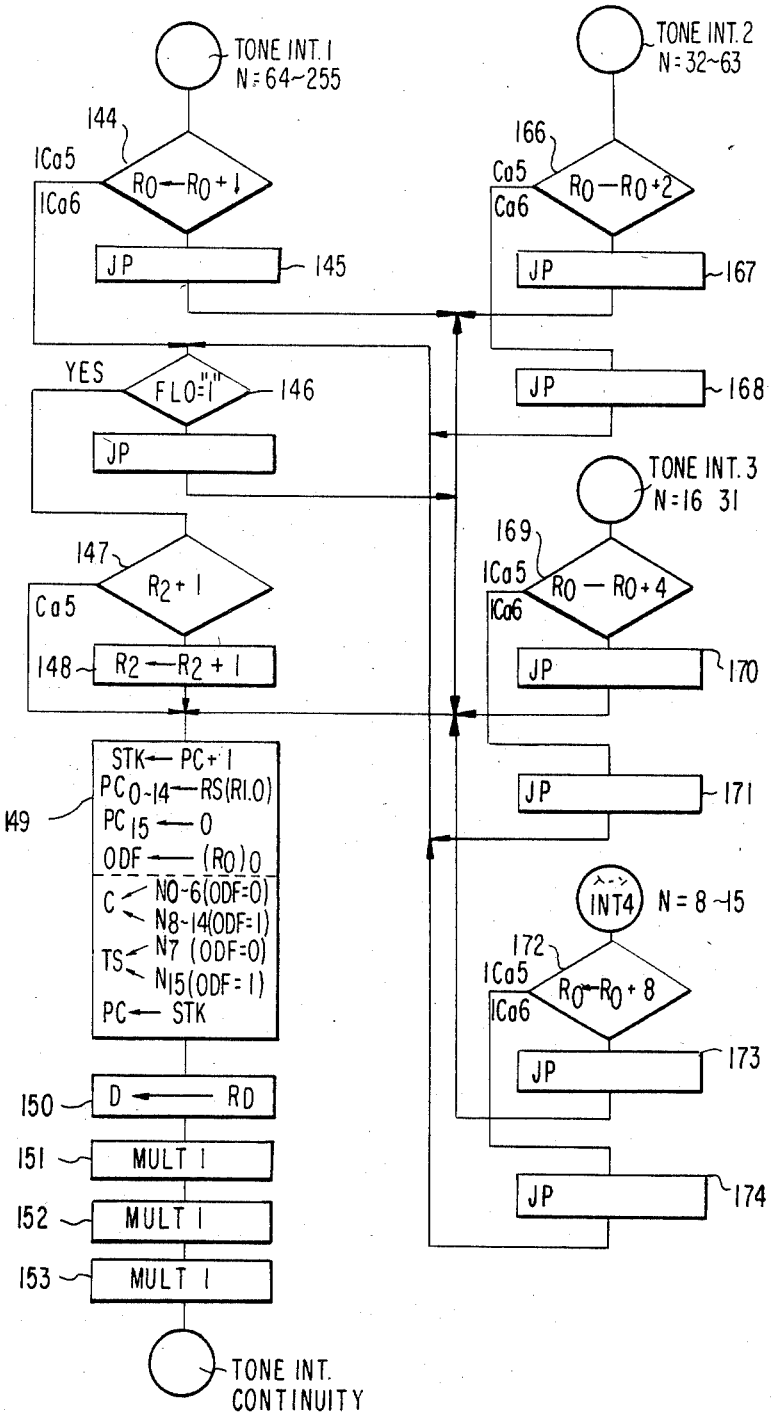
FIGS. 20(*a*) and (*b*) are flow charts of the tone signal processing.
Figure 20B:
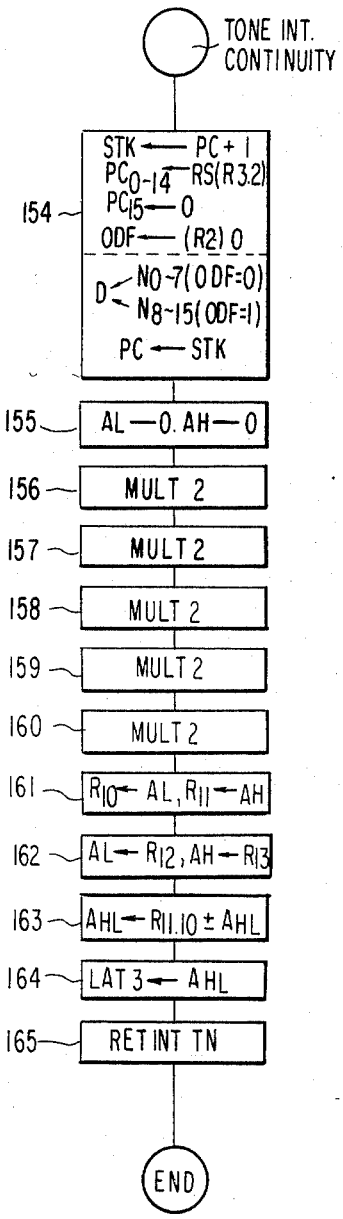

FIG. 20 shows a flow chart for the tone interruption processing. The interruption address generator (INT ADR) 141 is controlled by the value of the frequency-division data N for designating the pitch. In the case of N=64–255, the processing jumps to the interruption address processing named tone INT 1. In the step 166, the contents of the sub-region $R_0$ for storing the lower 8-digit address of the tone waveform are incremented by +2. Also, in the case of N=16–31, the processing jumps to the interruption address processing named tone INT 3. In the step 169, the contents of the sub-region $R_0$ for storing the lower 8-digit address of the tone waveform are incremented by +4. Further, in the case of N=8–15, the processing jumps to the interruption address processing named tone INT 4. In the step 172, the contents of the sub-region $R_0$ for storing the lower 8-digit address of the tone waveform are incremented by +8. When the above-mentioned instruction $R_0 \leftarrow R_0+1$, $R_0 \leftarrow R_0+2$, $R_0 \leftarrow R_0+4$ or $R_0 \leftarrow R_0+8$ has been executed, a control signal $ID_2$ generated by the instruction decoder (ID) 103 turns to "0". Accordingly, either one of the CR gates 148 and 149 is opened depending upon the state of the mode register (MODE) 135. In the case of the normalization mode of dividing one waveform into 32 intervals, the input to the gate 147 shown in FIG. 10 is "1", and so, its output becomes "0". Hence, the outputs of the gate 148 and gate 150, respectively, become "0". This serves to control the ALU 122 such that the carry input $C_6$ to the 6-th bit may be always kept "0". As a result, it is inhibited to jump to another address of the ROM where a different waveform is preset. Whereas, if the 5-th bit carry $C_5$ is generated from the ALU 122, then the instruction designated by the next address is skipped and the processing advances to the step 146. In the case of normalization mode of dividing one waveform into 64 intervals, the input to the gate 147 shown in FIG. 10 is "0", and so, its output becomes "1". Hence the output of the gate 148 becomes "1", so that the 5-th bit carry output $C_5$ is input to the ALU 122. On the other hand, the outputs of the gate 149 and gate 151 both become "0", and thereby the 7-th bit carry $C_7$ input to the ALU 122 is inhibited. Accordingly, it would not occur that the address is changed by a carry from a lower bit. Consequently, a malfunction of jumping to another address of the ROM where a different waveform is preset would not arise. At this moment, if the 6-th bit carry $C_6$ is generated from the ALU 122, then the instruction at the next address is skipped and the processing advances to the step 146. Upon the other instructions, the control signal $ID_2$ from the instruction decoder (ID) 103 becomes "1", so that both the OR gates 148 and 149 close. Accordingly, the gates 150 and 151 allow the 5-th bit carry $C_5$ to be applied to the 6-th bit carry input and the 6-th bit carry $C_6$ to be applied to the 7-th bit carry input. In the step 146, it is determined whether the flag FLO is "1" or not. If it is "1", then the processing advances to the step 147. The moment the when the flag FLO becomes "1" is the time for instructing the execution of the stepping of the tone envelope address in the time control interruption processing shown in FIG. 14(*a*). In other words, the step 146 is executed when the lower 8-bit address of the tone waveform becomes XXX00000 in the event of 32-division mode, and when it becomes XX000000 in the event of 64-division mode. As a result, the flag FLO for instructing the stepping of the address of the tone envelope turns to "1", and the processing advances to the step 147. In this step 147, if the lower 8-bit address of the tone envelope waveform in the sub-region $R_2$ is other then XXX11111, then even upon increment of +1, the 5-th bit carry $C_5$ is not generated. In such case, the processing advances to the step 148. In this step, for the first time, the contents of the sub-region $R_2$ are incremented by +1 according to the instruction $R_2 \leftarrow R_2+1$. As a result, the tone envelope address is stepped. At the start point of the lower 8-bit address of the tone waveform, that is, when the lower 8-bit address of the tone waveform is XXX00000 or XX000000, the tone waveform level is always set at 0000000. Accordingly, the change of the tone envelope level arises only when the tone waveform level is zero. This means that the variation of the tone envelope level starts always from the point where the tone output is zero. Therefore, when the tone waveform is at a level other than zero, variation of the tone envelope level would not arise. Thus, since any discontinuity in a speech waveform would not arise even if the envelope level should be varied, a speech that is free from noise and distortion can be synthesized.

The step 149 is an execution routine for a tone waveform table reference instruction. In this step, the contents of the program counter (PC) 108 are incremented by +1 and set in the stack pointer (STK) 109. Next, the data obtained by rightwardly shifting the contents of the sub-regions $R_1$ and $R_0$ are set in the lower 15-bit positions ($PC_{0-14}$) of the program counter (PC) 108. At the most significant bit position $PC_{15}$ is set "0". The least significant bit LSB originally stored in the sub-region $R_0$ is set in the odd-number designation flip-flop (ODF) 139. At the next timing, the contents of the B-register 114 are cleared, and "0" is input to the most significant bit position of the C-register 115. If the ODF 139 is set at "0", then the lower 7-bit data (0–6) read out of the ROM are set in the remaining bit positions of the C-register 115. Then the data $n_7$ is set in the tone sign flip-flop (TS) 153. In contrast, if the ODF 139 is set at "1", then the upper 7-bit data($n_8$–$n_{14}$) read out of the ROM are set likewise in the C-register 115. Likewise the data $n_{15}$ is set in the TS 153. Thereafter, the contents of the stack pointer (STK) 109 are set in the program counter (PC) 108. Then, the processing advances to the step 150. In this step 150, the tone peak value is set in the D-register 117. In the steps 151, 152 and 153, the MULT 1 instruction is executed. As described previously, if the least significant bit (LSB) in the D-register 117 is "1", then the BC-register 114, 115 is shifted leftwards to double the level, and the D-register is shifted rightwards. If the LSB in the D-register 117 is "0", only the rightward shift of the D-register is effected. This will be apparent from the previous explanation. That is, by executing the steps 151, 152 and 153, the tone level can be increased up to a eightfold value at the highest.

Further, in the step 154 shown in FIG. 20(*b*), a reference instruction for the tone envelope level is executed. In this step, the contents of the program counter (PC) 108 are incremented by +1 and set in the stack pointer (STK) 109. The data in the sub-regions $R_3$ and $R_2$ of the RAM 102 for storing the tone envelope waveform address are shifted rightwards and set in the lower 15-bit positions ($PC_{0-14}$) of the program counter (PC) 108. Zero→"0" is set in the most significant bit position $PC_{15}$ of the program counter (PC) 108. The LSB data in the sub-region $R_2$ for storing the lower 8-bit address of the tone envelope waveform are set in the odd-number designation flip-flop (ODF) 139. In the next processing cycle, if the ODF 139 is set at "0", then the lower 8-bit data ($n_0$–$n_7$) read out of the ROM are set in the D-register, whereas if the ODF 139 is set at "1", then among the data read out of the ROM the higher 8-bit data ($n_8$–$n_{15}$) are set in the D-register. Thereafter, the contents of the stack pointer (STK) 109 are set in the program counter (PC) 108. In the step 155, the higher-digit accumulator (AH) 111 and the lower-digit accumulator (AL) are set to their initial values (the value 0). The step 156, 157, 158, 159 and 160 are execution cycles for the above-described MULT 2 instructions. If the least significant bit (LSB) in the D-register 117 is "1", the instruction of $A_{HL} \leftarrow A_{HL}+BC$ is executed. More particularly, the contents of the $A_{HL}$ and the contents of the BC are added with each other, and set in the 16-bit accumulator ($A_{HL}$) 112. Further, the contents the D-register 117 are shifted rightwards, and the contents of the BC register 116 are shifted leftwards. On the other hand, if the LSB in the D-register 117 is "0", then the contents of the $A_{HL}$ 112 are kept intact, and the contents of the D-register 117 are shifted rightwards. Also, the contents of the BC-register 116 are shifted leftwards. In other words, in the steps 156, 157, 158, 159 and 160, multiplication of the tone waveform level by the tone envelope level is effected to obtain a tone signal. In the step 161, the obtained tone signal is set in the sub-regions $R_{10}$ and $R_{11}$ of the RAM. In the step 162, the noise signal is set in the accumulator 112. In the step 163, the processing of synthesizing the tone signal and noise signal in combination is executed. This is a processing of the same instruction as the step 113 shown in FIG. 12. Further, in the step 164, the upper 8-bit data in the 16-bit accumulator ($A_{HL}$) 112 are stored in the latch (LAT 3) 118. This is the same as the step 114 in FIG. 12. At this moment, if the state of the borrow flip-flop ($B_O$) 173 is "1", then an inverted output (or a complementary) of the data in the $A_{HL}$ 112 is set in the latch (LAT 3). In the step 165, a return instruction for terminating the tone interruption processing is executed. Then the tone interruption flip-flop and the flag FLO are reset. Further, in order to return the sheltered data to their original storage, the instructions of AL←A', FL←FL' and HL←HL' are executed.

In the tone interruption processing mode, multiplication operations of the tone waveform data by the tone peak value and further by the tone envelope value are executed. The resultant tone-signal is added to or subtracted from the noise signal set in the RAM 102, and is then transferred to the D/A converter 119 as a final speech output synthesized from both the noise and tone signals.

FIG. 21 shows one example of a speech waveform synthesized by means of the speech synthesizer according to the above-described embodiment of the present invention. FIG. 21(*a*) shows the obtained noise signal waveform, FIG. 21(*b*) shows the obtained tone signal waveform, and FIG. 21(*c*) shows the synthesized signal waveform generated by mixing the noise and tone signal waveforms. This signal is transferred to the latch 118 as a speech signal. The transferred signal is converted into an analog signal to produce a speech through the loudspeaker 162.

The procedure in the synthesis processing according to the above described embodiment will be summarized in the following. At first, the speech parameters preset in the form of subroutines in the tables of the ROM 101 are read out to the RAM 102 to be edited there. Thereafter, the speech waveform data and envelope data preset in the ROM 101 are read out on the basis of the parameters, time data, etc. edited in the RAM 102, and multiplication operations of the waveform data by the envelope data and further by the peak value are executed. As a result, the tone signal and the noise are obtained. Further, by adding these signals with each other and inputting the result to the loudspeaker on a real time basis, a desired speech can be obtained.

A remarkable advantage of the above-described embodiment is that the pitch of a sound can be controlled by varying a fundamental frequency (pitch). Consequently, an accent or intonation of a speech can be controlled. It is to be noted that in the pitch control according to the above-described embodiment, since the repeated waveform is expanded or contracted as a whole, a sound distortion would not arise between the adjacent waveforms and the pitch period can be arbitrarily varied by a factor of 1–256. Moreover, by varying time data, the duration of the speech can be varied. Furthermore, if a plurality of different repeated waveforms are prepared for each speech, a speech closer to the natural human speech can be synthesized. Since the speech data preset in the ROM are assembled in subroutine regions, they can be utilized in an appropriate combination if desired. Accordingly, the data are greatly compressed, and a large variaty of speeches can be synthesized with a small memory capacity. Further, since the same means as the conventional micro-processor is included in the hardware of the sound synthesizer, in the mode other than the noise interruption processing, tone interruption processing and time interruption processing for achieving the speech synthesis processing, the sound synthesizer according to the present invention can be used also as a conventional information processor. Also, the sound synthesizer according to the present invention can be constructed of a general-purpose micro-processor.

The other advantages of the above-described embodiment will be described hereunder. It is to be noted that in the above-described embodiment, if the memory is made of 8 bits, or if the bit number of the memory and the bit number representing the waveform data and the envelope data, respectively, of each speech are the same, the processing for determining whether the data are an even number or an odd number, is unnecessary.

According to the above-described embodiment, since the change of the amplitude level (envelope level) is effected when the address value for reading out the waveform data is zero, that is, at the time point when the waveform data value is zero, discontinuity of speech caused by the level change would not appear at all. As a result, a smooth speech signal can be obtained. In addition, according to the designation by the mode register (MODE), waveform data of 64-division or 32-division can be selected. In this instance, with respect to a speech containing high-frequency components (a high-pitched sound), a speech having sufficiently good quality can be obtained with the normalized data of 32-division because the variation of the waveform is small. However, with respect to a low-pitched sound, it is more preferable to use the normalized data of 64-division because the variation of the waveform is abrupt. Furthermore, since the numbers of sampling for the waveform data are divided into four groups depending upon the ranges of the fundamental frequency (clock frequency-division ratios of 8–255), the processing speed can be made uniform. Moreover, the above-described embodiment has a remarkable characteristic feature in connection with multiplication operations in that only a shift register and an adder are necessitated. The shift register is controlled in such manner that the data stored therein are shifted leftwards by one bit when the multiplier is "1" and kept intact when the multiplier can be executed. Accordingly, a complex multiplier unit is not necessitated at all. Especially, in the above-described embodiment, only one adder circuit 122 will suffice. It is to be noted that with respect to the mode of processing the speech synthesis, in the above-described embodiment, a sequence of preference is determined in the order of tone interruption, time interruption and noise interruption. Further, provision is made such that each time the tone interruption or noise interruption arises, the tone signal and the noise signal may be synthesized to pronounce a speech.

At this moment, in the case where it is desired to obtain only a noise signal as is the case with the unvoiced sound, it is only necessary to inhibit the tone interruption by clearing the tone signal. On the other hand in the case where it is desired to obtain only a tone signal, it is only necessary to inhibit the noise interruption by clearing the noise signal. Further, data transfer to or from external control instruments or control from external instruments can be also achieved by making use of external input/output terminals 171 and 172 and latch circuits 163 and 164 or an external interruption terminal 170. Moreover, since the ROM, RAM, ALU, accumulator, BC-register, etc. in the above-described speech synthesizer can be used as a conventional data processing unit (micro-computer), not only the synthesis of speeches but also other processing and control can be executed in parallel by the subject speech synthesizer.

As described above, the sound synthesizer according to the present invention can synthesize every sound such as speech, musical sounds, imitation sounds, etc. with a simple hardware construction merely by modifying the ROM codes on the basis of the above-described principle of synthesis. Especially, owing to the fact that the construction of the hardware is simple and also small in memory capacity, the sound synthesizer can be provided at low cost. Accordingly, the scope of application of the sound synthesizer is broad, and hence the synthesizer is applicable to every one of the toys, educational instruments, electric appliances for home use, home computers, various warning apparatuses, musical instruments, automatic-play musical instruments, music-composition and automatic-play musical instruments, automobile control apparatuses, vending machines, cash registers, electronic desk computers, computer terminal units, etc. Also the sound synthesizer according to the present invention has a great merit that it can synthesize various sounds including speech, imitation sounds, musical sounds, etc.

Furthermore, sound synthesizers in which various changes and modifications have been made can be constructed without departing from the spirit of the present invention. For instance, D/A converters of the type that can directly drive an electro-acoustic transducer such as a loudspeaker, could be employed. Moreover, if necessary, one or both of the ROM and the RAM can be constructed as a separate integrated circuit.

Now description will be made of the operations of the sound synthesizer according to the present invention for synthesizing speech sounds of a language other than Japanese (for instance, English).

Figure 24:
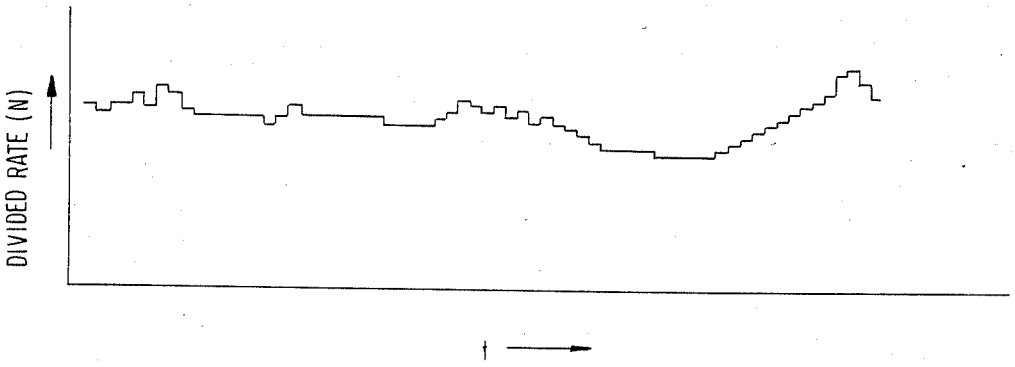
FIG. 24 is a normalized waveform diagram showing a data transition for a frequency-division ratio (pitch) of the speech signal "very good"
Figure 25A:
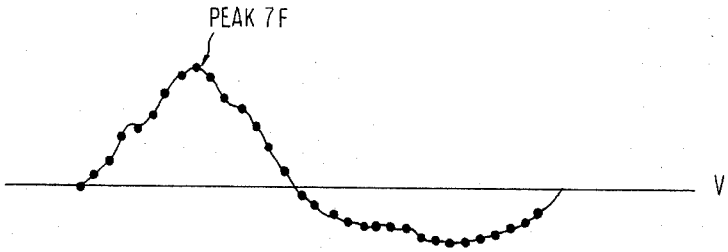
FIGS. 25(*a*) to 25(*n*) are waveform diagrams respectively showing repeated waveform parts extracted from the speech waveform depicted in FIG. 22.
Figure 25B:
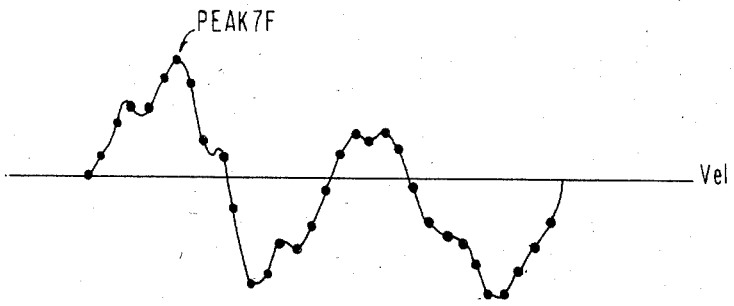
Figure 25C:
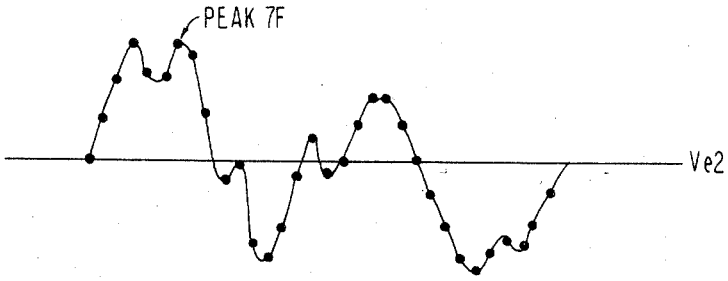
Figure 25D:
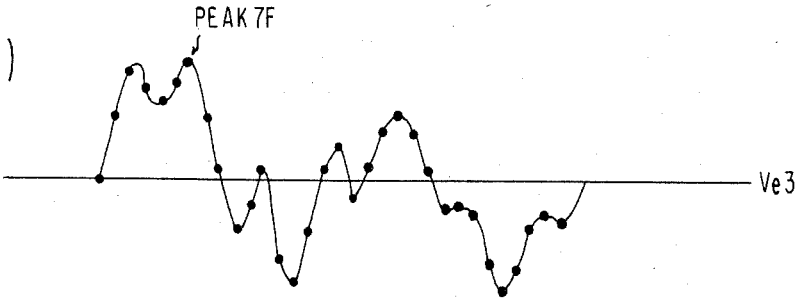
Figure 25E:
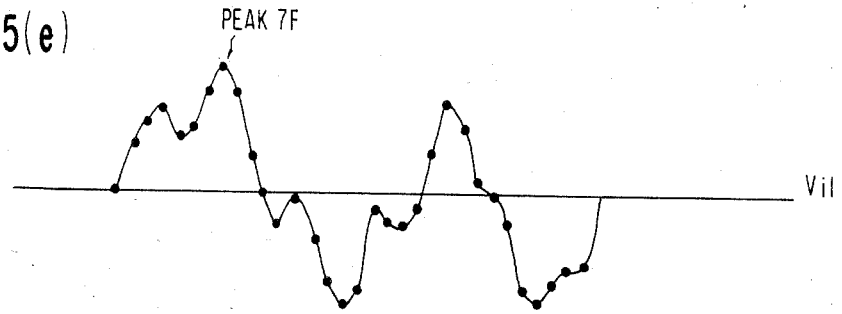
Figure 25F:
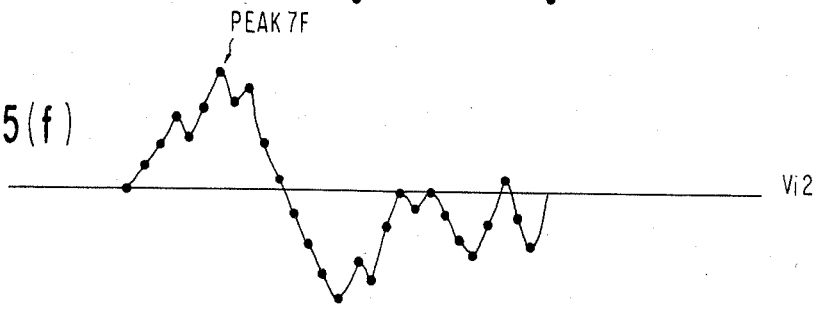
Figure 25G:
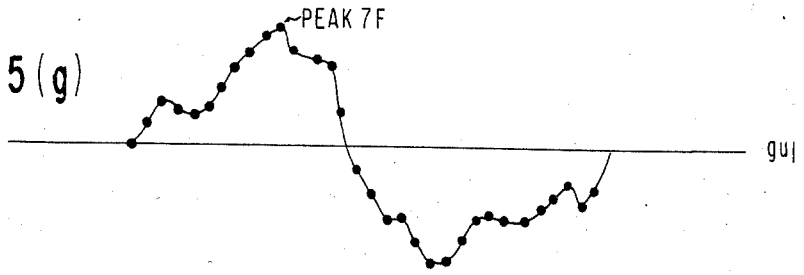
Figure 25H:
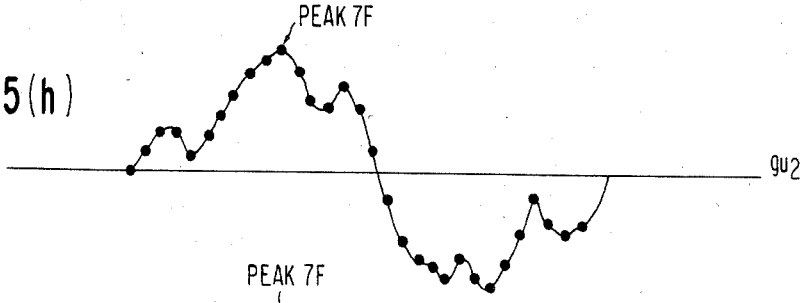
Figure 25I:
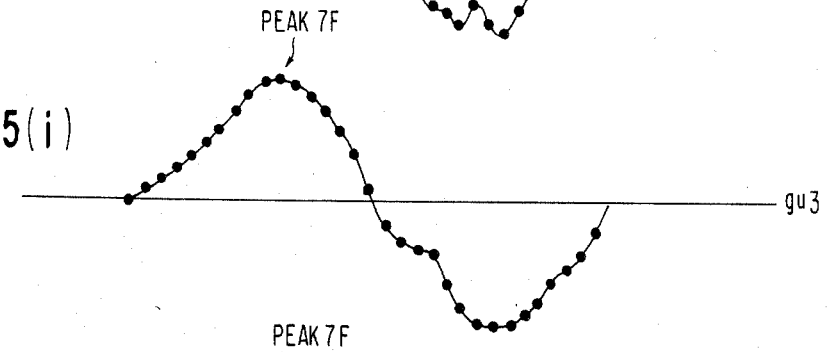
Figure 25J:
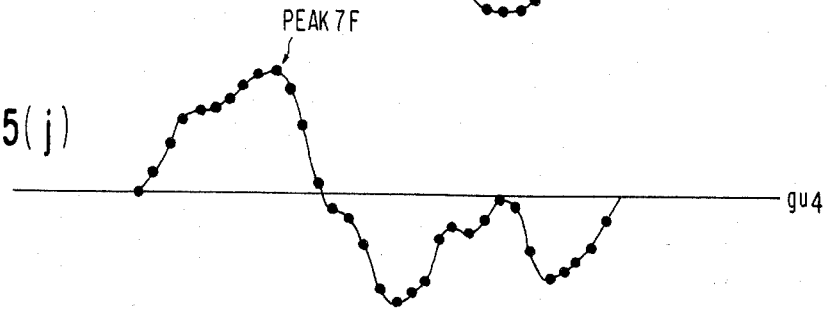
Figure 25K:
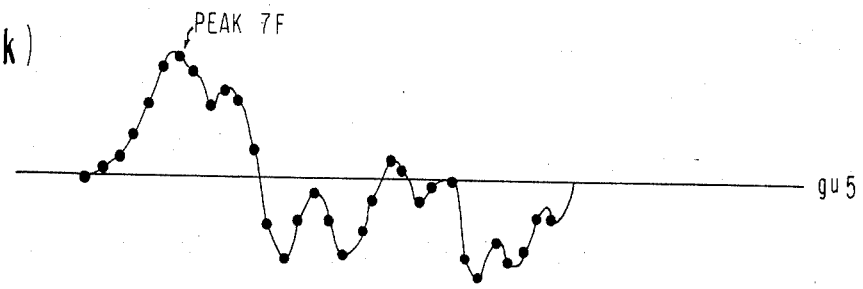
Figure 25L:
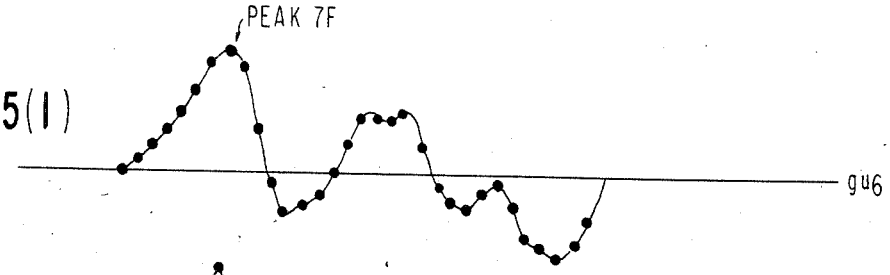
Figure 25M:
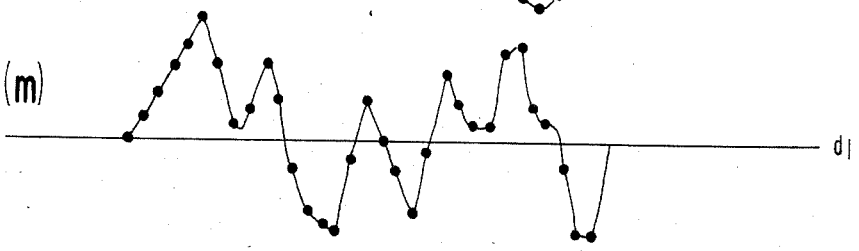
Figure 25N:
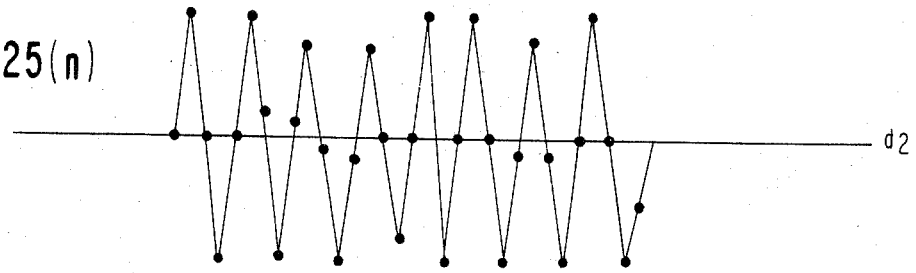

FIG. 22 is a waveform diagram depicting a record of a speech waveform of "very good" in English. A normalized waveform diagram for the envelope waveform of the same speech waveform is shown in FIG. 23. FIG. 24 is a data transition diagram for a frequency-division ratio (pitch) normalized along the time axis. FIGS. 25(*a*) through 25(*n*) are waveform diagrams respectively showing repeated waveform parts extracted from the speech waveform depicted in FIG. 22 as divided into 32 intervals for each waveform part. Their respective waveforms correspond to the portions marked by arrows in FIG. 22. More particularly, FIG. 25(*a*) shows the waveform part marked "V" (waveform name) in FIG. 22, which is repeated 13 times from the beginning of the tone section of the speech sound "very good". FIG. 25(*b*) shows the waveform part marked "$Ve_1$" waveform name in FIG. 22, which is repeated 8 times following the waveform part "V" in FIG. 25(*a*). FIG. 25(*c*) shows the waveform part marked "$Ve_2$" (waveform name) in FIG. 22, which is repeated 10 times following the waveform part "$Ve_1$" in FIG. 25(*b*). FIG. 25(*d*) shows the waveform part marked "$Ve_3$" (waveform name) in FIG. 22, which appears 8 times following the waveform part "$Ve_2$" in FIG. 25(*c*). FIG. 25(*e*) shows the waveform part marked "$ri_1$" (waveform name) in FIG. 22, which appears 13 times repeatedly following the waveform part "$Ve_3$" in FIG. 25(*d*). FIG. 25(*f*) shows the waveform part marked "$ri_2$" (waveform name) in FIG. 22, which appears 16 times repeatedly following the waveform part "$ri_1$" in FIG. 25(*e*). FIG. 25(*g*) shows the waveform part marked "$gu_1$" (waveform name) in FIG. 22, which appears 11 times repeatedly following the waveform part "$ri_2$" in FIG. 25(*f*). FIG. 25(*h*) shows the waveform part marked "$gu_2$" (waveform name) in FIG. 22, which appears 11 times repeatedly following the waveform part "$gu_1$" in FIG. 22. FIG. 25(*i*) shows the waveform part marked "$gu_3$" (waveform name) in FIG. 22, which appears 31 times repeatedly following the waveform part "$gu_2$" in FIG. 25(*h*). FIG. 25(*j*) shows the waveform part marked "$gu_4$" (waveform name) in FIG. 22, which appears 6 times repeatedly following the waveform part "$gu_3$" in FIG. 25(*i*). FIG. 25(*k*) shows the waveform part marked "$gu_5$" (waveform name) in FIG. 22, which appears 10 times following the waveform part "$gu_4$" in FIG. 25(*j*). FIG. 25(*l*) shows the waveform part marked "$gu_6$" in FIG. 22, which appears 9 times repeatedly following the waveform part "$gu_5$" in FIG. 25(*k*). FIG. 25(*m*) shows the repeated waveform part marked "$d_1$" in FIG. 22, which appears only once after the waveform part "$gu_6$" in FIG. 25(*l*). Finally, FIG. 25(*n*) shows the waveform part marked "$d_2$" in FIG. 22, which appears twice repeatedly following the waveform part "$d_1$" in FIG. 25(*m*).

As described above, in the speech waveform "very good" are contained 14 representative repeated waveform parts "V", "$Ve_1$" "$Ve_2$", "$Ve_3$", "$ri_1$", "$ri_2$", "$gu_1$", "$gu_2$", "$gu_3$", "$gu_4$", "$gu_5$", "$gu_6$", "$d_1$" and "$d_2$". The respective waveform parts are sampled as divided into 32 intervals. The sampled data are prepared in the tables of the ROM 101 shown in FIG. 10. In addition, with respect to the envelope waveform shown in FIG. 23, sampled data of the waveform are also prepared in another table of the ROM 101 shown in FIG. 10. The pitch data shown in FIG. 24 are data used for determining the pitch of the synthesized speech sound. According to these pitch data, the speech sound "very good" is given an accent and intonation. These pitch data are stored in the frequency-division ratio register 123 in FIG. 10.

A first, the initial noise section is synthesized. This is obtained by multiplying the noise envelope data as shown in FIG. 23 which are read out of the ROM 101 by the random waveform data generated by the polynomial counters (PNC 1 and PNC 2) shown in FIG. 10. With regard to the multiplication processing, it is only necessary to execute the routine shown in FIG. 12. Next, the synthesis processing for the waveform parts "V" in FIG. 25(*a*) is executed according to the routine shown in FIGS. 20(*a*) and 20(*b*). In this instance, the sampled repeated waveform part data are selectively read out of the ROM 101 according to the pitch data. In each repetition period, the read waveform data are multiplied by the corresponding envelope data. It is to be noted that the waveform part "V" is read out 13 times. However, in every cycle, the desired waveform part data are read out at the desired pitch frequency as controlled by the pitch data. Also, the envelope data have generally different values in each cycle as will be apparent from FIG. 23. In a similar manner, the multiplication processings are executed for the remaining repeated waveforms. The resultant noise signal and tone signal are subjected to D/A conversion and successively transferred to the loudspeaker. The procedure of such synthesis processing is apparently the same as that employed for the synthesis of Japanese. That is, the procedure consists of the steps of preliminarily sampling repeated waveform parts contained in each syllable at a predetermined number of divisions, storing the sampled data in a ROM, selectively reading out desired sampled waveform data from the ROM at a given pitch frequency, and multiplying the read waveform data by given envelope data, whereby a speech sound signal having desired pitch and amplitude level can be obtained.

According to this sound synthesizer system, not only English but also speech sounds of any language such as German, French, etc. can be easily synthesized through the same procedure. Furthermore, this system does not require any complex processing. Among the 14 kinds of repeated waveform parts depicted in FIG. 22 and FIGS. 25(*a*) through 25(*n*), those appearing in speech sounds other than the speech "very good", can be used in common. More specifically, by presetting the pitch data, every speech sound can be synthesized provided that all the repeated waveform parts contained in the vowels and consonants of the respective languages are prepared in the ROM. Owing to the above-described approach for the speech synthesis, the necessary amount of information can be greatly compressed, so that a memory device having a small memory capacity will suffice for the proposed speech synthesis. In addition, besides the above-described speech data, a peak value for controlling the intensity of a sound could be preset. In this event, it is only necessary to execute another multiplication operation (the above-described MULT instruction). Although polynomial counters were used as means for generating noise waveform data in the above-described embodiment, the waveform of the noise section shown in FIG. 22 could be sampled and stored in the table of the ROM. However, in this case, it should be noted that unless a table reference instruction for reading the sampled data of the noise waveform from the table in the ROM is repeatedly executed, the noise waveform data cannot be derived. Whereas, in the case of employing polynomial counters, the noise waveform data can be used repeatedly without executing the table reference instruction.

While one example of the process of depicting repeated waveform parts and an envelope waveform by analyzing a speech sound signal has been presented in the above-described embodiment of the present invention, the repeated waveform parts and their envelope waveform could be depicted with respect to each phone.

The hardware circuit shown in FIG. 10 includes, besides the essential elements which are necessitated for achieving the principal object of the present invention, various other elements which will achieve useful effects upon practical operations. Hence, the present invention can be realized by means of a different circuit from the circuit shown in FIG. 10. Especially with regard to the information to be set in a memory, it is only required that waveform information obtained by normalizing partial repeated waveforms in the speech signal waveform at every unit time interval, an envelope information for designating amplitude levels of the repeated waveforms, and pitch information for designating the periods of the repeated waveforms should be prepared.

With regard to the waveform information, a favorable method of normalization is one in which among all the repeated waveforms to be prepared (in a particular case they may include an exceptional waveform which appears only once and is not repeated), the amplitude value at the highest amplitude level point is selected as a full scale. However, the normalization ratio could be independently determined for each repeated waveform. Furthermore, by selecting a particular waveform as a reference, a difference between the respective repeated waveforms and the particular waveform could be used as a waveform information. In other words, it is only necessary that the repeated waveforms for determining the tone of a speech be obtained on the basis of the waveform information.

The envelope information is only required to be an information adapted to designate an amplitude ratio of each repetition of the repeated waveforms relative to a certain reference repetition. Assuming that a certain repeated waveform appears 10 times repeatedly, then an information adapted to determine the amplitude ratio of each repetition of the waveform relative to a certain reference repetition such as, for example, the first repetition, is the envelope information. This envelope informations need not be prepared as many times as the number of repeated waveforms to be prepared, so that the envelope information may correspond to the respective repeated waveforms in a predetermined relation (for example one to one). For instance, one envelope information may be modified to another envelope information by programmed control. This processing for modification can be easily executed by means of an arithmetic unit or a shift register.

The pitch information is an information for determining a period of a repeated waveform. With regard to this pitch information also, it need not be prepared as many as the number of the repeated waveforms. If necessary, this information could be applied externally to the speech synthesizer. However, it is desirable to provide means for selecting an information conformable to the pitch information from waveform information prepared on the basis of one repeated waveform. In other words, a circuit for producing a higher-harmonics waveform information conformable to the pitch information from the prepared repeated waveform information, is desired. In this case, the produced higher harmonics waveform information is multiplied by the envelope information. As a result, a speech signal having a desired pitch can be synthesized.

In the case where an unvoiced sound is included in the speech sound to be synthesized, any arbitrary repeated waveform information could be used as a waveform information for the unvoiced sound. Or else, a particular waveform information for the unvoiced sound could be preliminarily stored in a memory. In addition, by setting a peak value information for controlling an intensity of a speech sound, the amplitude of the speech sound signal can be amplified to a desired level.

Figure 26:
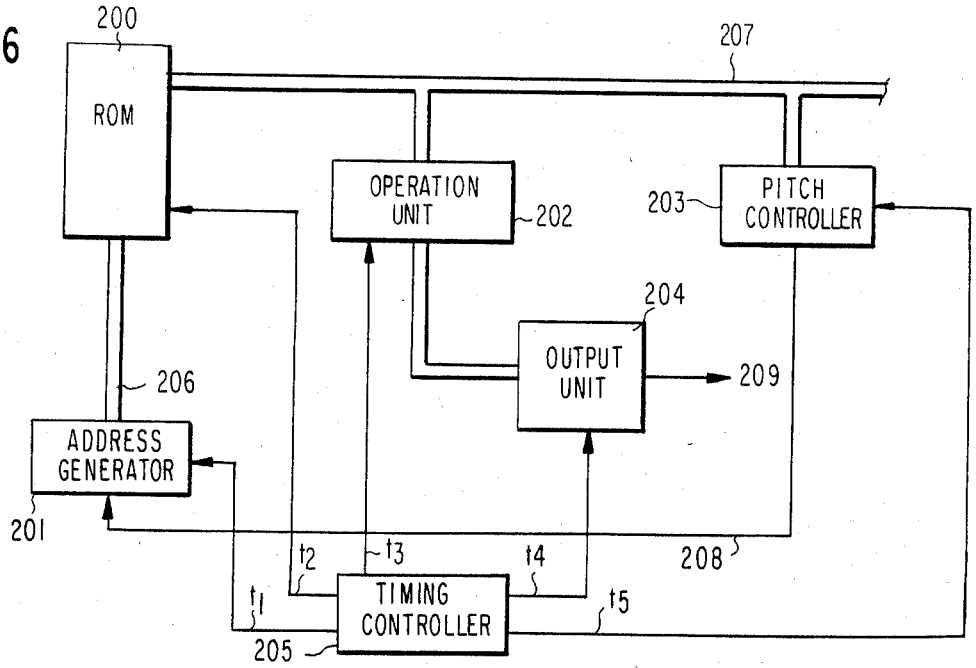
FIG. 26 is a block diagram of a third embodiment of the present invention.

In the following, another preferred embodiment of the sound synthesizer according to the present invention will be explained. FIG. 26 is a block diagram for illustrating a hardware construction of the sound synthesizer. All the blocks are integrated on the semiconductor substrate. In the ROM 200 are stored information of the repeated waveforms, an envelope information and a pitch information. Designation of address for the ROM 200 is achieved by an address generator 201 including a programmable counter. The waveform information and the envelope information stored in the ROM 200 are transferred to an operation unit 202. The operation unit 202 includes a plurality of registers for temporarily storing the transferred information and a logic operation circuit. In addition, the pitch information read out of the ROM 200 is transferred to a pitch controller 203. The data obtained as a result of processing in the operation unit 202 are transferred to an output unit 204. The output unit 204 produces a speech sound signal from the resultant data transferred from the operation unit 202. The respective operations of the ROM 200, address generator 201, operation unit 202, pitch controller 203 and output unit 204 are controlled by timing signals $t$–$t_5$ generated from a timing controller 205.

Upon commencement of the speech synthesis, the address generator 201 transfers address data of the ROM 200 where the speech information to be synthesized is stored, via a bus 206 to the ROM 200. The pitch information read according to the address data is transferred via a bus 207 to the pitch controller 203. The pitch controller 203 sends one of a plurality of pitch control signals 208 to the address generator 201, depending upon the pitch information. The pitch control signal 208 is a signal for controlling the mode of stepping for the address. In response to this pitch control signal 208, the address generator sets up the address data series to be generated. For instance, the pitch control signals and series of address data are related as shown in the following table:

| Pitch Control Signals | Series of Address Data |
|---|---|
| $C_1$ | N, N + 1, N + 2, N + 3, . . . |
| $C_2$ | N, N + 2, N + 4, N + 6, . . . |
| $C_3$ | N, N + 3, N + 6, N + 9, . . . |
| $C_4$ | N, N + 4, N + 8, N + 18, . . . |
| . | |
| . | |
| . | |
| $C_n$ | N, N + n, N + 2n, N + 3n, . . . |
| . | |
| . | |
| . | |

In the above table, $C_1$, $C_2$, . . . $C_n$, respectively, are names of different pitch control signals. N represents any arbitrary address data, which is a start data for a waveform information to be read out, and n represents any arbitrary integer.

As will be apparent from the above table, when the pitch control signal $C_1$ is generated, the address data N is incremented one by one. Consequently, all the prepared waveform information are read out. Whereas, if the pitch control signal $C_2$ is generated, the address data N is incremented each time by two. Consequently, alternate ones of the prepared waveform information are read out. In this way, for example, if the pitch control signal $C_n$ is generated, the address data N is incremented each time by n. In this case, among the prepared waveform informations, the N-th, (N+n)-th, (N+2n)-th, . . . informations are read out. Consequently, the waveform informations are read out at the period determined by the pitch control signal $C_1$, $C_2$, . . . , etc. That is, the pitch of the synthesized speech sound can be arbitrarily controlled by changing the pitch information. In other words, by making the sampling period for the waveform information variable, a higher harmonics waveform for the fundamental waveform can be produced.

The waveform informations selectively read out according to such an addressing system are multiplied by the envelope information. This processing is executed by the operation unit 201. The method for multiplication could be either multiplication by 2n by means of a shift register or multiplication by n by means of a register and an adder. The resultant data are derived in the form of a speech sound signal 209 through the output unit 204. Since this speech sound signal is associated with an accent and an intonation, a speech sound closely approximated to the natural human speech can be obtained.

It is to be noted that the duration of the synthesized speech sound can be varied by varying the read-out time for the envelope and/or pitch information as well as the number of repeated reading operations of the waveform information for one repeated waveform. In addition, the intensity of a sound can be controlled by further multiplying the product of the envelope information by the waveform information, and by an amplitude information. These procedures are exactly the same as those described previously.

The circuit of the sound synthesizer illustrated in FIG. 10 could be partly modified as shown in FIGS. 27 to 31. It is to be noted that in the respective figures, circuit components designated by the same reference numerals and reference symbols as those appearing in FIG. 10 have like functions. Accordingly, for clarification of understanding, only such portions in the respective figures as being characteristic of the respective modifications will now be explained.

Figure 27:
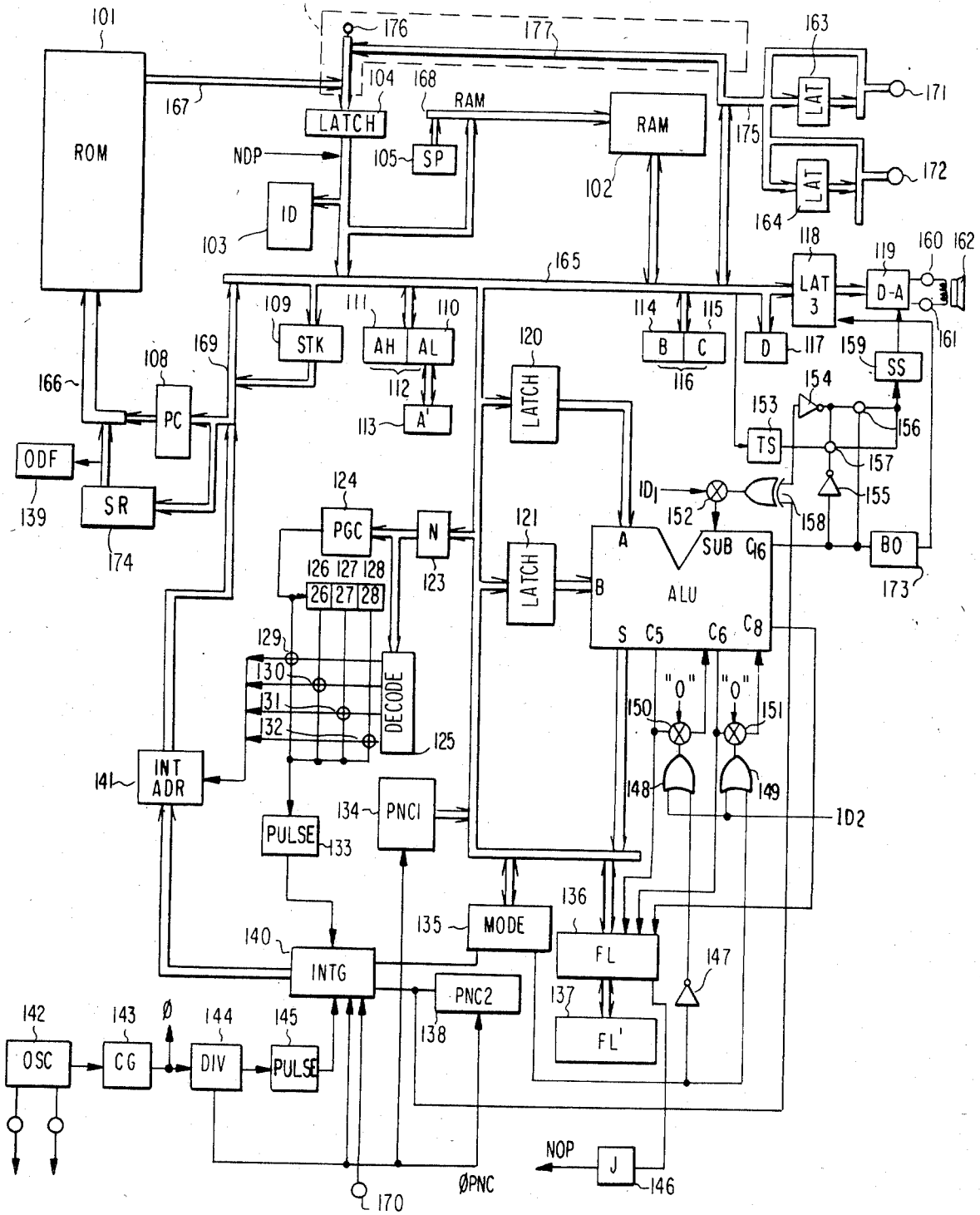
FIGS. 27 to 31 are block diagrams of other embodiments of the present invention.

In the case where the circuit arrangement shown in FIG. 10 is formed on one semiconductor substrate by making use of the technique of semiconductor integrated circuits, operation check tests for the respective circuit components are necessary. In such a case, the circuit arrangement illustrated within a dash-line frame 27-A in FIG. 27 is useful. The circuit portion enclosed by the dashline frame 27-A is composed of a terminal 176 for inputting an external signal, and a bus 177 for connecting the bus 175 with the bus 167. In this modified circuit arrangement, a test program fed through the input/output ports 171 and 172 can be set in the latch 104 via the bus 177 by inputting a switching signal to the input terminal 176. Accordingly, the circuit arrangement except for the ROM 101 can be tested by means of a program other than that preset in the ROM 101. Further, if control is made such that the bus 167 and the bus 177 are connected by a switching signal, then the information stored in the ROM 101 can be directly monitored at the input/output ports 171 and 172 via the bus 167 and the bus 177. Accordingly, debugging processing of the contents of the memory can be achieved in a very simple manner.

Figure 28:
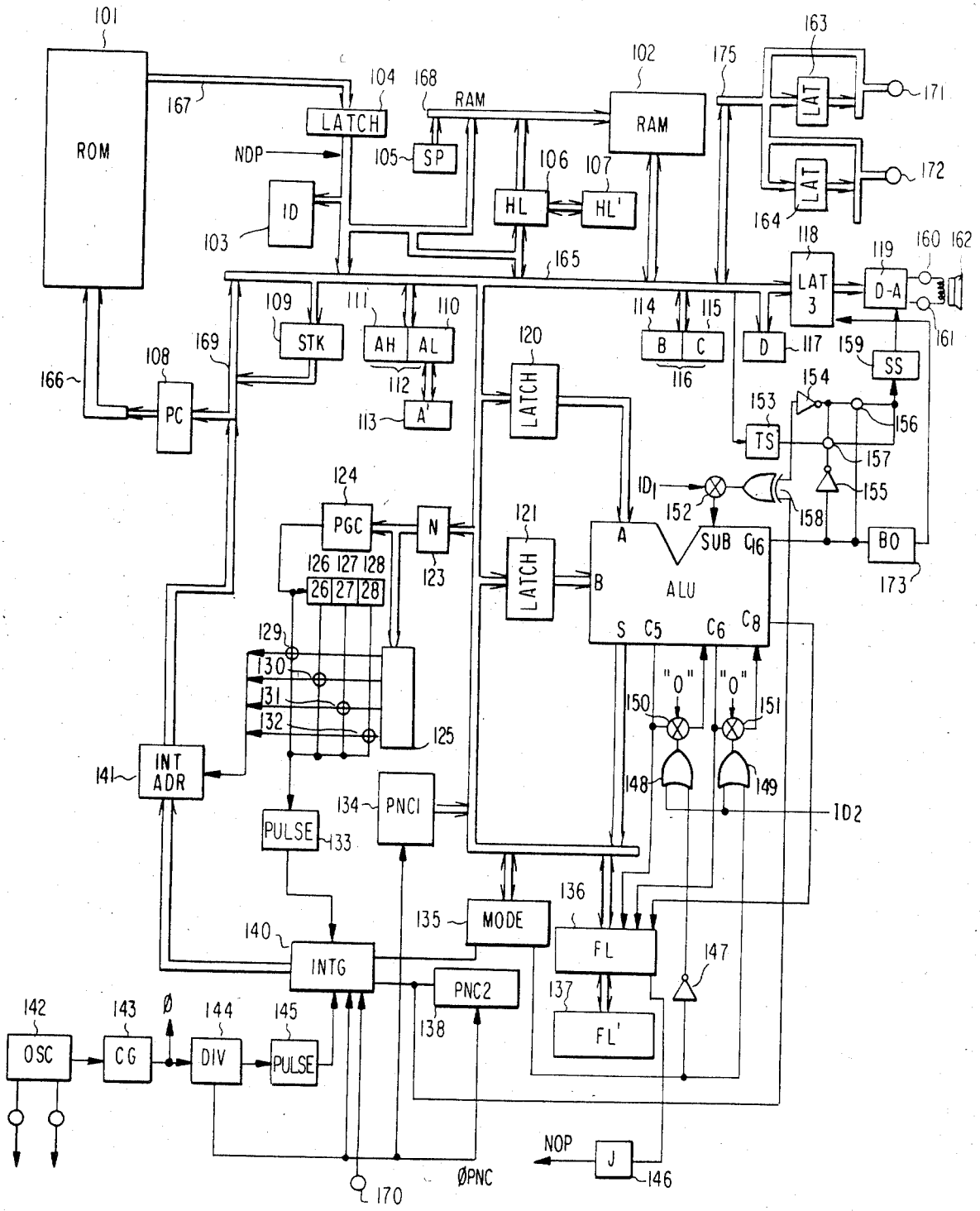

The one-bit right shift register 174 and the odd-number designation flip-flop 139 shown in FIG. 10 could be omitted. In other words, a modified circuit arrangement as shown in FIG. 28 can be conceived. In this modification, the HL-register 106 and the HL'-register 107 are used in place of the one-bit right shift register 174 and the odd-number designation flip-flop 139. The HL-register 106 operates as a data pointer upon normal data processing. The HL'-register 107 is a register in which the contents of the HL-register 106 are temporarily sheltered. It is to be noted that each of the HL- and HL'-register 106 and 107 consists of an H-register and an L-register. Accordingly, control could be made such that when the H- and L-registers are both set to "0", the sub-regions $R_0$, $R_2$, $R_4$, . . . $R_{2n}$ of the RAM 102 are selected, and when the L-register is set to "1", the sub-regions $R_1$, $R_3$, $R_5$, . . . $R_{2n+1}$ are selected. However, in the event that the numbers of bits of the information to be processed are united to the same bit number, then such means is unnecessary.

Figure 29:
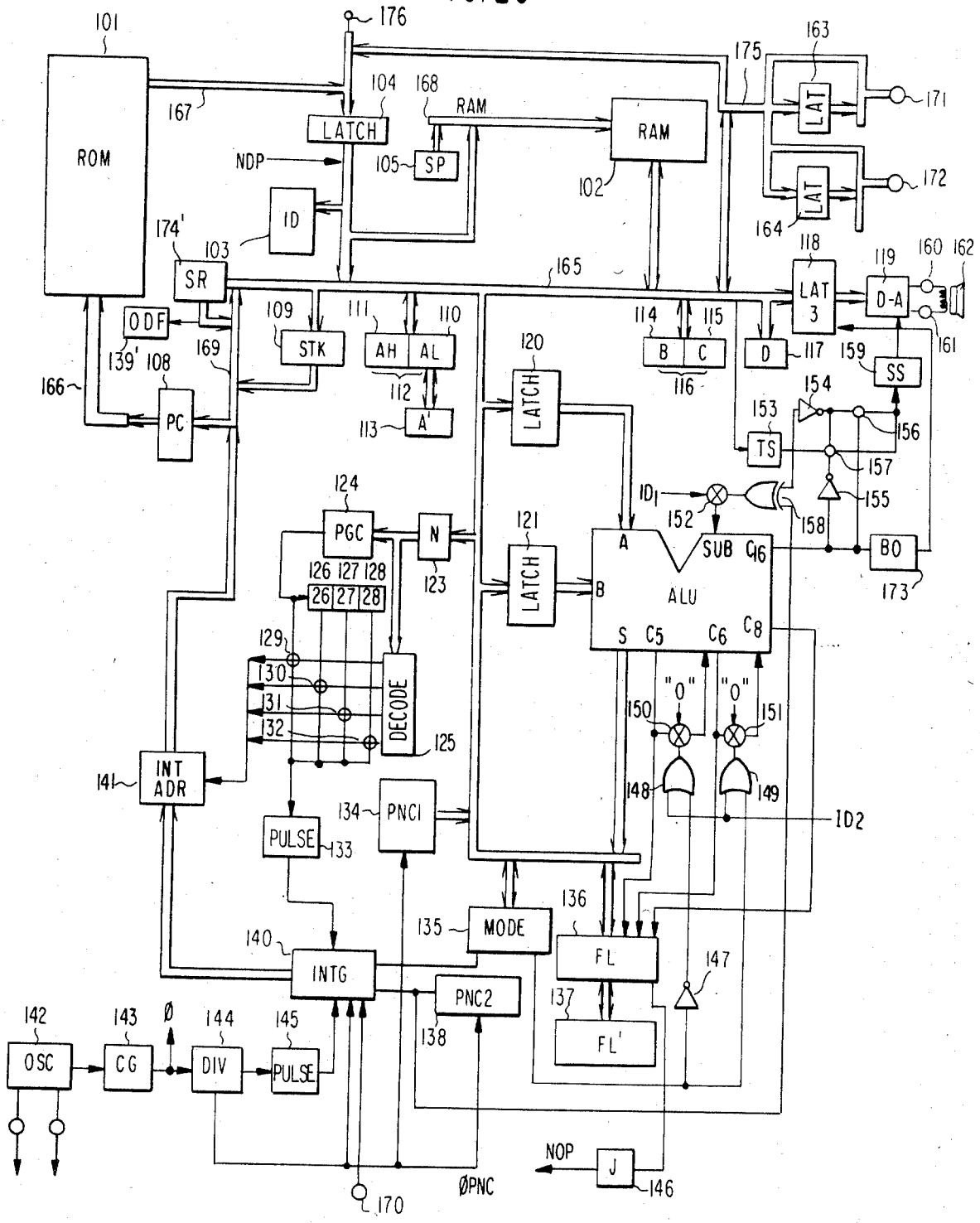
Figure 30:
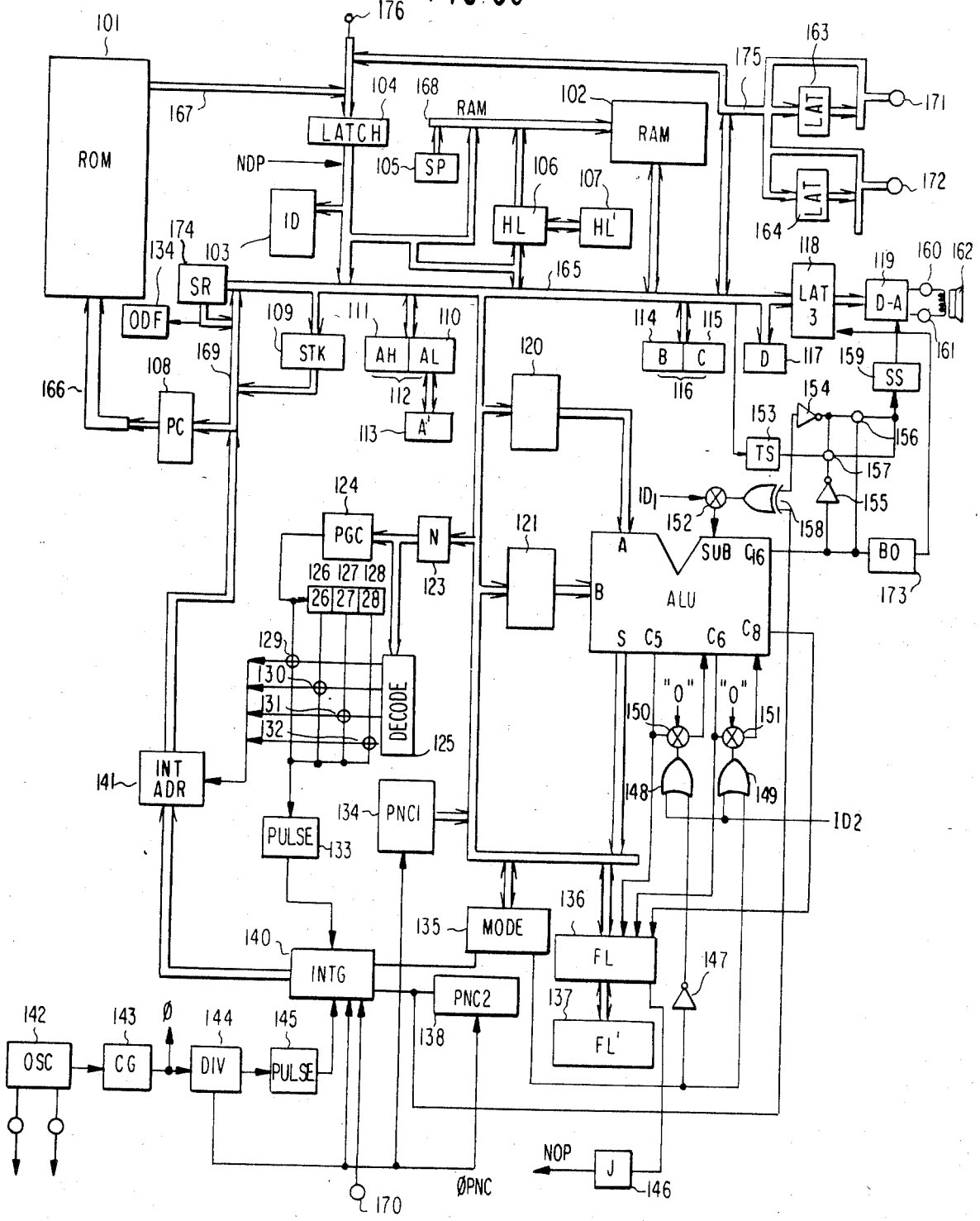

Furthermore, the one-bit right shift register 174 and the odd-number designation flip-flop 139 could be provided in a stage preceding the program counter 108 as shown in FIG. 29. In FIG. 29, a one-bit right shift register 174' and an odd-number designation flip-flop 139' are equivalent to the components 174 and 139 in FIG. 10. In this modification, the output of the one-bit right shift register 174' is applied to the input of the program counter 108 via the bus 169.

Figure 31:
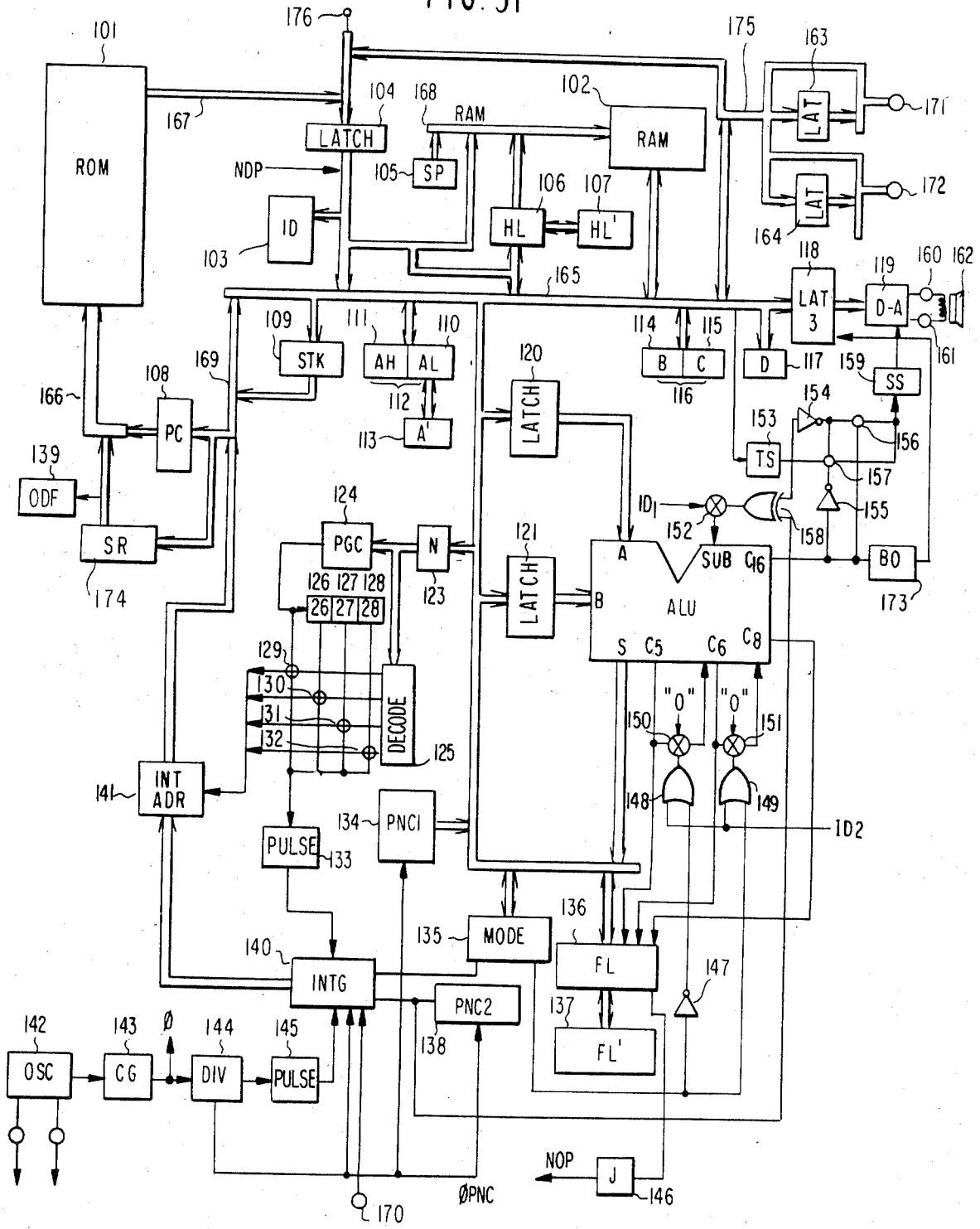

The circuit arrangements shown in FIGS. 28 and 29, respectively, could be combined into the circuit arrangement shown in FIG. 31. However, it will be obvious that the basic operation of the sound synthesizers illustrated in FIGS. 27 through 31 is the same as the operation of the sound synthesizer shown in FIG. 10.

In the above-described embodiments of the present invention, if information including durations of musical tone signs and musical pause signs, frequency-division ratios (pitches) for determining the musical scale, maximum amplitude values, repeat positions, etc. are preset in the ROM 101, then any musical piece can be played automatically. It will be obvious that the tone of the musical instrument for playing the musical piece can be arbitrarily changed. Furthermore, by making use of the contents of the data pointer (HL-register) 106, designation of address for a large-capacity RAM can be achieved. Accordingly, by employing this data pointer as an equivalent one for the chip selection circuit, the scope of application of the sound synthesizer according to the present invention can be expanded further. In the event of synthesizing a music piece, if a keyed signal is input to the sound synthesizer through external key input means, then automatic playing can be achieved on the basis of the keyed signal. Moreover, the sound synthesis system of the present invention can be applicable to all sound information obtained by the DM, PCM, DPCM, ADM, APC, etc. Desirable sound signals forming speech, words, sentences, etc. are synthesized easily by using desired repeated tone waveform data and/or noise waveform data in the present invention.

What is claimed is:

1. A sound synthesizer comprising:

memory means for storing waveform information obtained by normalizing, along a time axis, one repeated waveform extracted from a group of waveforms repeatedly appearing a plurality of times within a speech sound waveform, said group of waveforms being substantially similar in configuration to each other, the extracted waveform information being stored at a group of memory locations of a predetermined number in said memory means, and for storing a plurality of groups of amplitude information for designating amplitude levels of said repeatedly appearing waveforms;

means for designating a number of memory locations for said waveform information to be read out of said memory means, said number of designated memory locations being equal to said predetermined number of memory locations when a speech sound having the same tone frequency as that of a recorded speech sound is to be synthesized, and said number of designated memory locations being less than said predetermined number of memory locations when a speech sound having a tone frequency higher than that of said recorded speech sound is to be synthesized, the ratio of said designated number to said predetermined number depending upon the frequency of the tone of the speech sound to be synthesized;

means for reading said waveform information from the designated memory locations and for reading a designated group of amplitude information out of said memory means at a fixed rate regardless of the tone frequency of the speech sound to be synthesized;

means for defining a multiplying interval for said designated group of amplitude information;

means for producing a speech sound data by multiplying said read-out waveform information by said designated group of amplitude information during said defined multiplying interval;

means for setting a start value of one of the produced speech sound data and an end value of a next one of the produced speech sound data to be zero; and means for sequentially linking said one of said speech sound data to said next one of said speech sound data adjacent thereto.

2. A sound synthesizer for producing a sound of the type having at least one unvoiced sound waveform and at least one repeated voiced sound waveform, said synthesizer comprising:

memory means for storing said at least one unvoiced sound waveform in the form of a plurality of normalized noise waveform data, for storing said at least one repeated voiced sound waveform in the form of a plurality of normalized sound waveform data, for storing first amplitude information of said unvoiced sound waveform in the form of normalized first amplitude data, and for storing second amplitude information of said voiced sound waveform in the form of normalized second amplitude data;

means for selecting normalized sound waveform data to be read out of said memory means among said plurality of normalized sound waveform data in accordance with a tone frequency of a sound signal to be synthesized, all of said plurality of normalized sound waveform data stored in said memory means being read out from said memory means when a sound of the same tone frequency as that of a recorded sound is to be synthesized, and a less than entire portion of said plurality of normalized sound waveform data being read out of said memory means when a sound with a higher tone frequency than that of said recorded sound is to be synthesized;

addressing means for reading said normalized noise waveform data, said normalized sound waveform data according to said selecting means, said normalized first amplitude data and said normalized second amplitude data out of said memory means at a fixed rate regardless of the tone frequency of the sound to be synthesized;

multiplying means for multiplying said normalized noise waveform data by said normalized first amplitude data to produce an unvoiced sound waveform, and for multiplying said normalized sound waveform data by said normalized second amplitude data to produce a voiced sound waveform;

adding means for adding said produced unvoiced sound waveform and said produced voiced sound waveform to each other at every time point such that the two waveforms overlap one another; and output means for transferring the added waveforms to a speaker.

3. A sound synthesis system for synthesizing a sound signal by using prepared information in the form of a plurality of normalized sound waveform data and normalized amplitude data segmented at points along the time axis for a sound signal, said system comprising:

memory means for storing said plurality of normalized sound waveform data and said normalized amplitude data, each of said normalized sound waveform data being stored at respective ones of a predetermined number of memory locations;

means for generating a pitch signal corresponding to the desired pitch of the sound to be synthesized;

means for designating a number of memory locations from which normalized sound waveform data is to be read out of said memory means, said designated number being determined by said pitch signal and being equal to said predetermined number when a sound signal having the same tone frequency as a recorded sound is to be synthesized, and said designated number being less than said predetermined number and being determined in accordance with the tone frequency of a sound signal to be synthesized when a sound signal having a different tone frequency from that of said recorded sound is to be synthesized;

means for reading the sound waveform data out of the designated number of memory locations of said memory means at a fixed rate regardless of the tone frequency of the sound signal to be synthesized;

means for reading said normalized amplitude data out of said memory means; and means for synthesizing a sound signal with said desired pitch by combining the read-out sound waveform data with the read-out amplitude data.

4. An apparatus for generating a sound signal in which a plurality of tone waveforms are each repeated plural times, said apparatus comprising:

a first memory for storing data representing said plurality of repeated tone waveforms and for storing data representing a noise waveform in said sound signal, said plurality of repeated tone waveform data corresponding to a voiced sound signal part of said sound signal and having a plurality of digital data, respectively, and said noise waveform data corresponding to an unvoiced-sound signal part of said sound signal;

a second memory for storing first envelope data designating a first group of amplitudes in said voiced sound signal part of said sound signal and a second envelope data designating a second group of amplitudes in said unvoiced sound signal part of said sound signal;

means for designating tone waveform data to be read out of said first memory means according to a tone frequency of a sound signal to be synthesized, all of said plurality of digital data of said plurality of repeated tone waveforms being designated when a sound signal having the same tone frequency as that of a recorded sound signal is to be synthesized, and a less than entire portion of said plurality of digital data being designated in accordance with a tone frequency of a sound signal to be synthesized when a sound signal having a higher tone frequency than that of said recorded sound signal is to be synthesized;

addressing means for reading the designated plurality of digital data of each of said plurality of repeated tone waveform data, said noise waveform data, said first envelope data and said second envelope data out of said first and second memories, respectively;

means for selecting one of a first plurality of multiplying intervals for said first envelope data and for selecting one of a second plurality of multiplying intervals for said second envelope data;

first means for multiplying the read-out plurality of digital data of each of said repeated tone waveforms by respective ones of said first group of amplitudes during the selected one of said first plurality of multiplying intervals;

second means for multiplying said noise waveform data by respective ones of said second group of amplitudes during the selected one of said second plurality of multiplying intervals;

means for linking multiplication results along a time axis in such a manner that a start data and end data of the multiplication results of each of said repeated tone waveforms is zero; and means for generating a synthesized sound signal by adding the multiplied tone waveform data and the multiplied noise waveform data to each other so as to overlap the multiplied two data.

5. A sound synthesizer as defined in claim 2, wherein said one repeated voiced sound waveform appears a plurality of times in said speech sound waveform at different amplitude levels, said normalized second amplitude information designating the different amplitude levels of each repetition of said repeated voiced sound waveform.

6. A sound synthesis system as define in claim 3, wherein said normalized sound and amplitude data respectively comprise tone waveforms and amplitude envelope waveforms each segmented into a plurality of waveform segments, and wherein said means for reading said sound waveform data and said means for reading said normalized amplitude data select equally spaced segments for multiplication, with the spacing of selected segments being determined by said pitch information.

7. A sound synthesizer for synthesizing a sound signal by using prepared information in the form of a plurality of normalized sound waveform data and normalized amplitude data segmented at points along the time axis for a sound signal, said sound synthesizer comprising:

first memory means for storing said plurality of normalized sound waveform data such that odd numbered sound waveform data and even numbered sound waveform data are separately stored in first and second areas, respectively, of sequential memory address locations;

second memory means for storing said normalized amplitude data;

first means for reading said normalized sound waveform data out of both of said first and second areas of said memory address locations when a sound signal having the same tone frequency as that of a recorded sound signal is to be synthesized, and for reading said normalized sound waveform data out of either one of said first and second areas of said sequential memory address locations when a second signal having a tone frequency twice that of said recorded sound signal is to be synthesized;

second means for sequentially reading said normalized amplitude data out of said second memory means in accordance with a pitch period defined by a tone frequency of a sound signal to be synthesized;

means for multiplying the read-out normalized sound waveform data by the read-out normalized amplitude data; and means for generating a sound signal according to a multiplication result in said multiplying means.

* * * * *